US007757317B2

(12) United States Patent
Ganance et al.

(10) Patent No.: US 7,757,317 B2
(45) Date of Patent: Jul. 20, 2010

(54) STOWING BIRTHING BED FOOT SECTION

(75) Inventors: Francis C. Ganance, Cincinnati, OH (US); Robert Cooks, Cincinnati, OH (US); Kenneth L. Kramer, Greensburg, IN (US); Jerome E. Reckelhoff, Blue Ash, OH (US); Peter M. Wukusick, Batesville, IN (US); Robert M. Zerhusen, Cincinnati, OH (US); Mark E. Haufler, Cincinnati, OH (US); Darrell L. Metz, Batesville, IN (US); Kenneth Q. Rudolf, Batesville, IN (US); Stephen M. Holl, Columbus, IN (US); Richard W. Chance, Greenwood, IN (US); David W. Hornbach, Brookville, IN (US); John P. Biondo, Durant, IA (US)

(73) Assignee: Hill-Rom Services, Inc., Wilmington, DE (US)

( * ) Notice: Subject to any disclaimer, the term of this patent is extended or adjusted under 35 U.S.C. 154(b) by 661 days.

(21) Appl. No.: 11/560,346

(22) Filed: Nov. 15, 2006

(65) Prior Publication Data

US 2007/0157386 A1 Jul. 12, 2007

Related U.S. Application Data

(60) Provisional application No. 60/737,820, filed on Nov. 17, 2005, provisional application No. 60/803,841, filed on Jun. 2, 2006.

(51) Int. Cl.
*A61G 7/015* (2006.01)
*A61G 7/075* (2006.01)

(52) U.S. Cl. ..... 5/602; 5/624; 5/648

(58) Field of Classification Search ..... 5/602, 5/613, 621, 624, 600, 648, 722, 723, 661
See application file for complete search history.

(56) References Cited

U.S. PATENT DOCUMENTS

| | | | |
|---|---|---|---|
| 336,577 | A | 2/1886 | MacKenzie |
| 336,578 | A | 2/1886 | Main |
| 388,995 | A | 9/1888 | Moxham |
| 469,837 | A | 3/1892 | Fulton |
| 964,170 | A | 7/1910 | Leonard |
| 1,469,841 | A | 10/1923 | Leon |
| 1,469,928 | A | 10/1923 | Leon |
| 1,835,021 | A | 12/1931 | Decker |

(Continued)

FOREIGN PATENT DOCUMENTS

GB 2405789 3/2005

OTHER PUBLICATIONS

European Search Report for Application No. 06255878.8—1257/1787617, Dec. 19, 2008, 4 pages.

(Continued)

*Primary Examiner*—Robert G Santos
(74) *Attorney, Agent, or Firm*—Barnes & Thornburg LLP

(57) ABSTRACT

A patient-support apparatus includes receivers for supporting a patient-support deck. The patient-support deck is configured to engage the receivers to support the deck in a cantilevered configuration. The patient-support deck may be secured to the patient-support apparatus by a locking mechanism.

20 Claims, 42 Drawing Sheets

U.S. PATENT DOCUMENTS

| | | | |
|---|---|---|---|
| 1,930,993 | A | 10/1933 | Blodgett |
| 2,021,107 | A | 11/1935 | Logie |
| 2,067,891 | A | 1/1937 | Adrian |
| 2,120,732 | A | 6/1938 | Adrian |
| 2,257,491 | A | 9/1941 | Armstrong |
| 2,275,973 | A | 3/1942 | Marchbanks |
| 2,290,191 | A | 7/1942 | Stig |
| 2,323,060 | A | 6/1943 | Larsson |
| 2,381,633 | A | 8/1945 | Weare |
| 2,470,524 | A | 5/1949 | Scudder |
| 2,605,151 | A | 7/1952 | Robert |
| 2,640,998 | A | 6/1953 | Myre |
| 2,658,211 | A | 11/1953 | Sadie |
| 2,754,142 | A | 7/1956 | Baker, Jr. |
| 2,757,058 | A | 7/1956 | Broesel |
| 2,766,463 | A | 10/1956 | Sadie |
| 2,832,655 | A | 4/1958 | Adolphson |
| 2,872,259 | A | 2/1959 | James |
| 3,041,120 | A | 6/1962 | Adrian |
| 3,041,121 | A | 6/1962 | Adrian |
| 3,041,122 | A | 6/1962 | Weickgenannt |
| 3,100,129 | A | 8/1963 | Adolphson |
| 3,167,789 | A | 2/1965 | Wicks |
| 3,220,022 | A | 11/1965 | Ted |
| 3,226,105 | A | 12/1965 | Weickgenannt |
| 3,227,440 | A | 1/1966 | Scott |
| 3,231,905 | A | 2/1966 | Brochu |
| 3,281,141 | A | 10/1966 | Smiley et al. |
| 3,318,596 | A | 5/1967 | Herzog |
| 3,334,951 | A | 8/1967 | Chervenka |
| 3,411,766 | A | 11/1968 | Lanigan |
| 3,486,747 | A | 12/1969 | Cardoso |
| 3,492,679 | A | 2/1970 | Drew |
| 3,587,592 | A | 6/1971 | Price |
| 3,599,963 | A | 8/1971 | Grover |
| 3,686,696 | A | 8/1972 | Lanigan |
| 3,733,481 | A | 5/1973 | Kuyt |
| 3,764,795 | A | 10/1973 | Austin, Jr. |
| 3,813,091 | A | 5/1974 | Metzger |
| 3,817,512 | A | 6/1974 | Torrey |
| 3,845,945 | A | 11/1974 | Lawley |
| 3,851,870 | A | 12/1974 | Cook |
| 3,868,103 | A | 2/1975 | Pageot et al. |
| 3,997,926 | A | 12/1976 | England |
| 4,025,972 | A | 5/1977 | Adams et al. |
| 4,034,972 | A | 7/1977 | Peterson |
| 4,057,240 | A | 11/1977 | Damico |
| 4,097,939 | A | 7/1978 | Peck |
| 4,139,917 | A | 2/1979 | Fenwick |
| 4,148,472 | A | 4/1979 | Rais |
| 4,178,625 | A | 12/1979 | Schudel |
| 4,225,126 | A | 9/1980 | Lee |
| 4,225,127 | A | 9/1980 | Strutton |
| 4,227,269 | A | 10/1980 | Johnston |
| 4,233,649 | A | 11/1980 | Scheer |
| 4,247,091 | A | 1/1981 | Glowacki |
| 4,323,060 | A | 4/1982 | Pecheux |
| 4,333,638 | A | 6/1982 | Gillotti |
| 4,336,965 | A | 6/1982 | Lipp |
| 4,356,578 | A | 11/1982 | Clark |
| 4,395,071 | A | 7/1983 | Laird |
| 4,411,035 | A | 10/1983 | Fenwick |
| 4,426,071 | A | 1/1984 | Klevstad |
| 4,457,502 | A | 7/1984 | Beach |
| 4,472,845 | A | 9/1984 | Chivetta |
| 4,541,622 | A | 9/1985 | Tabuchi |
| 4,551,348 | A | 11/1985 | O'Mahony et al. |
| 4,552,348 | A | 11/1985 | Forssmann et al. |
| 4,564,164 | A | 1/1986 | Allen |
| 4,577,730 | A | 3/1986 | Porter |
| 4,615,058 | A | 10/1986 | Feldt |
| 4,621,349 | A | 11/1986 | Sander |
| 4,632,349 | A | 12/1986 | Anstey |
| 4,639,954 | A | 2/1987 | Speed |
| 4,646,211 | A | 2/1987 | Gallant |
| 4,682,376 | A | 7/1987 | Feldt |
| 4,688,780 | A | 8/1987 | Hanz |
| 4,698,837 | A | 10/1987 | Van Steenburg |
| 4,724,555 | A | 2/1988 | Poehner |
| 4,751,754 | A | 6/1988 | Bailey et al. |
| 4,805,249 | A | 2/1989 | Usman |
| 4,807,618 | A | 2/1989 | Auchinleck et al. |
| 4,821,350 | A | 4/1989 | Feldt |
| 4,860,394 | A | 8/1989 | Benessis |
| 4,865,484 | A | 9/1989 | McConnell |
| 4,882,566 | A | 11/1989 | Koerber et al. |
| 4,882,797 | A | 11/1989 | Failor et al. |
| 4,886,258 | A | 12/1989 | Scott |
| 4,894,876 | A | 1/1990 | Fenwick |
| 4,898,491 | A | 2/1990 | Van Steenburg |
| 4,940,218 | A | 7/1990 | Akcelrod |
| 4,968,013 | A | 11/1990 | Kuck |
| 4,993,762 | A | 2/1991 | Rogers |
| 5,039,167 | A | 8/1991 | Sweet |
| 5,056,535 | A | 10/1991 | Bonnell |
| 5,060,327 | A | 10/1991 | Celestina et al. |
| 5,078,705 | A | 1/1992 | Edwards et al. |
| 5,081,729 | A | 1/1992 | Menday |
| 5,103,384 | A | 4/1992 | Drohan |
| 5,104,363 | A | 4/1992 | Shi |
| 5,109,554 | A | 5/1992 | Borders et al. |
| 5,116,008 | A | 5/1992 | Allen |
| 5,129,116 | A | 7/1992 | Borders et al. |
| 5,134,737 | A | 8/1992 | Wyman |
| 5,134,739 | A | 8/1992 | Gaffe |
| 5,148,562 | A | 9/1992 | Borders et al. |
| 5,157,800 | A | 10/1992 | Borders |
| 5,161,274 | A | 11/1992 | Hayes |
| 5,197,156 | A | 3/1993 | Stryker |
| 5,201,087 | A | 4/1993 | Wickham |
| 5,205,004 | A | 4/1993 | Hayes |
| 5,214,812 | A | 6/1993 | Bartow et al. |
| 5,226,187 | A | 7/1993 | Borders et al. |
| 5,329,657 | A | 7/1994 | Bartley et al. |
| 5,331,698 | A | 7/1994 | Newkirk et al. |
| 5,362,302 | A | 11/1994 | Jensen et al. |
| 5,369,825 | A | 12/1994 | Reesby |
| 5,369,827 | A | 12/1994 | Parke et al. |
| 5,375,276 | A | 12/1994 | Nelson et al. |
| 5,377,373 | A | 1/1995 | Shirai |
| 5,398,357 | A | 3/1995 | Foster |
| 5,423,097 | A | 6/1995 | Brule |
| 5,454,126 | A | 10/1995 | Foster et al. |
| 5,460,346 | A | 10/1995 | Hirsch |
| 5,466,249 | A | 11/1995 | de Putter |
| 5,472,412 | A | 12/1995 | Knoth |
| 5,479,666 | A | 1/1996 | Foster |
| 5,481,770 | A | 1/1996 | Ahlsten |
| 5,502,862 | A | 4/1996 | Vosbikian |
| 5,522,098 | A | 6/1996 | Podgorschek |
| 5,555,582 | A | 9/1996 | Jerideau |
| 5,560,577 | A | 10/1996 | Keselman |
| 5,577,279 | A | 11/1996 | Foster et al. |
| 5,628,078 | A | 5/1997 | Pennington |
| 5,636,394 | A | 6/1997 | Bartley |
| 5,636,899 | A | 6/1997 | Schiff |
| 5,645,079 | A | 7/1997 | Zahiri et al. |
| 5,661,859 | A | 9/1997 | Schaefer |
| 5,692,255 | A | 12/1997 | Canfield |
| 5,708,997 | A | 1/1998 | Foster et al. |
| 5,735,593 | A | 4/1998 | Gallant et al. |
| 5,740,571 | A | 4/1998 | Tyra |
| 5,740,572 | A | 4/1998 | Hannant |
| 5,774,914 | A | 7/1998 | Johnson et al. |

| | | | | |
|---|---|---|---|---|
| 5,778,467 | A | 7/1998 | Scott et al. | |
| 5,791,761 | A | 8/1998 | Bryant | |
| 5,802,641 | A | 9/1998 | Van Steenburg | |
| 5,806,114 | A | 9/1998 | Morgan | |
| 5,862,549 | A | 1/1999 | Morton et al. | |
| 5,878,748 | A | 3/1999 | Garth | |
| 5,913,774 | A | 6/1999 | Feddema | |
| 5,926,878 | A | 7/1999 | Morton | |
| 5,933,888 | A | 8/1999 | Foster et al. | |
| 5,941,175 | A | 8/1999 | Bannister | |
| 5,961,085 | A | 10/1999 | Navarro | |
| 6,058,534 | A | 5/2000 | Navarro | |
| 6,112,345 | A | 9/2000 | Foster et al. | |
| 6,141,806 | A | 11/2000 | Bobey et al. | |
| 6,174,068 | B1 | 1/2001 | Ambach | |
| 6,202,230 | B1 | 3/2001 | Borders | |
| 6,226,821 | B1 | 5/2001 | Heimbrock | |
| 6,230,345 | B1 | 5/2001 | Borrero | |
| 6,282,738 | B1 | 9/2001 | Heimbrock | |
| 6,289,537 | B1 | 9/2001 | Hopper et al. | |
| 6,408,464 | B1 * | 6/2002 | Weismiller et al. | 5/602 |
| 6,409,131 | B1 | 6/2002 | Bentley | |
| 6,412,126 | B2 | 7/2002 | Heimbrock | |
| 6,470,520 | B1 * | 10/2002 | Weismiller et al. | 5/602 |
| 6,507,964 | B1 | 1/2003 | Lewandowski et al. | |
| 6,546,577 | B1 | 4/2003 | Chinn | |
| 6,564,405 | B1 | 5/2003 | Barr et al. | |
| 6,725,479 | B1 | 4/2004 | Stryker et al. | |
| 6,757,924 | B2 * | 7/2004 | Goodwin et al. | 5/602 |
| 6,807,695 | B1 | 10/2004 | Barr | |
| 6,826,793 | B2 | 12/2004 | Tekulve | |
| 6,851,142 | B2 | 2/2005 | Stryker et al. | |
| 6,854,145 | B2 | 2/2005 | Ruehl et al. | |
| 6,957,457 | B2 | 10/2005 | Stryker et al. | |
| 6,983,501 | B2 | 1/2006 | Heimbrock | |
| 7,073,221 | B2 * | 7/2006 | Goodwin et al. | 5/602 |
| 7,124,456 | B2 | 10/2006 | Palmatier et al. | |
| 7,127,756 | B2 | 10/2006 | Brophy et al. | |
| 7,278,987 | B2 | 10/2007 | Solazzo | |
| 7,412,739 | B2 * | 8/2008 | Derenne et al. | 5/731 |
| 7,464,421 | B2 * | 12/2008 | Goodwin et al. | 5/602 |
| 7,657,953 | B2 * | 2/2010 | Reckelhoff et al. | 5/624 |
| 7,669,259 | B2 * | 3/2010 | Ganance et al. | 5/602 |
| 2001/0011394 | A1 | 8/2001 | Heimbrock et al. | |
| 2002/0083527 | A1 | 7/2002 | Ruel et al. | |
| 2002/0092096 | A1 | 7/2002 | Heimbrock et al. | |
| 2003/0019039 | A1 * | 1/2003 | Goodwin et al. | 5/602 |
| 2004/0226092 | A1 * | 11/2004 | Goodwin et al. | 5/602 |
| 2006/0021142 | A1 | 2/2006 | Hornbach et al. | |
| 2006/0031991 | A1 | 2/2006 | McDaniel et al. | |
| 2006/0070182 | A1 | 4/2006 | Heimbrock et al. | |
| 2006/0096029 | A1 | 5/2006 | Osborne et al. | |
| 2006/0117485 | A1 | 6/2006 | Brophy et al. | |
| 2007/0143922 | A1 * | 6/2007 | Ganance et al. | 5/602 |
| 2007/0157386 | A1 * | 7/2007 | Ganance et al. | 5/602 |

OTHER PUBLICATIONS

Hill-Rom ELANA Delivery Table Brochure, 2000, 6 pages.
Hill-Rom Affinity Three Birthing Bed Brochure, 2000, 2 pages.
Hill-Rom Affinity II Bed Brochure, 1996, 6 pages.

* cited by examiner

STOWING BIRTHING BED FOOT SECTION

CROSS REFERENCE TO RELATED APPLICATIONS

This application claims the benefit of a U.S. Provisional Patent Application, Ser. No. 60/737,820, filed on Nov. 17, 2005, and entitled "Birthing Bed Foot Section" and a U.S. Provisional Patent Application, Ser. No. 60/803,841, filed on Jun. 2, 2006, and entitled "Ob/Gyn Bed," each of the foregoing provisional applications being hereby incorporated by reference herein.

BACKGROUND OF THE INVENTION

This disclosure relates to a patient-support apparatuses and accessories. Specifically, this disclosure relates to patient-support apparatuses with articulating deck sections that are removable and stowable.

Patient-support apparatuses, including hospital beds and birthing beds, sometimes provide support for patients during medical procedures. In the case of birthing beds, the apparatus supports the mother throughout the labor and delivery of a child. During the procedures or birthing process, it is sometimes advantageous to move or remove a portion of the patient-support apparatus to allow a caregiver, such as a doctor or nurse, improved access to a portion of the patient's body. For example, in the case of a birthing bed, a foot deck section may be removable to permit a caregiver access to the perineal area of a mother during labor to assist with the delivery of the child.

SUMMARY OF THE INVENTION

According to the present disclosure, a patient-support apparatus embodied as a birthing bed comprises a lower frame, an upper frame which raises a lowers relative to the lower frame, and support frame which moves relative to the upper frame. The patient-support apparatus further comprises a deck section releasably coupleable to the support frame, and a storage structure coupled to the support frame and the upper frame, the support frame configured to support the deck section as the deck section moves between a use position, wherein the deck section is secured to the support frame and a stored position between the lower frame and upper frame. In some embodiments, the deck section may include a locking mechanism actuable to engage with a portion of the support frame to secure the deck section to the support frame.

In some embodiments, the locking mechanism may be activated by a cushion assembly positioned on the deck section. The cushion assembly may include a protrusion configured to engage the locking mechanism to actuate the locking mechanism into engagement with the support frame to secure the deck section to the support frame. The locking mechanism may be biased to a position in which an engagement pin of the locking mechanism is retracted within the frame of the foot deck section. The protrusion may be configured to actuate a linkage to overcome the bias of the locking mechanism to urge the engagement pin to extend and engage a portion of the support frame to secure the foot deck section to the support frame.

The storage structure may comprise bias assembly supported from the upper frame of the patient-support apparatus, a frame coupled to the bias assembly, and a guide engaged with the frame and pivotably coupled to the support frame. The guide may be configured to support the deck section during movement of the deck section between a use position and a stowed position. The guide may move with the support frame and along the frame of the storage structure to provide a continuous support structure for supporting the foot deck section.

The frame may be moveable relative to the upper frame to deflect under a load placed on the foot deck section in a stowed position. The bias assembly may comprise springs which urge the frame of the storage structure to a home position wherein the frame is configured to maintain the foot deck section in a generally horizontal storage position. The bias assembly may be coupled to hanger assemblies which are engaged with a portion of the upper frame.

The hanger assemblies may be moveable relative to the upper frame along a longitudinal length of the patient-support apparatus such that the storage structure is moveable relative to the upper frame. The hanger assemblies may be biased to a first position away from the foot end of the patient-support apparatus. The storage structure may be configured to engage with the lower frame of the patient -support apparatus to overcome the bias exerted on the hanger assemblies and urge the storage structure toward a foot end of the patient-support apparatus when the upper frame is articulated vertically downward toward the lower frame.

The storage structure may be configured to position the foot deck section in a position wherein a portion of the foot deck section is exposed. The exposed portion of the foot deck section may be formed to include a receptacle which is positioned to be accessed by a caregiver when the foot deck section is in a stowed position. The receptacle may be embodied as a placenta basin and may be positioned to be accessed by a caregiver during the birthing process.

In another illustrative embodiment, a patient support apparatus comprises a frame having first and second members, first and second receivers coupled to the first and second members respectively, and a patient-support deck including first and second support brackets configured to engage with the first and second receivers to support the patient-support deck on the frame of the patient-support apparatus. The receivers may comprise a first protrusion forming a generally vertical boundary and a second protrusion spaced apart from the first protrusion to form another generally vertical boundary. A lower generally vertical surface positioned may be interposed between the first and second protrusions. An inclined surface may be interposed between the first and second protrusions, the inclined surface spaced vertically above the lower surface and intersecting the lower surface.

The patient-support deck may comprise a main portion having first and second lateral sides. The first and second support brackets may be coupled to the main portion and positioned on the first and second sides, respectively. The second side may be positioned laterally opposite the first support bracket. The brackets may be configured to engage the first and second receivers to support and secure the patient-support deck.

In some embodiments, the first and second support brackets may be positioned proximate an end of the patient-support deck. The patient-support deck may be supported in a cantilevered configuration. The receivers may be positioned on opposing lateral sides of a longitudinal axis of the patient-support apparatus. The patient-support apparatus may comprise a birthing bed, and the patient-support deck may comprise a foot deck section.

In some embodiments, the patient-support deck may comprise a pair of handles. The handles may be positioned on opposite lateral sides of the patient-support deck. In some embodiments, the handles may be a flexible material. The support brackets may include a protrusion configured to engage a lower surface of a protrusion on the receivers to maintain the patient-support deck in engagement with the patient-support apparatus if the patient-support deck is lifted from an end opposite the receivers.

In some embodiments, the first and second support brackets comprise a bearing material positioned to engage with the inclined and lower surfaces of the first and second and receivers as the patient-support deck is positioned on the patient-support apparatus. In some embodiments, the receivers may comprise a generally horizontal support surface and a latch block. The patient-support deck may comprise a locking mechanism including latch hooks positioned to engage the latch blocks of the receivers to secure the patient-support deck to the patient-support apparatus.

When the patient-support deck includes the locking mechanism, the handles may be rotatable to move the latch hooks a disengaged position and a position wherein the latch hooks are engaged to with the latch blocks to secure the patient-support deck to the patient-support apparatus. For example, the locking mechanism may comprise a first shaft coupled to a handle and an arm coupled to the shaft and moveable with the shaft. The locking mechanism may also comprise a second shaft coupled to the latch hook and arms coupled to the shafts and rotatable with the shafts and a link pivotably coupled to the arms at points offset from the axis of rotation of the shafts. The rotation of the handles may be transferred through the mechanism to rotate the latch hooks.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
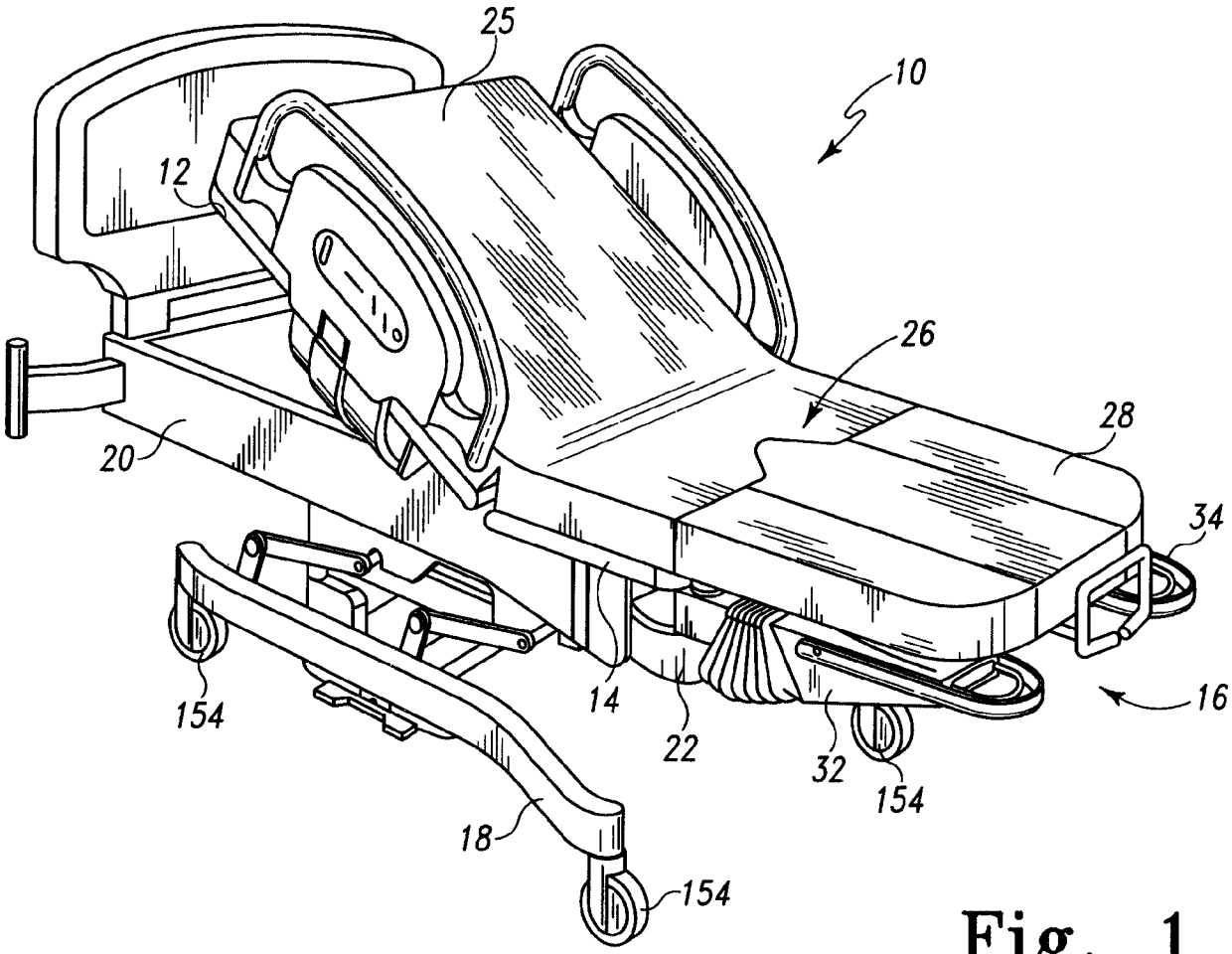
FIG. 1 is a perspective view of a birthing bed including articulable foot supports in a stowed position and a removable foot section.

According to the present disclosure, a birthing bed 10 comprises a head deck section 12, seat deck section 14, and a removable foot deck section 16 as shown in FIG. 1. The birthing bed 10 further comprises a base frame 18 supporting an intermediate frame 20 that supports the head deck section 12 and seat deck section 14. The head deck section 12 and seat deck section 14 are articulable relative to the intermediate frame 20 to adjust the position of a patient occupying the birthing bed 10. The foot deck section 14 is supported on a support frame 22 that is supported by the intermediate frame 20. The support frame 22 moves vertically as depicted by arrow 24 in FIG. 1 to adjust to a plurality of positions including positions in which the foot deck section 16 is vertically spaced from the seat deck section 14. This allows a caregiver or patient to adjust the birthing bed 10 to a plurality of positions during labor and delivery.

The birthing bed 10 comprises a mattress 25 that is supported on the head deck section 12 and seat deck section 14. The mattress 25 comprises a v-shaped cavity 26 along the edge of the mattress 25 adjacent the foot deck section 16. In the illustrative embodiment of FIG. 1, a cushion assembly 28 is supported on the foot deck section 16 and comprises a protrusion 30 that is configured to be received in the cavity 26 to form a continuous support surface for a patient when the foot deck section 16 is vertically aligned with the seat deck section 14. As is shown in FIG. 1, the birthing bed 10 also comprises two articulable foot supports 32 and 34. Foot support 32 is positioned to support a patient's right foot when in use while foot support 34 is positioned to support a patient's left foot when in use.

In use during natural delivery of a baby, the birthing bed 10 is configured to permit a caregiver access to a patient seated on the mattress 25 and supported on seat deck section 14. Foot deck section 16 is supported on the support frame 22 and moveable with the support frame 22 as the support frame 22 moves vertically relative to the intermediate frame 20.

Figure 16:
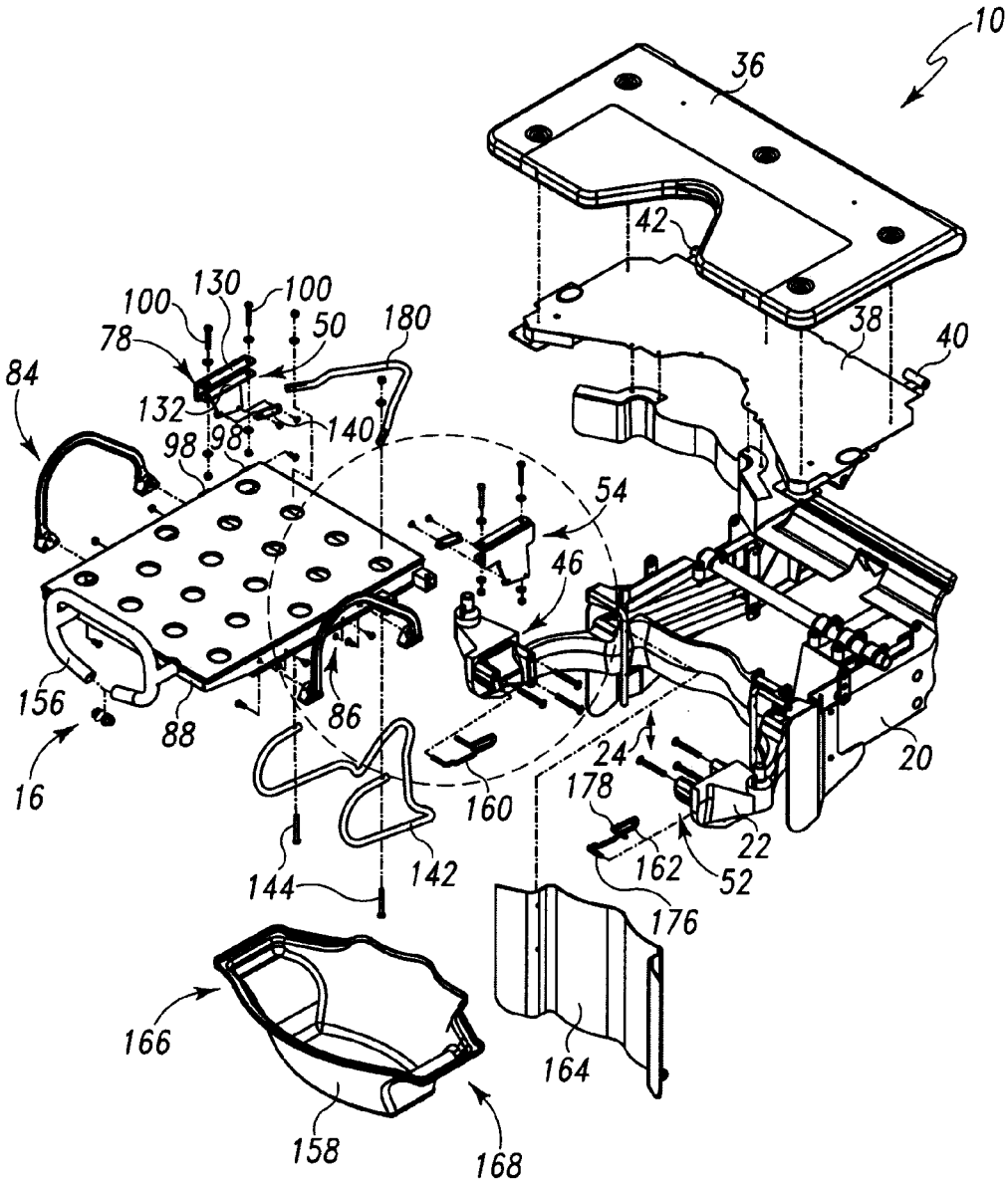
FIG. 16 is an exploded assembly view of a portion of the birthing bed of FIG. 1 with a removable foot deck section.

Referring now to FIG. 16, removable foot deck section 16 and a portion of birthing bed 10 are shown in an exploded assembly view. Seat deck section 14 comprises an upper deck 36 which is supported on a lower deck 38. Lower deck 38 includes first and second pivots 40 and 42 respectively which cooperate to define an axis of rotation about which seat deck section 14 pivots relative to intermediate frame 20. Support frame 22 is supported relative to intermediate frame 20 and moves vertically relative to intermediate frame 20 as depicted by arrow 24. Support frame 22 is driven by a drive mechanism (not shown) which utilizes a DC drive to articulate an articulating mechanism 44 to control movement of support frame 22. According to the present disclosure, the operation of birthing bed 10 including the articulation of support frame 22 is consistent across all embodiments. However, in some embodiments support frame 22 may be engaged by a receiver to change the configuration of the birthing bed 10 such that alternative embodiments of foot support decks may be employed on the birthing bed 10.

Figure 12:
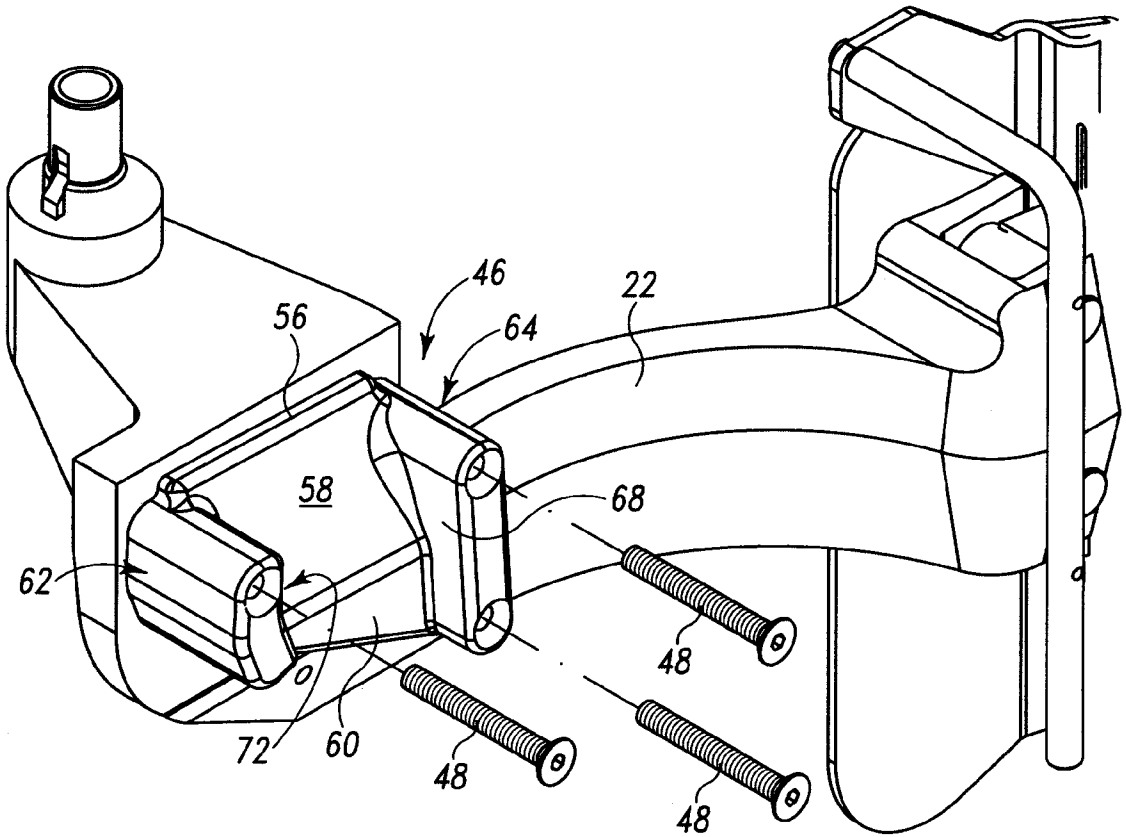
FIG. 12 is a view similar to FIG. 11, FIG. 12 showing an alternative embodiment of receiver configured to receive a removable foot deck section.

For example, referring to FIG. 12 a receiver 46 is coupled to support frame 22 by three bolts 48. Receiver 46 is configured to assist a user, such as a caregiver, to engage a removable foot deck section such as foot deck section 16 to support frame 22 by guiding a support plate 50 to proper engagement with receiver 46 to support foot deck section 16 in cantilever from support frame 22. Referring again now to FIG. 16, a second receiver 52 is positioned on support frame 22 and is positioned laterally opposite of receiver 46. Receiver 52 is also secured to support frame 22 by three bolts 48 and receiver 52 is positioned to receive a second support plate 54 which is positioned on foot deck section 16 laterally opposite of support plate 50. When support plates 50 and 54 are engaged with receivers 46 and 52 respectively, foot deck section 16 is supported in cantilever from support frame 22. As will be discussed in further detail below, the weight of foot deck section 16, cushion assembly 28, and the weight of a portion of a patient supported thereon, serves to increase the force with which support plates 50 and 54 are engaged with the receivers 46 and 52.

Figure 20:
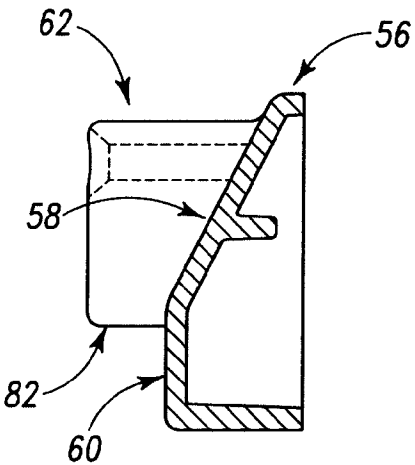
FIG. 20 is a cross-sectional view of the receiver of FIGS. 12, 16, and 19 The cross-section taken along lines 20-20 of FIG. 19.
Figure 19:
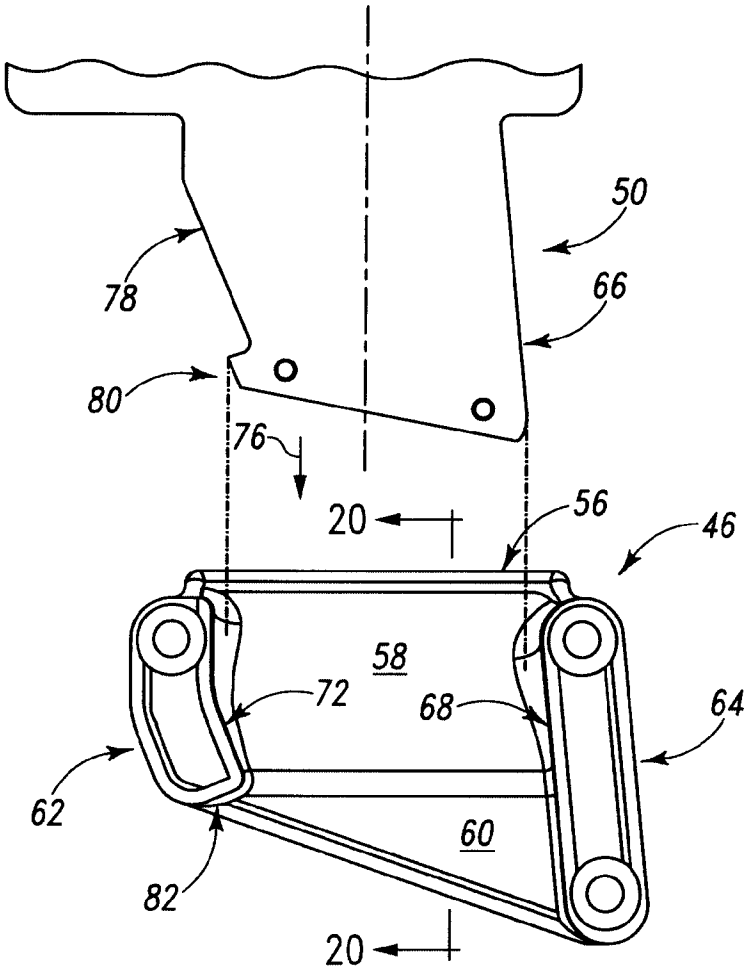
FIG. 19 is a side view of a tab of the removable foot section of FIG. 16 positioned to engage the receiver shown in FIG. 12.

Referring now to FIGS. 19-20, support plate 50 and receiver 46 are illustratively shown. Receiver 46 has an upper surface 56 which transitions to an incline surface 58 which transitions to an engagement surface 60. Receiver 46 further includes a first protrusion 62 and a second protrusion 64. When receiver 46 is coupled to storage structure 22, first protrusion 62 is positioned at a foot end to side of receiver 46 and protrusion 64 is positioned at a head end of receiver 46. Protrusions 62 and 64 thereby serve as longitudinal barriers for support plate 50 when support plate 50 is engaged with receiver 46. Generally, support plate 50 is narrower at a lower portion and widens as it progresses vertically upwardly, as shown in FIG. 19. This tapering effect assists a caregiver in properly positioning the removable foot deck section 16 longitudinally as the foot deck section 16 is being positioned to engage with receivers 46 and 52.

Referring now to FIG. 19, support plate 50 includes a surface 66 which engages a surface 68 of the second protrusion 64 as support plate 50 is engaged with receiver 46. Support plate 50 also includes a surface 70 which engages a surface 72 of receiver 46 when support plate 50 is engaged with receiver 46. Support plate 50 has a vertical axis 74 and surfaces 66 and 70 are not parallel to vertical axis 74 or to each other. As support plate 50 is lowered in the direction of arrow 76 surfaces 66 and 70 engage surfaces 68 and 72 respectively such that support plate 50 is frictionally engaged with receiver 46 thereby securing removable foot deck section 16 to the birthing bed 10. In addition, an outer surface 78 (not shown in FIGS. 19-20) engages with surface 58 which guides support plate 50 to proper engagement with surface 60 of receiver 46. In the illustrative embodiment, support plate 50 is a mirror image to support plate 54. Support plate 54 comprises a main portion 102 with an outer member 104 which is positioned to engage receiver 52 and act as a bearing surface to reduce noise during the insertion of support plate 50 into receiver 52, as well as to reduce noise which may occur when foot deck section 16 is moved due to patient movement on foot support deck 16. Support plate 50 also includes a main portion 106 and an outer member 108.

Surface 70 of support plate 50 is formed to include a protrusion 80 which acts as a hook to prevent inadvertent removal of foot deck section 16 from receivers 46 and 52. If the foot end of foot deck section 16 is lifted, protrusion 80 engages a lower surface 82 of first protrusion 62 of receiver 46. Thus, a person who is not familiar with the operation of foot deck section 16 is prevented from removing foot deck section 16. In normal operation, a user grips two handles 84 and 86 which are shaped and positioned to cause the weight of foot deck section 16 to rotate to prevent protrusion 80 from clearing surface 82 of first protrusion 62. Foot deck section 16 includes a main portion 88 and handle 84 and 86 are coupled to opposite sides of main portion 88 by fasteners 90.

Figure 16A:
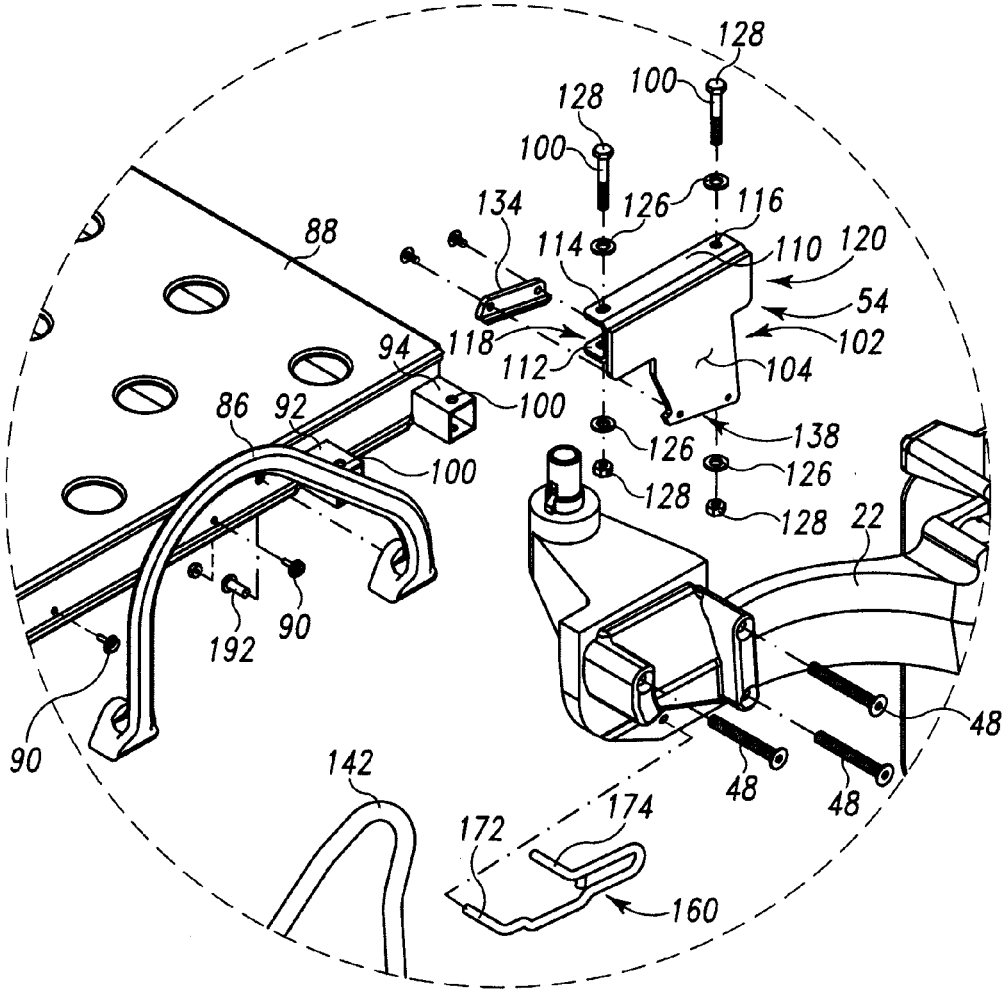
FIG. 16A is an enlarged view of a portion of FIG. 16 enclosed in a circle 16A.

Foot deck section 16 further includes four extensions 92, 94, 96, and 98 coupled to main portion 88 and extending laterally therefrom. Support bracket 50 is coupled to extensions 96 and 98 and support bracket 54 is coupled to extensions 92 and 94. Extensions 92, 94, 96, and 98 each have a through-hole 100. Referring now to FIG. 16A, support plate 54 is shown to include a pair of flanges 110 and 112 which are coupled to main portion 102. Two through-holes are formed in each of the flanges 110 and 112 respectively. Through-hole 114 and through-hole 116 are each formed in flange 110. Through-hole 118 and through-hole 120 are each formed in flange 112. Through-hole 114 is positioned vertically above through-hole 118 such that the centerlines of the through holes form an axis 122. Similarly, through-hole 116 is positioned vertically above through-hole 120 such that the centerlines of those through-holes form an axis 124. When support plate 54 is coupled to main portion 88 of foot deck sections 16, the axis 122 is positioned such that a fastener 100 passes through flange 110 through protrusion 92 and through flange 112 along axis 122 and a second fastener 100 passes along axis 124 through flange 110, protrusion 94, and flange 112. When fastener 100 is engaged with support bracket 54 a washer 126 interfaces between a head 128 of the fastener in the flange 110. A second washer 126 is interposed between a nut 128 and flange 112. Tightening of nut 128 onto fastener 100 secures support bracket 54 to protrusions 92 and 94 of foot deck 16. Support bracket 50 includes two flanges 130 and 132 and is coupled to protrusions 96 and 98 in a manner that is similar to manner in which bracket 54 is coupled to protrusions 92 and 94 and will not be discussed in further detail.

Support bracket 54 further includes a glide 134 which is coupled to main portion 102 and positioned to cover a lower surface 138 of main portion 102. Glide 134 acts as a bearing as support bracket 54 is engaged with receiver 52 to reduce the potential for noise during the engagement of support bracket 54 with receiver 52. Support bracket 50 also includes a glide 140 coupled to main portion 106 and which acts in a manner or similar to glide 134 of support bracket 54.

Foot deck section 16 further includes a stand 142 which is coupled to main portion 88 by two fasteners 144. Stand 142 is illustratively embodied as a wire-form which is configured to support foot deck section 16 in a standing position. For example, in another illustrative embodiment shown in FIG. 17, a stand 142 is coupled to a foot deck section 144 and supports the foot deck section 144 in a standing position such that a cushion assembly 146 is spaced apart from the floor to prevent linens supported on the cushion assembly 146 from being contaminated by touching the floor. The illustrative foot deck section 144 is similar to foot deck section 16, but the foot deck section 144 has two grip handles 148 and 150 coupled to a main portion 152. Grip handles 148 and 150 are positioned such that a caregiver may utilize the grip handles 148 and 150 to reposition birthing bed 10 by rolling the birthing bed 10 on casters 154 coupled to the base 18 of birthing bed 10.

Referring again to FIG. 16, foot deck section 16 further includes a handle 156 coupled to main portion 88. Handle 156 is usable by a caregiver to reposition the birthing bed 10 by rolling it on its casters 154. Handle 156 also serves as a stand to support foot deck section 16 in a standing position with handle 156 engaging the floor.

In the illustrative embodiment of FIG. 16, a placenta basin 158 is supported on two racks 160 and 162 which are coupled to support frame 22 vertically below receivers 46 and 52 respectively. Racks 160 and 162 are illustratively embodied as wire forms and are configured to receive flange portions 166 and 168 of placenta basin 158 respectively. A shroud 164 is coupled to support frame 22 and has a shape which is configured to engage a front portion 170 of placenta basin 158 so that shroud 164 and placenta basin 158 cooperate to guide waste materials into the placenta basin 158. Rack 116 includes two extensions 172 and 174 which are received in two holes (not shown) in support frame 22 such that rack 116 is coupled to support frame 22 by a frictional interference fit. In some embodiments, an adhesive may be added to secure rack 116 to support frame 22. Similarly, rack 162 includes two extensions 176 and 178 which are received in holes (not shown) in support frame 22.

Foot deck section 16 further includes a support member 180 coupled to main portion 88 and configured to provide support for a protrusion on a cushion assembly supported on foot deck section 16 when foot deck section 16 is engaged with support frame 22. Support member 180 is illustratively embodied as a wire form having a V-shape and positioned to be received in a V-shaped cavity 182 formed an upper deck 36 of seat section 14. Support member 180 is coupled to main portion 88 by two fasteners 184 and washers 186. In other embodiments, the cavity formed in upper deck 36 of seat section 14 may be a U-shaped cavity and support 180 may be replaced with another support member which is configured to be received within the U-shaped cavity and support a U-shaped protrusion of a cushion assembly supported on a foot deck section configured to be received in the U-shaped cavity.

Figure 17:
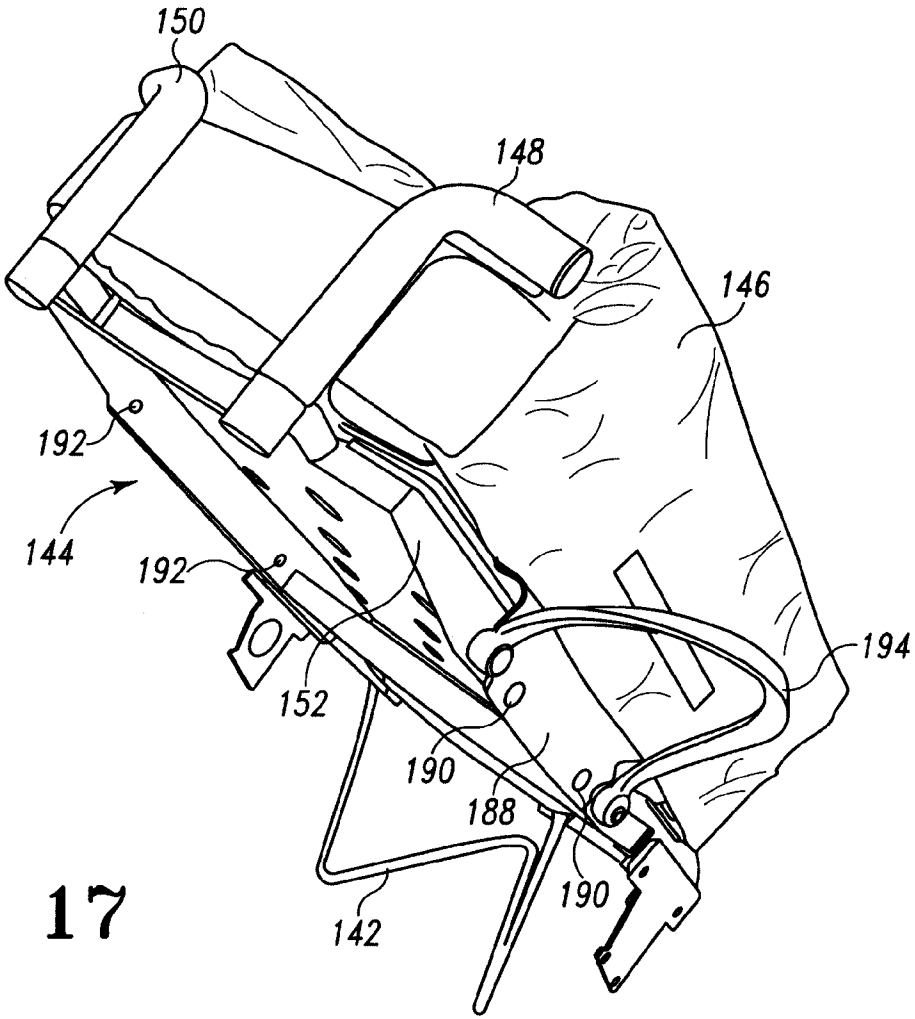
FIG. 17 is a perspective view of the removable foot deck section stored positioned on a floor in an out-of-the-way position.
Figure 18:
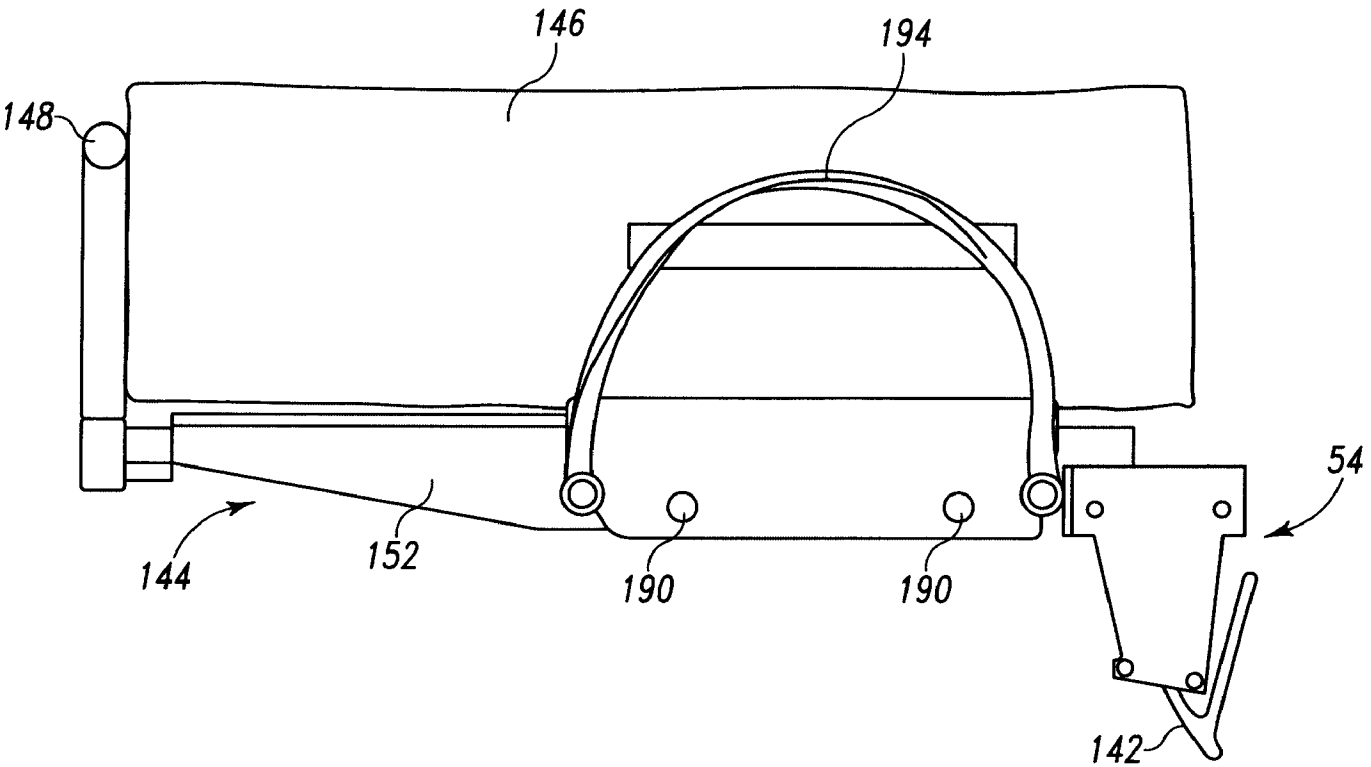
FIG. 18 is a side view of the removable foot deck section.

Foot deck section 144 shown in FIGS. 17-18 is similar to foot deck section 16 and illustrates the manner in which a cushion assembly, such as cushion assembly 146 may be coupled to foot deck section 144 or other embodiments of foot deck sections, such as foot deck section 16. Cushion assembly 146 includes a flap 188 which extends over the side of foot deck section 144 and includes two snap portions 190 which engage complementary snap portions 192. Snap portions 192 are shown in FIG. 16 which shows the engagement of snap portions 192 with main portion 88 of foot deck section 16. Referring again to FIG. 17, another flap complementary to flap 188 and positioned laterally on the opposite side of cushion assembly 146 includes a pair of snap portions 190 coupled to another pair of snap portions 192. In this manner, cushion assembly 146 is coupled to foot deck section 144 and maintains engagement with foot deck section 144 when foot deck section 144 is removed from engagement with receivers 46 and 52. In other embodiments, a cushion assembly such as cushion assembly 146 could be coupled to foot deck section 16.

Foot deck section 144 includes a pair of handles with one of the handles 194 shown in FIGS. 17 and 18. The handles including handle 194 are flexible and are positioned such that when a user lifts foot deck section 144 off from support frame 22 of birthing bed 10, the weight of foot deck section 144 urges the foot deck section to rotate with stand 142 in a vertically lowered orientation so that a caregiver may position foot deck section 144 in a standing position as shown in FIG. 17.

Figure 21:
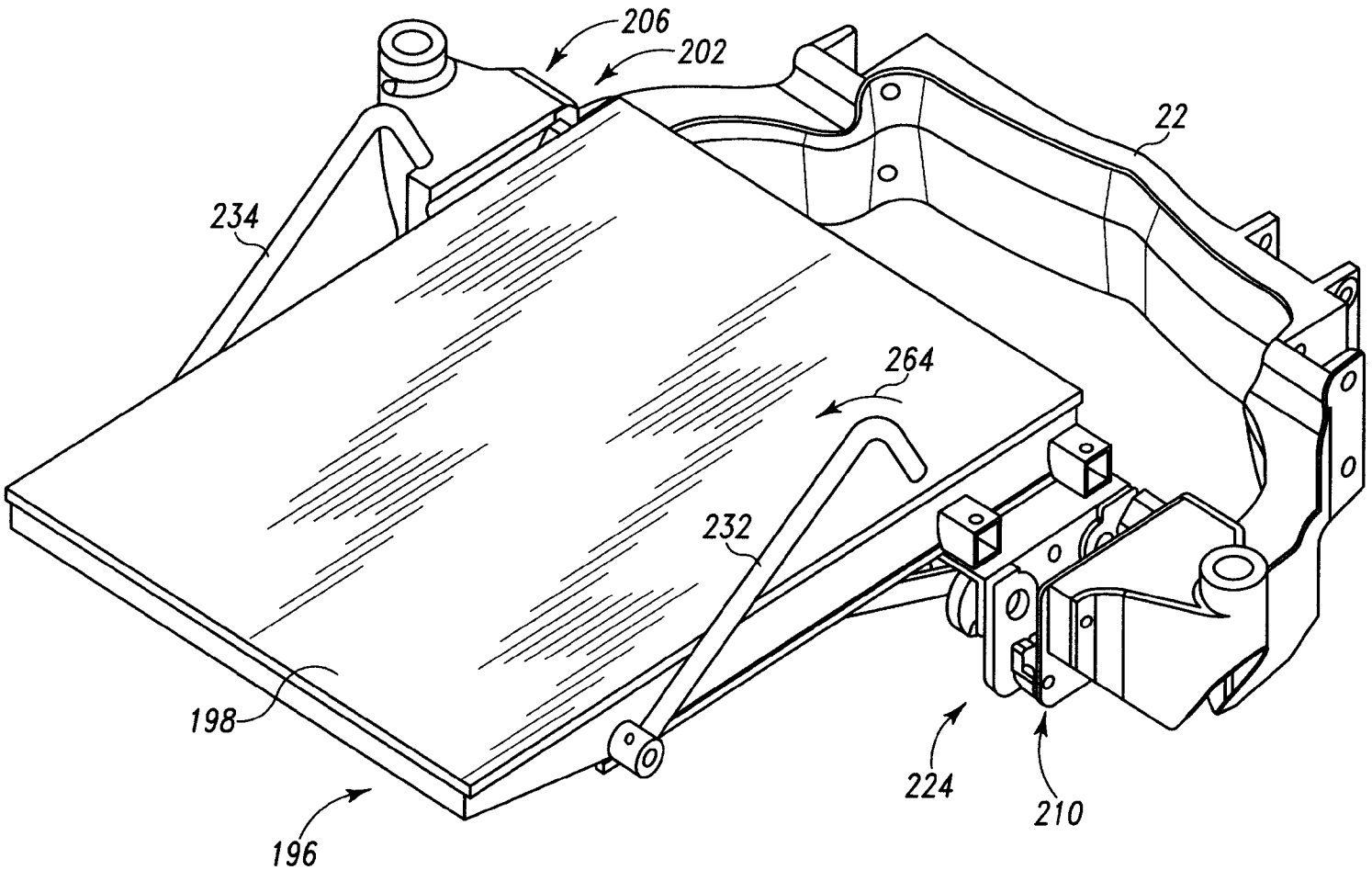
FIG. 21 is a perspective view of a portion of a birthing bed including another embodiment of a foot deck section, the removable foot deck section including a locking mechanism to secure the removable foot deck section to a frame of the birthing bed.
Figure 22:
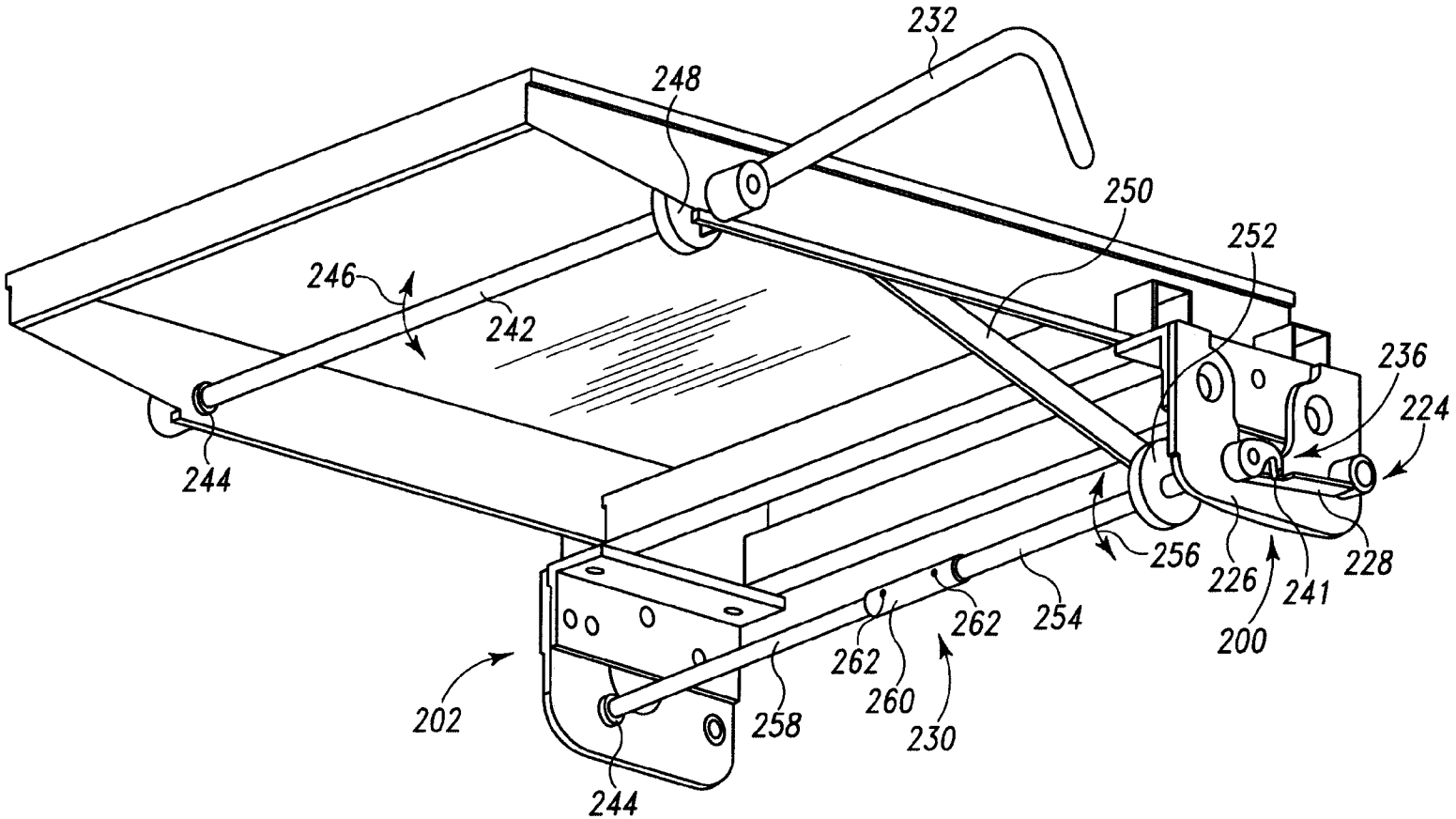
FIG. 22 is a perspective view of the removable foot deck section of FIG. 21, the foot deck section viewed from below.
Figure 23:
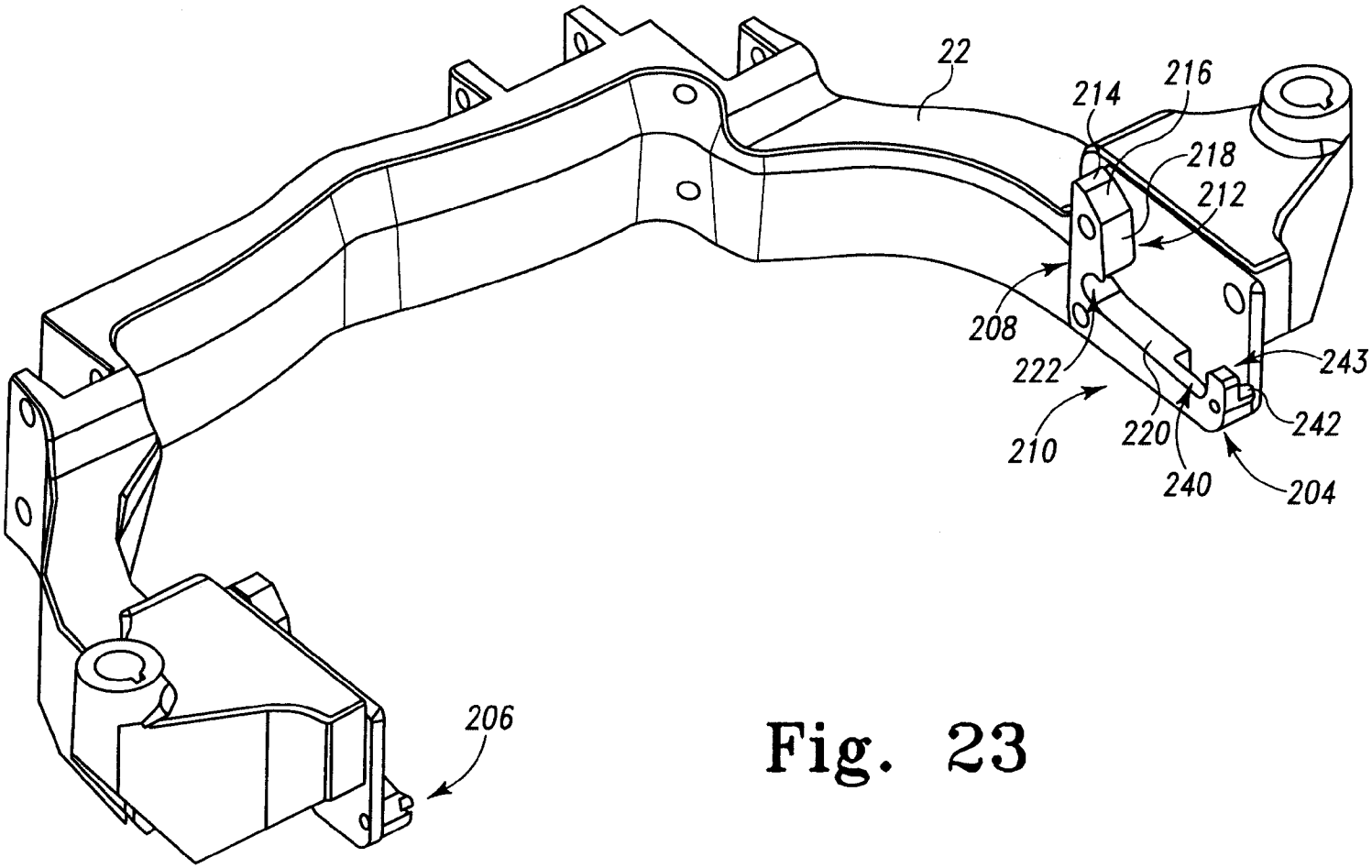
FIG. 23 is a perspective view of a portion of a frame of the birthing bed of FIG. 21, the frame configured to be engaged by the locking mechanism to secure.

As discussed above, foot deck sections 16 and 144 employ a passive locking approach to secure the foot deck sections 16 and 144 to birthing bed 10. In another embodiment shown in FIGS. 21-23, a foot deck section 196 is removable from support frame 22 and includes a locking mechanism to positively secure foot deck section 196 to support frame 22. Foot deck section 196 includes a main portion 198 with two support bracket assemblies 200 and 202 coupled to main portion 198. In the illustrative embodiment of FIGS. 21-23, only support frame 22 is shown and the remainder of birthing bed 10 is omitted. However, it should be understood that support frame 22 in the illustrative embodiments of FIGS. 21-23 is coupled to hospital bed 10 as described elsewhere in this disclosure. Support bracket 200 rests on a portion of a receiver 204 and support bracket 202 rests on a portion of a receiver 206 when foot deck section 196 is positioned on support frame 22. The engagement of support bracket 202 to receiver 206 is similar to the engagement of support bracket 200 to receiver 204 and will not be discussed in detail. The discussion of the engagement of support bracket 200 to receiver 204 should be extended to the engagement of support bracket 202 to receiver 206.

Receiver 204 includes an upper portion 208 and a lower portion 210. Upper portion 208 is formed to include a protrusion 212 having an upper surface 214, a guide surface 216, and a vertical surface 218. Extension 212 extends over an upper surface 220 of lower portion 210 to form and undercut 222 which is configured to receive a roller 224 coupled to a main portion 226 of support bracket 200. In addition, support bracket 200 includes a flange 228 which is positioned to engage upper surface 220 of lower portion 210 of receiver 204. When foot deck section 196 is position on support frame 22, roller 224 is positioned in to undercut 222 and flange 228 rest on upper surface 220 of lower portion 210 such that foot deck section 196 is supported in a cantilevered orientation from support frame 22.

Foot deck section 196 further includes a locking mechanism 230 which transfers motion from a pair of handles 232 and 234 to rotate a pair of hooks which engage a cavity in lower portion 210 to secure foot deck section 196 to support frame 22. For example, latch hook 236 rotates relative to support bracket 200. When support bracket 200 is engaged with receiver 204, latch hook 236 is positioned above the cavity 238 in the lower portion 210 and rotates such that a barb 241 is positioned within cavity 240 beneath a surface 242. Cavity 240 and surface 242 cooperate to define a latch block 243 which is engaged by barb 241 to secure foot deck section 196 to support frame 22. When in the locked position, the barb 241 of 236 prevents foot deck section 196 from being removed from support frame 22. Handles 232 and 234 are coupled to a shaft 242 which spans the width of the main portion 198 of foot deck section 196. Shaft 242 is supported on main portion 198 through a pair of bearings 244 which permit shaft 242 to rotate about its longitudinal length relative to main portion 198 as depicted by arrow 246.

Locking mechanism 230 further includes an arm 248 coupled to shaft 242 which rotates with shaft 242 when shaft 242 is rotated by arms 232 and 234. A link 250 is pivotably coupled to arm 248 and is pivotably coupled to a second arm 252. Arm 252 is coupled to a shaft 254 and latch hook 236 is coupled to shaft 254 and rotates about the longitudinal length of shaft 254 as depicted by arrow 256. Shaft 254 is coupled to another shaft 258 through a coupler 260 which is coupled to each of the shafts by a fastener 262 such that rotation of shaft 256 is transferred to shaft 258 which thereby rotates another hook (not shown) positioned laterally opposite latch hook 236. Shafts 254 and 258 rotate relative to support plates 200 and 202 respectively and are supported by bearings 244. Because link 250 is pivotably coupled to throws 248 and 252 at a position that is offset from the longitudinal axis of shafts 242 and 254, rotation of shaft 242 is transferred to shaft 254 and thereby shaft 258.

Thus, actuation of handles 232 and/or 234 rotates latch hook 236 to engage with receiver 204. As handles 232 and 234 are rotated downwardly, they move to an out-of-the-way position in which handles 232 and 234 are positioned below an upper surface of a cushion assembly supported on foot deck section 196. If the handles are rotated upwardly in the direction of arrow 264 in FIG. 21, latch hook 236 disengages receiver 200 and foot deck section 196 is free to be removed from engagement with receivers 200 and 202.

Figure 24:
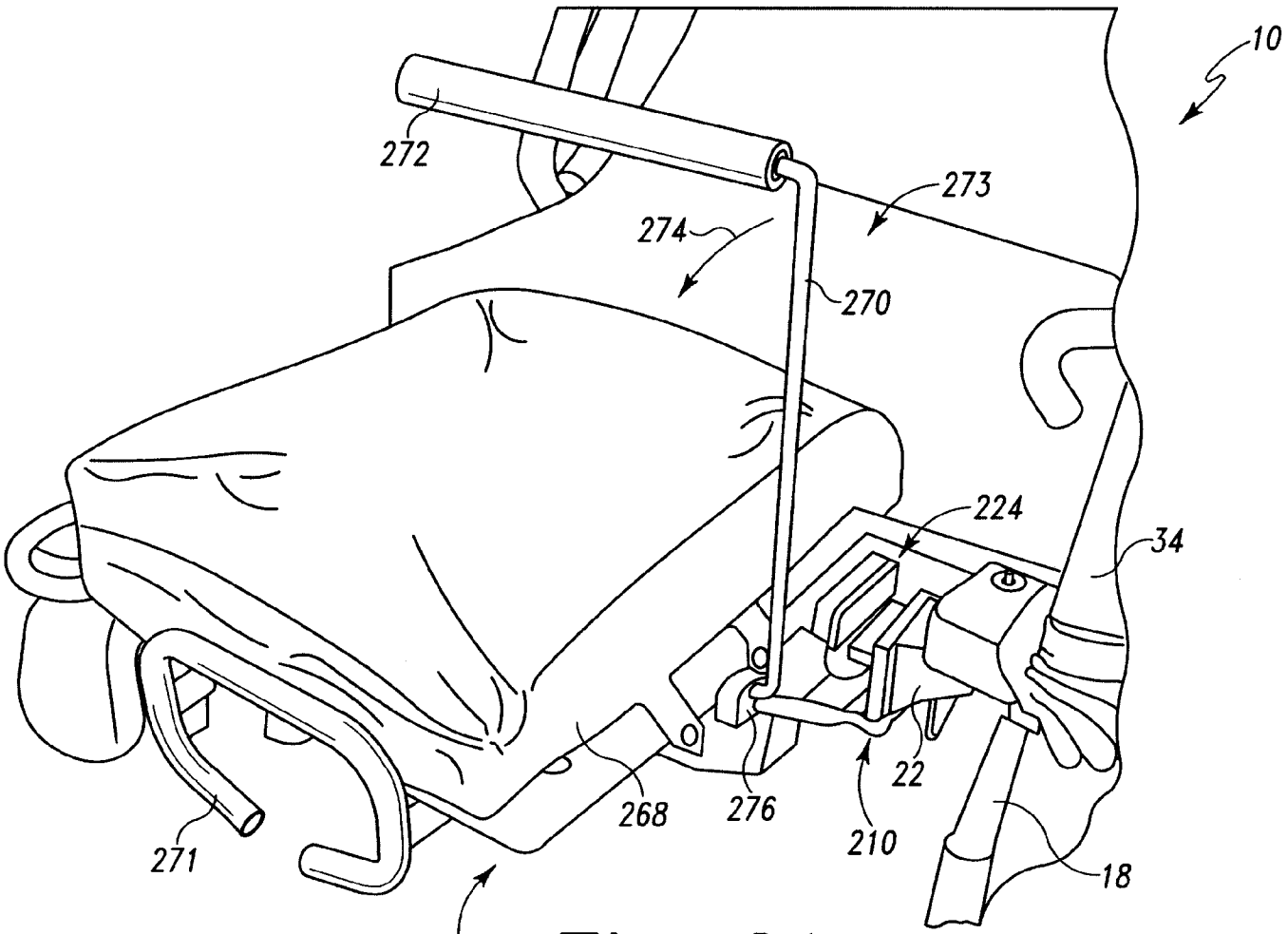
FIG. 24 is a perspective view of a portion of a birthing bed having yet another embodiment of a removable foot deck section.

The illustrative embodiment of FIG. 24, a foot deck section 266 supports a cushion assembly 268 and is coupled to support frame 22 of birthing bed 10. A handle 273 includes a main portion 270 and a grip portion 272. Handle 273 is actuable in the direction of arrow 274 to move to a stowed position with the grip portion 272 stowed at the foot end of deck section 266 with grip portion positioned adjacent a handle 271. The foot deck section 266 employs a locking mechanism similar to locking mechanism 230 of the illustrative embodiment of FIGS. 21-23, but the direction of travel of handle 273 is reversed as compared to handles 232 and 234 of foot deck section 196.

Figure 25:
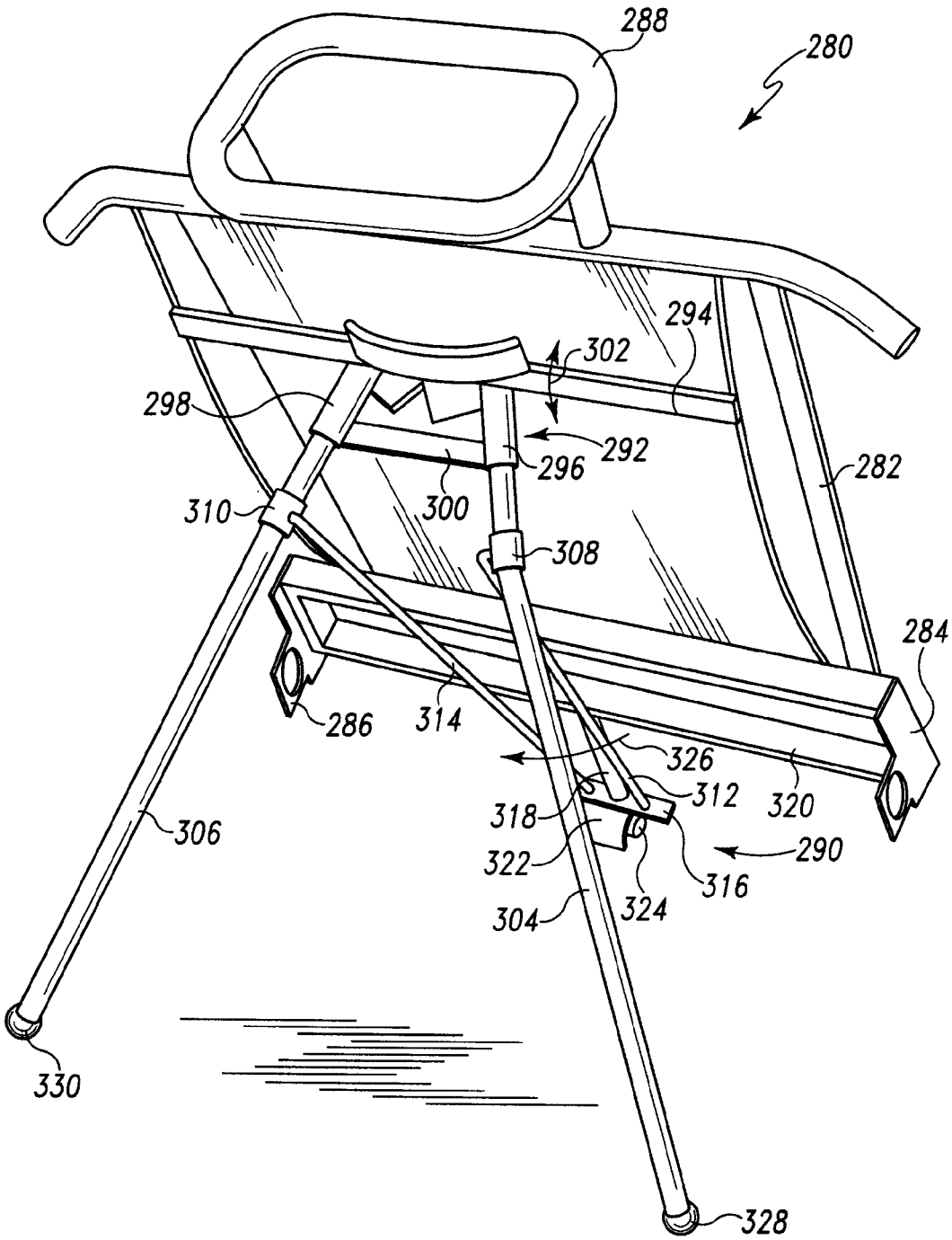
FIG. 25 is a perspective view of yet another embodiment of removable foot deck section, the foot deck section having a self-deploying stand to support the foot deck section when it is positioned on the floor.

In yet another embodiment illustrated in FIG. 25, a removable foot deck section 280 includes a main portion 282 and two support brackets 284, 286 coupled to main portion 282 and configured to engage receivers 52 and 46 of the illustrative embodiment of FIG. 16, respectively. Foot deck section 280 includes a handle 288 coupled to main portion 282 and functions similarly to handle 156 of foot deck section 16. When coupled to receivers 52 and 46, foot deck section 280 functions similarly to foot deck section 16. However, foot deck section 280 includes a three-point stand 290 which deploys when foot deck section 280 engages the floor. Stand 290 includes an upper bracket assembly 292 which is coupled to a cross-member 294 of the main portion 282 of foot deck section 280. Bracket assembly 292 includes two receivers 296 and 298 coupled by a link 300 such that the receivers 296 and 298 maintain a constant relative spacing. Bracket assembly 292 is pivotably coupled to cross-member 294 and pivots relative to cross-member 294 as depicted by an arrow 302.

Stand 290 further includes two legs 304 and 306, with leg 304 being engaged with receiver 296 and leg 306 been engaged with receiver 298 such that legs 304 and 306 move with bracket assembly 292. A collar 308 is coupled to leg 304 and is configured to receive a link 312 for pivotable movement relative to collar 308 and thereby leg 304. Similarly, a collar 310 is coupled to leg 306 and is configured to receive a link 314 such that the link 314 is pivotable relative to collar 310. Links 312 and 314 are coupled to a bracket 316. A bias member 318 is also coupled to bracket 316 and is interposed between links 312 and 314. Bias member 318 is coupled at an end opposite bracket 316 to cross-member 320 of the main portion 282 of foot deck section 280. A flange 322 is also coupled to bracket 316 and is configured to engage with the floor when foot deck section 280 is lowered to the floor. Additionally, a foot 324 is coupled to flange 322 and bracket 316. Foot 324 is flexible and has a high coefficient of friction so that when foot 324 engages the floor, it provides resistance to deploy stand 290.

Unloaded, bias member 318 urges bracket 316 to a stowed position wherein the bias member 318 pulls legs 304 and 306 upwardly to a stowed position against the bottom of main portion 282 of foot deck section 280. When foot 324 engages the floor and the weight a foot deck section 280 is borne by foot 324 and flange 322, bias member 318 deflects in the direction of arrow 326. Because links 312 and 314 are rigid and fixed in length, deflection of bias member 318 causes links 312 and 314 to act upon legs 304 and 306 respectively to urge the legs 304, 306 into the deployed position as shown in FIG. 25. Once stand 290 is fully deployed, foot deck section 280 rests on two glides 328 and 330 coupled to legs 304 and 306 respectively and foot 324. If bias member 318 is sufficiently deflected, foot deck section 280 may also rest on support brackets 284 and 286. When foot deck section 280 is lifted from the floor, bias member 318 urges bracket 316 in the direction opposite of arrow 326 and thereby links 312 and 314 pull legs 304 and 306 into the stowed position tucked against the lower side of main portion 282.

Figure 26:
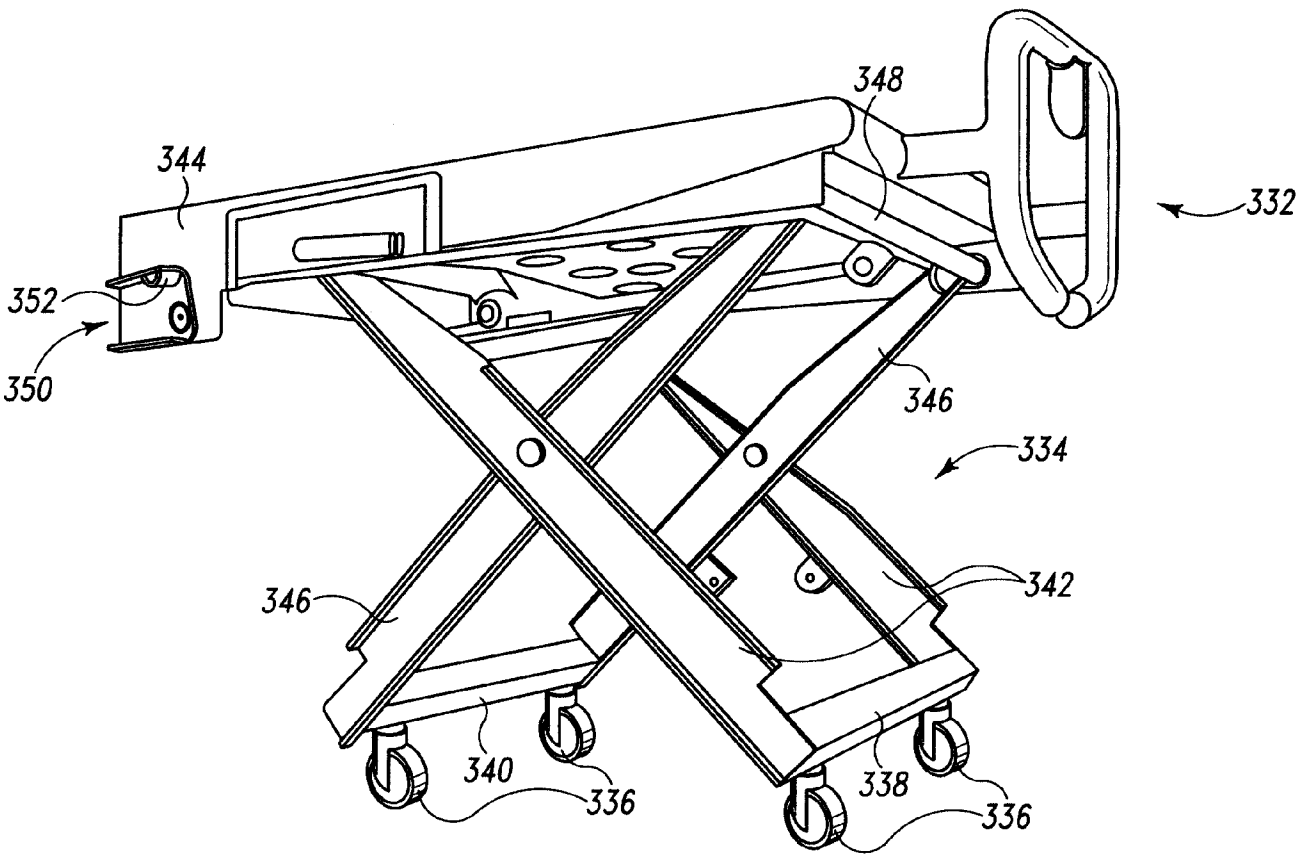
FIG. 26 is a perspective view of yet another removable foot deck section, the foot deck section including a deployable support frame with caster wheels such that the foot deck section may be rolled away from a birthing bed to which the foot deck section is engaged.

In still yet another embodiment shown in FIG. 26, a removable foot deck section 332 is supported on a scissors frame 334 such that foot deck section 332 can be rolled away from a patient-support apparatus, such as birthing bed 10. Scissors frame 334 includes four casters 336, two of which are coupled to a lower member 338 and two of which are coupled to a lower member 340. Scissors mechanism 334 further includes two legs 342, 342 coupled to lower member 338 and pivotably coupled at a head end of a main portion 344 of foot deck section 332. Two legs 346, 346 are pivotably coupled to a cross-member 348 near the foot end of main portion 344 such that legs 346 are pivotable relative to main portion 344. Additionally, one of each of the legs 342 is pivotably coupled to one of the other pair of legs 346 to form the scissors frame 334. Scissors frame 334 is manually deployed to engage the floor when a caregiver wants to remove foot deck section 332 from engagement with birthing bed 10. Additionally, scissors frame 334 can be lifted to a stowed position manually when foot deck section 332 is engaged with birthing bed 10.

A support bracket 350 is coupled to main portion 344 and is configured to slide onto a receiver (not shown) coupled to support frame 22 of birthing bed 10. A matching support bracket is positioned laterally opposite support bracket 350 such that when the support brackets are engaged with the receivers, foot deck section 332 is supported in a cantilevered configuration from support frame 22. Support bracket 350 includes a bias member 352 which deflects when support bracket 350 is engaged with a receiver on support frame 22 until bias member 352 is received in a cavity in the receiver. The cavity is complementary to bias member 352 and maintains foot deck section 332 in engagement with support frame 22 until sufficient force is applied to overcome the bias of bias member 352 to remove the foot deck section 332 from support frame 22.

While various illustrative embodiments of removable foot deck sections have been disclosed herein, it should be understood that various aspects of the removable foot deck sections are interchangeable and various combinations of stands, locking mechanisms and handle configurations are contemplated within the scope of this disclosure. For example, in some embodiments a foot deck section similar to foot deck section 16 may have a stand such as stand 142 omitted and may be supported in a standing orientation by a structure similar to stand 290 as disclosed in the illustrative embodiment of FIG. 25. Similarly, in another embodiment a foot deck section such as foot deck section 16 may be configured to employ the locking mechanism disclosed in the illustrative embodiment of FIGS. 21-23.

In the embodiments discussed above, foot deck sections have been disclosed which are removal from birthing bed 10 and storable in a position spaced apart from birthing bed 10. In some instances, it may be advantageous to stow a foot deck section within the space of a birthing bed 10 to reduce clutter within a delivery room and to reduce the potential for injury to a caregiver who lifts off a removable foot deck section.

Figure 2:
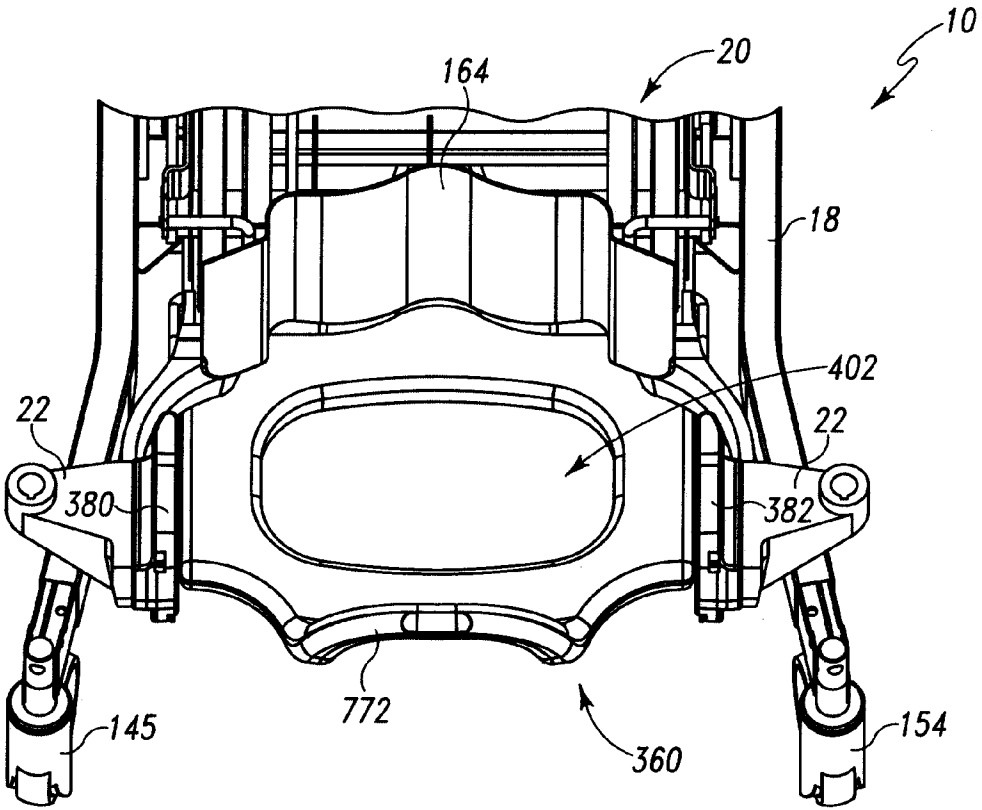
FIG. 2 is a perspective view of a portion of a birthing bed with portions removed, the birthing bed viewed from the foot end of the bed with a stowable foot deck section shown articulated to a stowed position such that a receptacle in the stowable foot deck section is positioned to function as a placenta basin.
Figure 3:
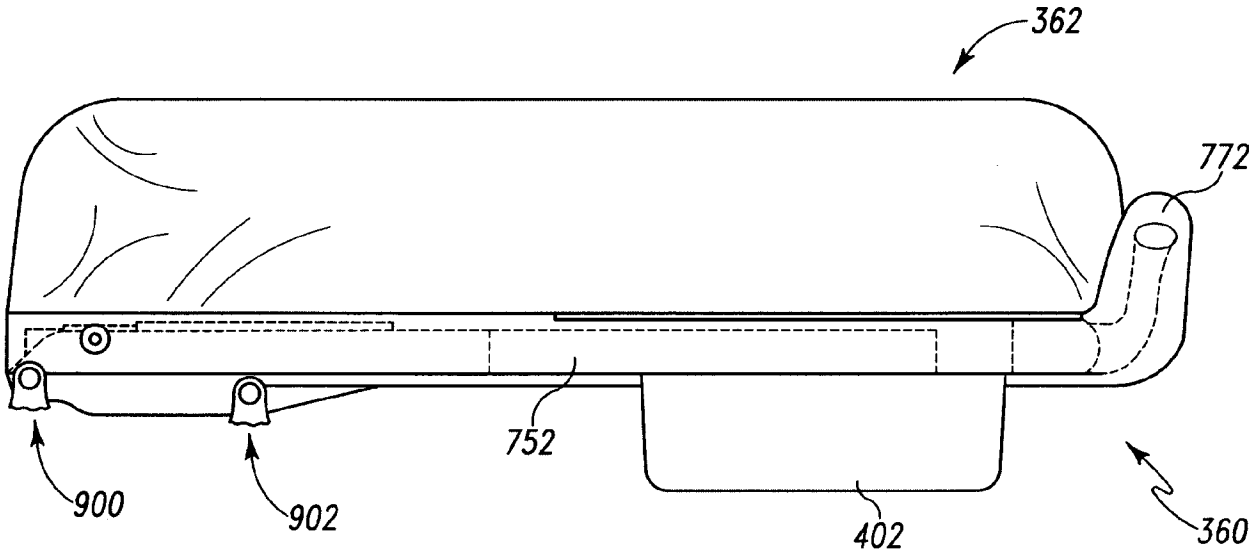
FIG. 3 is a side view of the stowable foot deck section of FIG. 2 including a cushion assembly secured on the foot deck section.

Referring now to FIG. 2, in another embodiment of a foot deck section 360 is shown with a cushion assembly 362 positioned on the foot deck section 362. Cushion assembly 362 comprises an actuator 364 that extends from a bottom surface 366 of cushion assembly 362 (best seen in FIG. 6) and is received in an aperture 368 in an upper surface 370 of foot deck section 360. The actuator 364 retains cushion assembly 362 on foot deck section 360 and activates a locking mechanism 372 (best seen in FIG. 4) which extends two pins 374 and 376 laterally outwardly from the foot deck section 360 to engage with a channel 378 in receiver 380 coupled to support frame 22 (refer to FIG. 11). The receiver 380 is positioned on the patient right side of birthing bed 10, and a second receiver 382 is positioned on the patient left side of birthing bed 10 as shown in FIG. 2.

Figure 11:
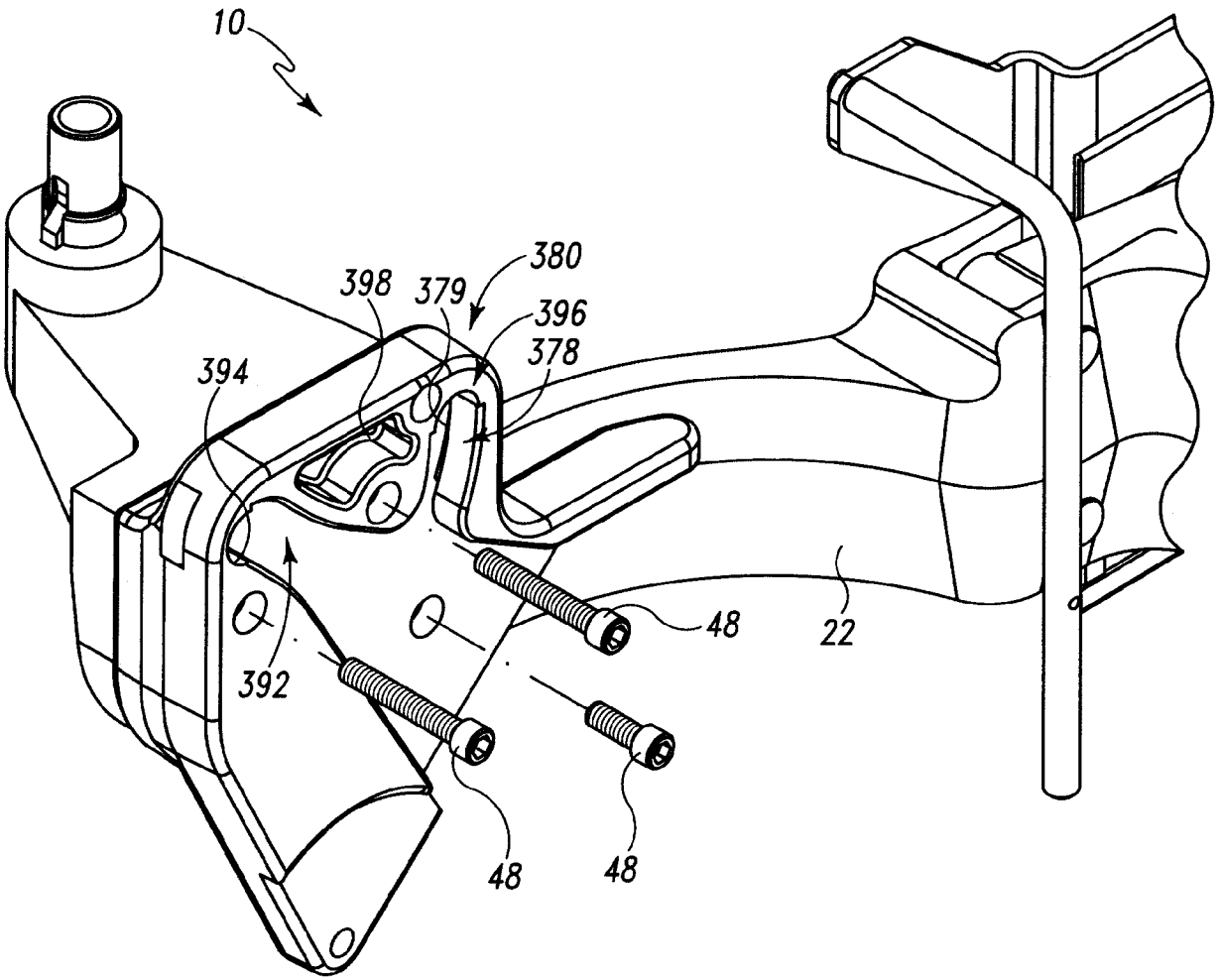
FIG. 11 is a perspective view of a portion of the birthing bed of FIG. 2 with portions removed, perspective view showing a receiver mounted to a frame of the birthing bed, the receiver configured to receive a portion of the stowable foot deck section in a cantilevered configuration.

The foot deck section 360 engages with receivers 380 and 382 through two sets of rollers 384, 386 and 388, 390 with rollers 384 and 386 positioned on the patient right side of foot deck section 360 and rollers 388 and 390 positioned on the patient left side of foot deck section 360. Rollers 384, 386, 388 and 390 are secured to foot deck section 360 by a retainers 900, 902, 904 and 906 each of which includes a flange 910 which is received in an undercut 379 formed in channel 378. Referring now to FIG. 11, channel 378 intersects a channel 392. When foot deck section 360 is positioned on support frame 22, roller 384 is positioned in channel 378. Roller 386 is positioned on a surface 394 on receiver 380 and the foot deck section 360 is pivoted about roller 386 such that roller 384 travels in channel 378 until roller 384 engages an end 396 of channel 378. With roller 386 resting on surface 394 and roller 384 engaged with end 396, foot deck section 360 is supported in cantilever from support frame 22. However, lifting of the foot deck section 360 will result in the foot deck section 360 moving relative to the receiver 380.

To secure foot deck section 360 to receiver 380, pin 374 is extended into a blind cavity 398 formed in an inner surface 90 of the receiver 380. Engagement of pin 374 with cavity 398 prevents rotation of foot deck section 360 relative to receiver 380. As will be discussed in further detail below, pin 374 extends from foot deck section 360 when cushion assembly 362 is positioned on foot deck section 360 such that the activator 364 of cushion assembly 362 activates a locking mechanism 372 to extend pins 374 and 376. This secures foot deck section 360 and cushion assembly 362 relative to support frame 22 when the foot deck section 360 is positioned on support frame 22 in use.

Figure 13:
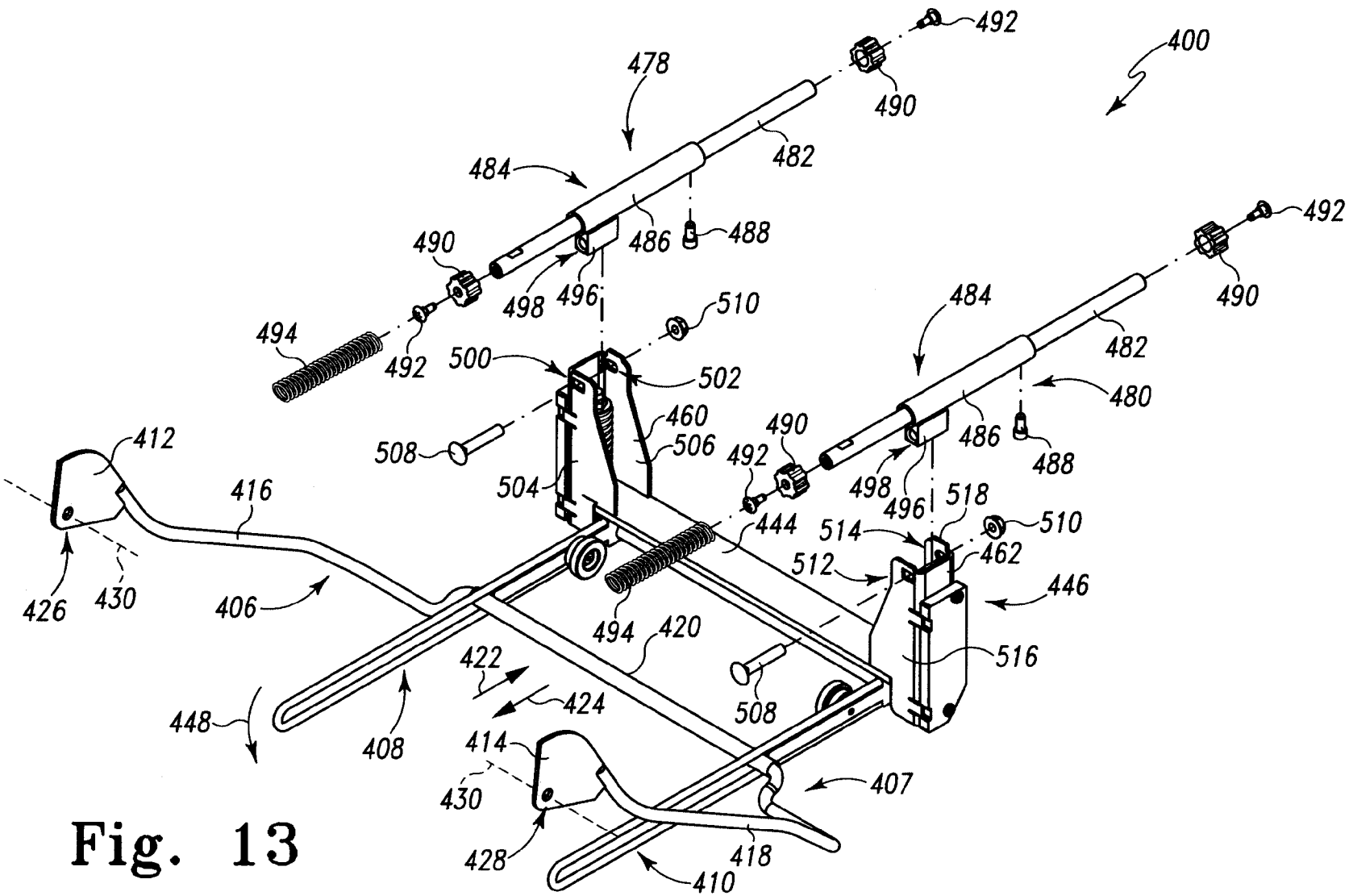
FIG. 13 is an exploded perspective assembly view of a structure coupled to a portion of the birthing bed of FIG. 2, the structure configured to support the stowable foot deck section in a stowed position.
Figure 14:
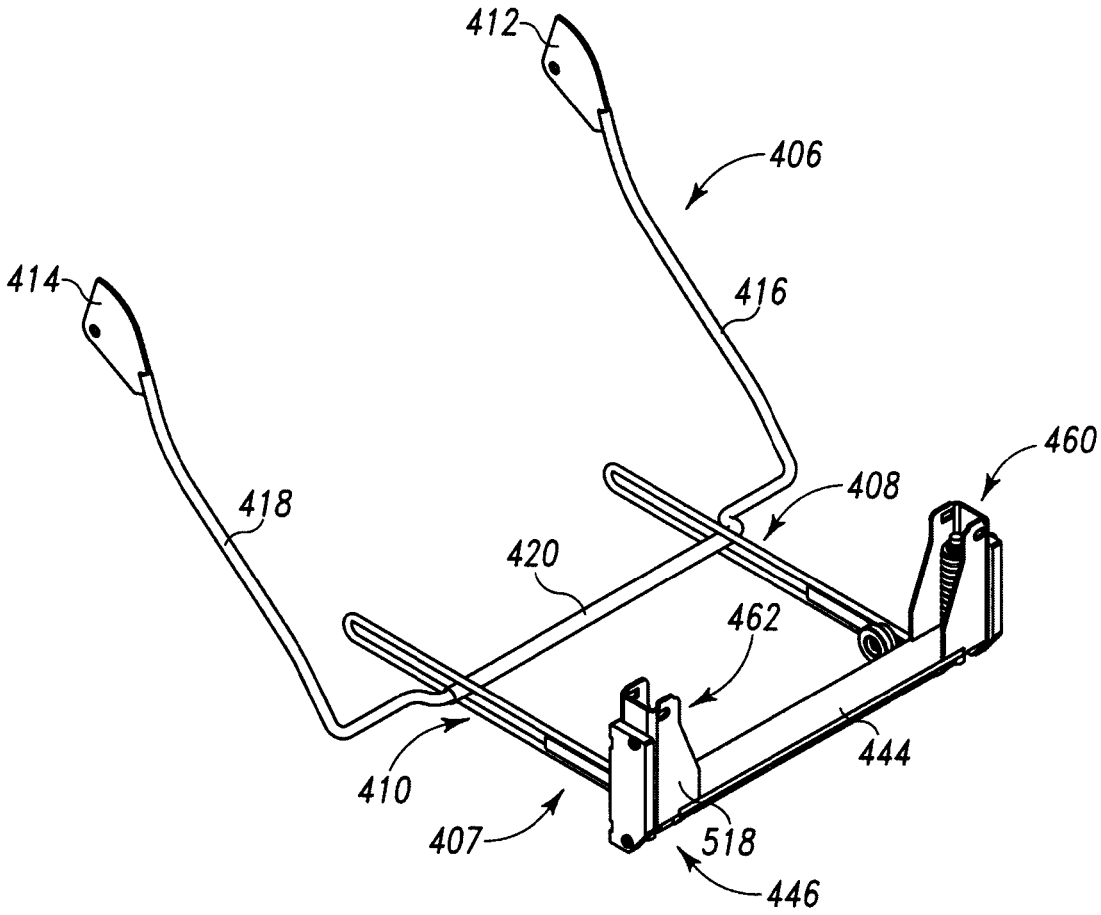
FIG. 14 is a perspective view of a portion of the storage structure of FIG. 13.
Figure 15:
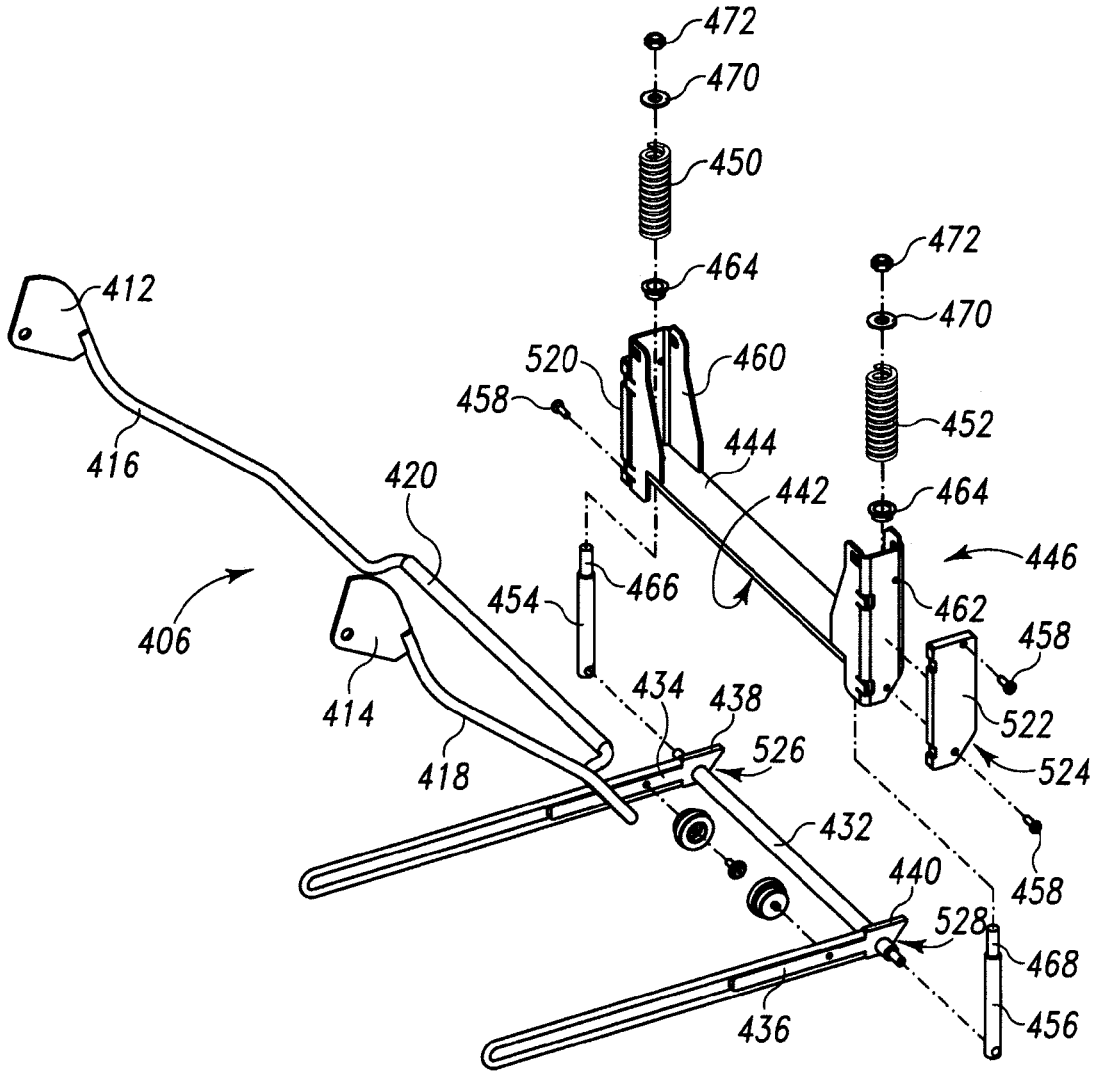
FIG. 15 is an exploded perspective assembly view of the portion of the storage structure of FIG. 14.

When not in use, foot deck section 360 is stowable on a storage structure 400 as shown in FIGS. 30-40 so that a placenta basin 402 of the foot deck section 360 is positioned for use during the labor and delivery process as shown in FIG. 2. A portion of storage structure 400 is shown in FIG. 13. Storage structure 400 is configured to receive and support foot deck section 360 thereon in a stowed position. In addition, storage structure 400 is configured to deflect if downwardly if a caregiver steps on foot deck section 360 while the section 360 is in the stowed position to prevent damage to the section 360. Finally, a portion of storage structure 400 moves along the longitudinally relative to the length of birthing bed 10 to clear a transverse beam 404 of the base 18.

Figure 39:
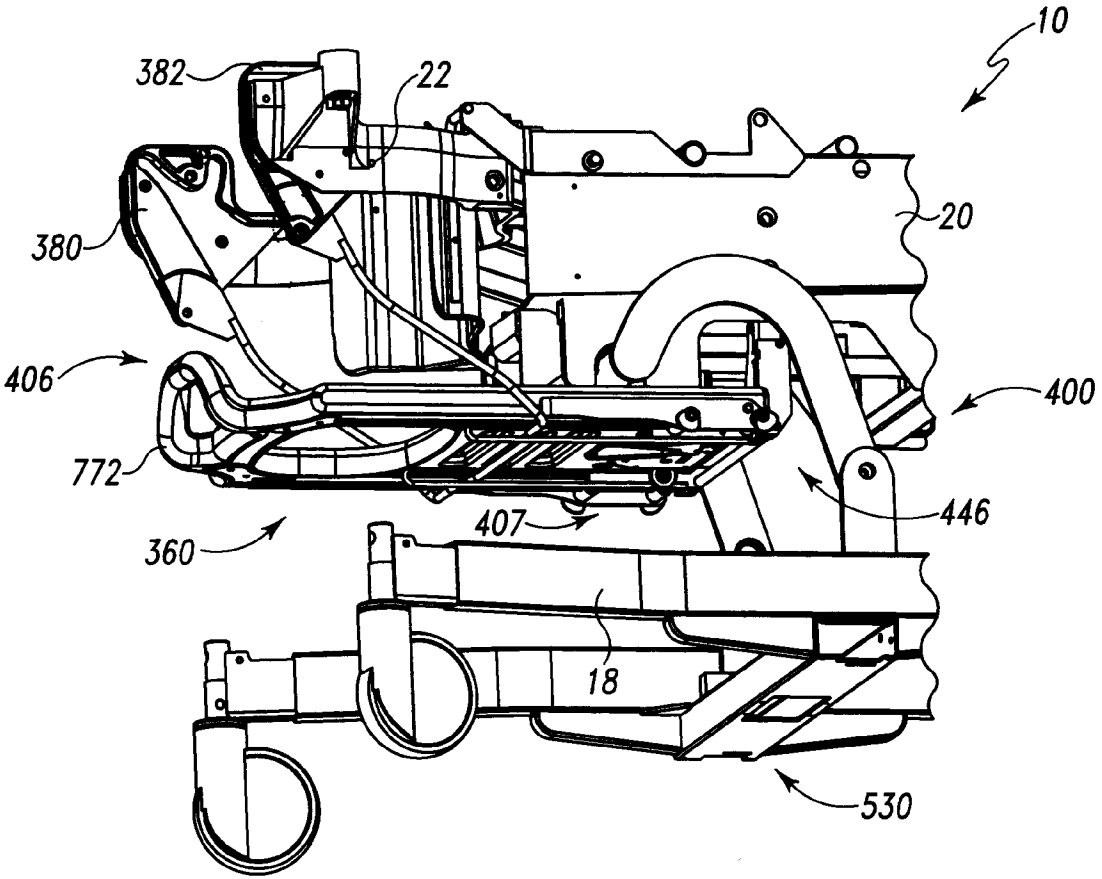
Figure 40:
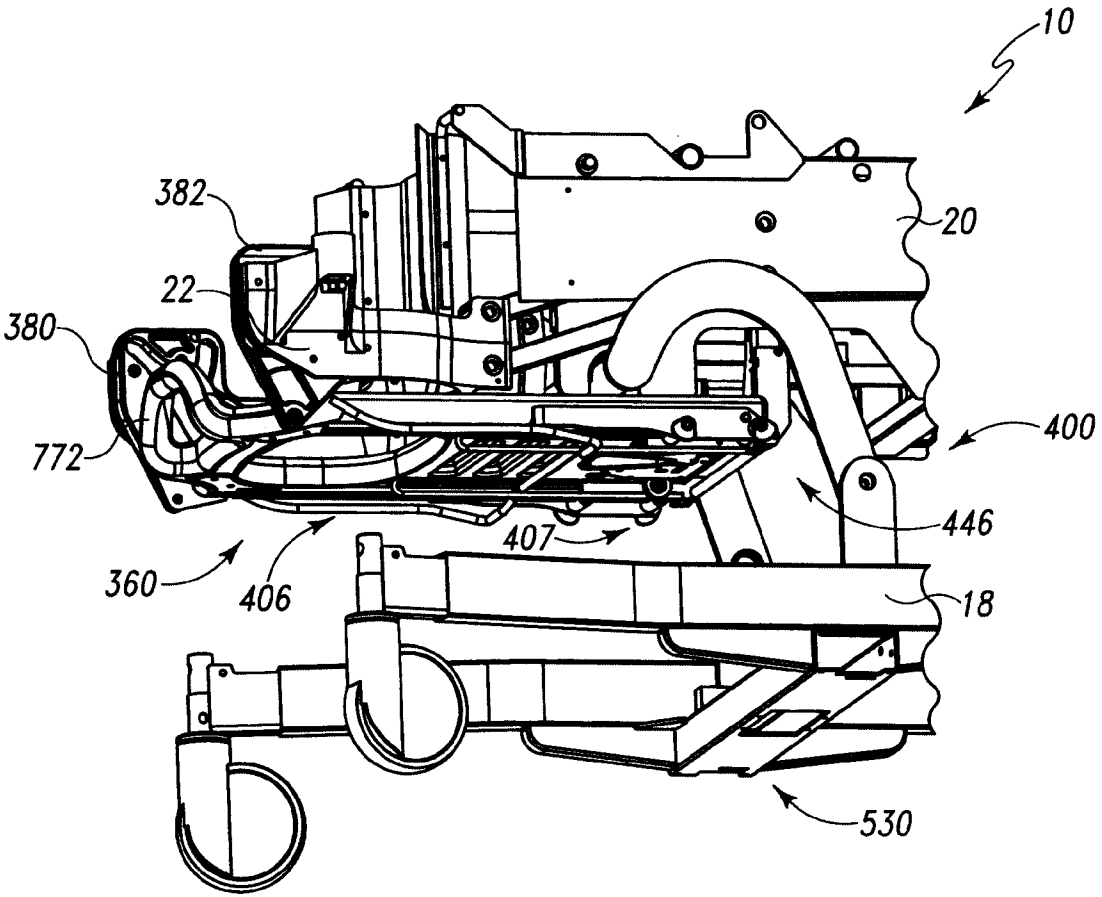

Referring to FIGS. 13-15 and 30-40, storage structure 400 includes a guide 406 which is supported on frame 407 which includes a pair of extensions 408 and 410. Guide 406 includes a pair of plates 412 and 414 which are configured to secure to receiver 380 and 382 respectively. Guide 406 further includes a pair of arms 416 and 418 which are coupled to plates 412 and 414 respectively. Arms 416 and 418 are interconnected by a cross-member 420 which is positioned within extensions 408 and 410 and supported by extensions 408 and 410 for movement relative thereto in the direction of arrows 422 and 424. Movement of guide 406 relative to frame 407 is illustrated in FIGS. 39 and 40. Generally, guide 406 moves relative to frame 407 when storage structure 22 moves vertically relative to intermediate frame 20. Plate 412 includes a through-hole 426 and plate 414 includes a through-hole 428 the centerlines of which cooperate to define an axis 430 of rotation about which guide 406 rotates as support frame 22 moves relative to intermediate frame 20.

Frame 407 further includes a shaft 432 coupled to two plates 434 and 436. Extension 408 is coupled to plate 434 and extension 410 is coupled to plate 436. Plate 434 has an upper surface 438 and plate 436 has an upper surface 440, each of which is configured to engage a lower surface 442 of a cross-member 444 of a bias assembly 446. Bias assembly is configured to maintain frame 407 in an orientation in which extensions 408 and 410 are in a generally horizontal orientation under normal conditions and to allow frame 407 to deflect relative to bias assembly 446 when a load is applied to the frame 407 distal to cross-member 444. For example, if foot deck section 360 is supported on frame 407 and a user steps on foot deck section 360, bias assembly 446 will permit frame 407 to deflect under the load of the user in the direction of arrow 448 shown in FIG. 13.

Bias assembly includes two extension springs 450 and 452 which bias against cross-member 444 when assembled to two pins 454 and 456 respectively. Pins 454 and 456 are received on opposing ends of shaft 432 of frame 407. Shaft 432 is secured to bias assembly 446 by two fasteners 458, 458 which are received in the ends of shaft 432. Bias assembly 446 also includes two brackets 460 and 462 engaged at opposite ends with cross-member 444. Two bearings 464 engage two through-holes (not shown) in cross-member 444 and provide a bearing interface between the cross-member 444 and the pins 454 and 456 and the extension springs 450 and 452. Pins 454 and 456 pass through extension springs 450 and 452 respectively. Pin 454 includes a threaded portion 466 and pin 456 includes a threaded portion 468 each of which are configured to receive a washer 470 and nut 472 biases surfaces 438 and 440 of plates 434 and 436 respectively against lower surface 442 of cross-member 444. The compression of extension springs 450 and 452 defines the amount of bias exerted by bias assembly 446 on frame 407.

Within the restraints of springs 450 and 452, cross-member 444 is free to move relative to brackets 460 and 462. Thus, as a load is applied to frame 407 in the direction of arrow 448, frame 407 rotates about shaft 432 and surfaces 438 and 440 are urged against surface 442. If the load is of a sufficient magnitude, cross-member 444 compresses springs 450 and 452 to allow frame 407 to deflect. Once the load is removed, frame 407 is urged to return to a position in which extensions 408 and 410 are in a generally horizontal orientation.

Figure 31:
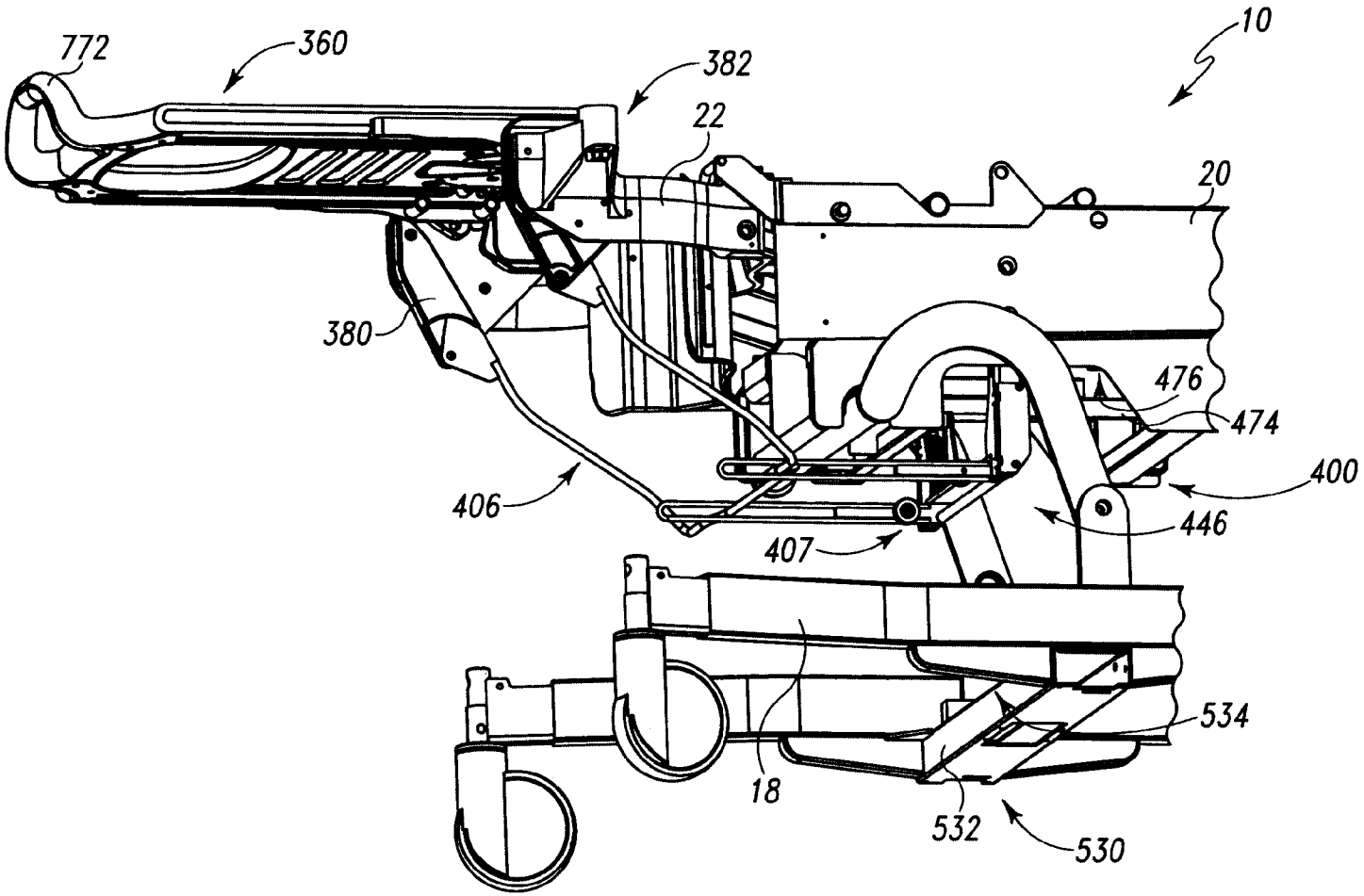

Referring to FIG. 31, storage structure 400 is received in tube members 474 and 476 of intermediate frame 20 and is moveable longitudinally relative to intermediate frame 20. Storage structure 400 comprises two hanger assemblies 478 and 480 to which brackets 460 and 462 are coupled respectively. Hanger assemblies 478 and 480 have identical structures and will be described generally with reference to hanger assembly 478. Hanger assembly 478 includes a rod 482 and a hanger bracket 484 which includes a tubular member 486 through which rod 482 is received. A fastener 488 is threaded through tubular member 486 and engages rod 482 to secure hangar bracket 484 to rod 482. Thus, hanger bracket 484 is fixed to and moves with rod 482. Hanger assembly 478 further includes two guides 490, 490, each of which is coupled to an end of rod 482 by a fastener 492 such that when hanger assembly 478 is assembled, guides 490, 490 are positioned to support rod 482 within member 474 of intermediate frame 20. Guide 490 is sized to be received in an inner space of member 474 with sufficient clearance to move along the length of member 474. Storage structure 400 further includes a pair of extension springs 494, 494 one of which is positioned between a hanger assemblies 478 and 480 and intermediate frame 20 at a foot end of birthing bed 10, the extension springs 494, 494 positioned in members 474 and 476 respectively. The extension springs 494, 494 urge hanger assemblies 478 and 480 toward the head end of birthing bed 10.

Brackets 460 and 462 are secured to hanger assemblies 478 and 480 through a hanger block 496 which is formed to include a through-hole 498 parallel to the longitudinal length of tubular member 486. Bracket 460 is formed to include two through-holes 500 and 502 in opposing flanges 504 and 506 of bracket 460. Hanger block 496 is sized to be received between flanges 504 and 506 such that through-hole 498 aligns with through-holes 500 and 502. A fastener 508, illustratively embodied as a carriage bolt, passes through the through-holes 500, 498 and 502 and is secured by a nut 510 to couple bias assembly 446 to hanger assembly 478. Bracket 462 is secured to hanger assembly 484 in a similar manner. Fastener 508 passes through a through-hole 512 in flange 516 of bracket 462, a through-hole 498 in hanger block 496 of hanger assembly 484, and a through-hole 514 in flange 518 of bracket 462 and is secured by a nut 510.

Referring again to FIG. 15, bias assembly further includes two bearing plates 520 and 522 coupled to outer surfaces of brackets 460 and 462 respectively by fasteners 458. Each of the bearing plates 520 and 522 operate in a similar manner with the two being mirror images of each other. Referring to plate 522, the bearing plate is formed to include an angled surface 524. Similarly, plates 434 and 436 are formed to include angled surfaces 526 and 528 which are generally parallel to angled surface 524 on bearing plate 522 and a complementary surface (not shown) on bearing plate 520.

The angled surfaces 524, 526, and 528 are positioned such that when intermediate frame 20 is lowered, the surfaces 524, 526, and 528 engage an intersection 534 of surfaces 532 and 536 of a cross-beam 530 of base 18. Engagement of surfaces 524, 526, and 528 with cross-beam 530 urges storage structure 400 toward the foot end of birthing bed 10 and overcomes the bias of extension springs 494 causing the hanger assemblies 478 and 480 to move longitudinally to prevent damage to foot deck section 360 and storage structure 400 due to a lack of clearance between storage structure 400 and cross-beam 530. When intermediate frame 20 is raised, extension springs 494 urge storage structure 400 to a home position.

Figure 43:
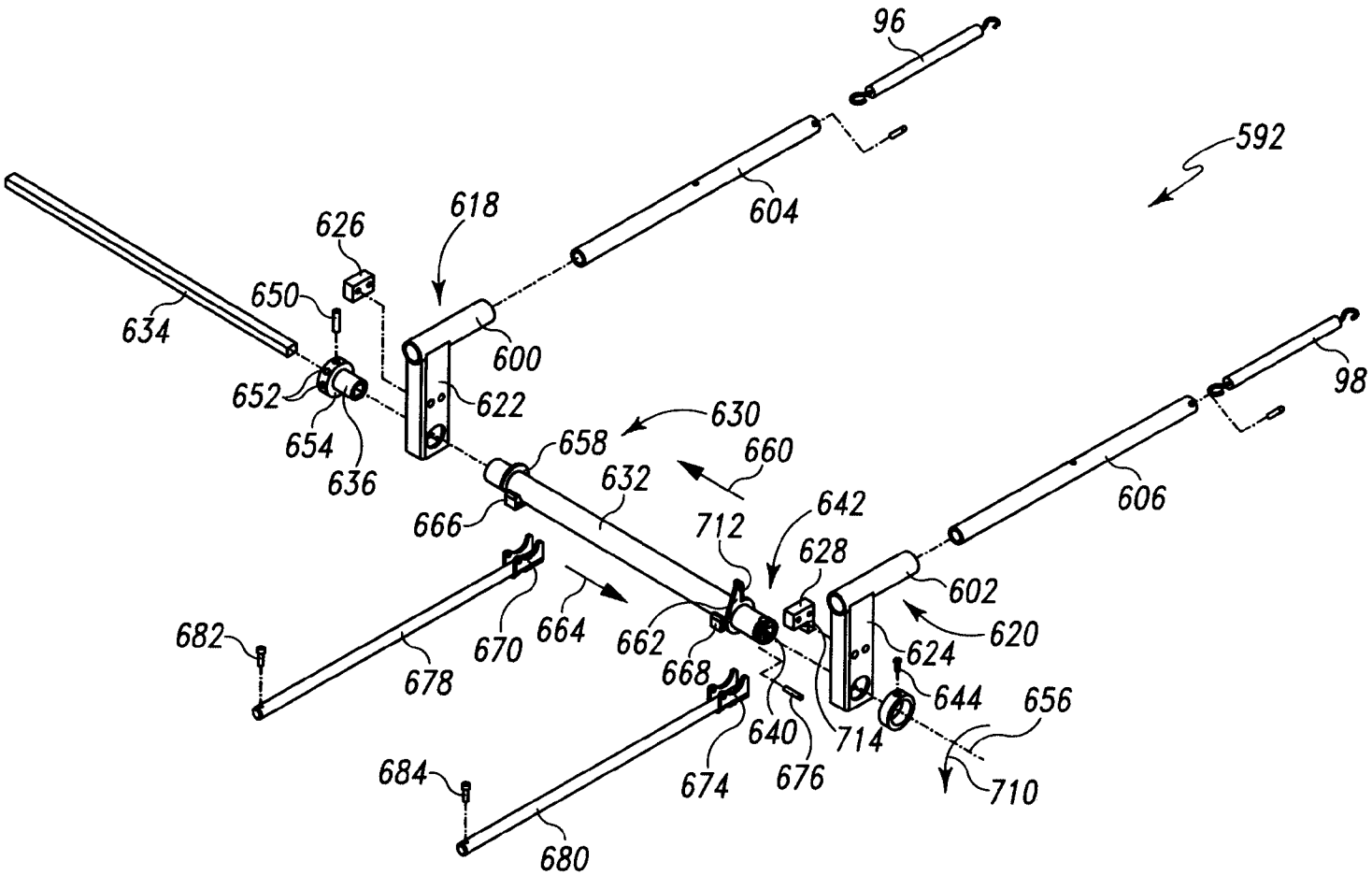
FIG. 43 is a perspective exploded assembly view of another embodiment of a storage structure configured to support a foot deck section suspended from a frame of a patient-support apparatus.

In another embodiment shown in FIG. 43, a storage structure 592 is supported from the intermediate frame 20 and moveable relative thereto. The storage structure 592 comprises two springs 596 and 598 that are each coupled at one end to members 474 and 476 respectively. The springs 596 and 598 are each coupled to a tubular rod 604 and 606 respectively as well. The tubular rods 604 and 606 each support tubes 600 and 602 respectively. Springs 596 and 598 bias storage structure 592 and urge storage structure 592 toward the head end of the birthing bed 10.

The storage structure 592 further comprises two support brackets 618 and 620 that comprise tubes 600 and 602 respectively. Each support bracket 618 and 620 has a hanger 622 and 624 respectively and each hanger 622 and 624 has a mount block 626 and 628 respectively secured to the hangars 622, 624, the mount blocks 626 and 628 configured to limit rotation of a torsion spring assembly 630 relative to the hangers 622 and 624. The torsion spring assembly 630 comprises an outer tube 632, a plurality of flexion members 634, a torsion collar 636, and a retaining collar 638. The flexion members 634 are received through the length of outer tube 632 and received in a square aperture 640 in an end 642 of outer tube 632. The retaining collar 638 is coupled to the end 642 of outer tube 632 by a pin 644 once outer tube 632 has passed through an aperture 646 in hanger 624.

The flexion members 634 are received in a through-hole 648 of torsion collar 636, the through-hole 648 having a square cross-section. The mount block 626 comprises a pin receiving hole (not shown) which receives a pin 650. The pin 650 is also received in one of a series of holes 652 in an outer annular surface 654 of torsion collar 636. The connection of pin 650 to torsion collar 636 and mount block 626 fixes the torsion collar 636 relative to the support bracket 618 and, thereby, the intermediate frame 20.

The outer tube 632 has a longitudinal axis 656 about which the outer tube 632 rotates. Outer tube 632 also comprises a positioning flange 658 that engages with a surface 660 of hanger 622 to prevent lateral movement of the torsion spring assembly 630 in the direction of an arrow 660. Another positioning flange 662 is positioned along outer tube 632 adjacent an inner surface (not shown) of hanger 624 to prevent lateral movement of the torsion spring assembly 630 in the direction of an arrow 664. Thus, torsion spring assembly 630 is retained on hanger 622 by torsion collar 636 and positioning flange 658 and retained on hanger 624 by position flange 662 and retaining collar 638.

The outer tube 632 still further comprises two mounts 666 and 668 that are positioned to be vertically below the longitudinal axis 656. The mount 666 receives a bracket 670 that is coupled to mount 666 by a pin 672. Similarly, a bracket 674 is coupled to mount 668 by a pin 676. Each bracket 670 and 674 are coupled to a rod 678 and 680 respectively. Each rod 678 and 680 have a pin 682 and 684 respectively coupled to the rods 678 and 680, the pins 682 and 684 serving as retainers.

As discussed above, storage structure 692 deflects under load. For example, if a load is placed on storage structure 692, torsion spring assembly 630 rotates about axis 656 as depicted by arrow 710. While the end of torsion spring assembly 630 where torsion collar 636 is fixed to mount block 626 is restrained from rotating, torsion members 634 flex at end 642. The torsion members 634 are engaged with outer tube 632 at aperture 640 but outer tube 632 is free to rotate relative to torsion collar 636. Therefore, outer tube 632 rotates relative to brackets 622 and 624 allowing rods 678 and 680 to pivot about axis 656.

Figure 4:
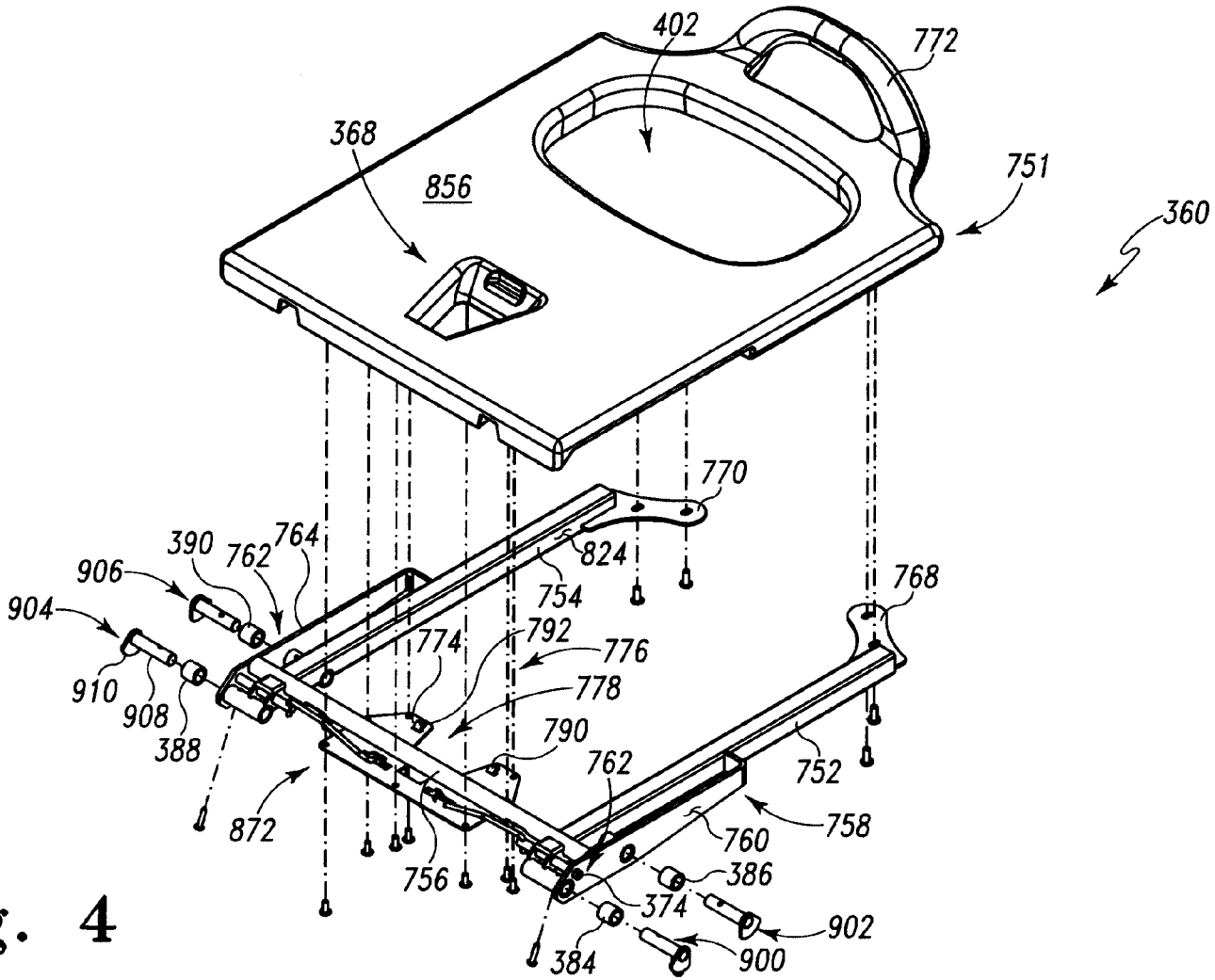
FIG. 4 is a an exploded perspective assembly view of the stowable foot deck section of FIG. 3, the foot deck section viewed from above.

Further, rotation of outer tube 632 in the direction opposite arrow 710 is limited by the engagement of a tab 712 of flange 662 that engages a tab 714 of mount block 628. Because mount block 628 is fixed to bracket 624, the engagement of tab 712 with tab 714 constrains rotation of outer tube 632 in the direction opposite arrow 710 about axis 656. FIG. 4 shows the storage structure 592 in an undeflected position. During movement of the intermediate frame 20 downwardly, the brackets 622 and 624 engage cross-beam 530 of base 18 and are urged away from cross-beam 530 to prevent damage to storage structure 592 due to interference between brackets 622 and 624 with cross-beam 530.

Thus, storage structure 592 operates in a manner similar to storage structure 400 to permit rotation of a frame of the storage structure relative to the intermediate frame and longitudinal movement of the storage structures 400 and 592 relative to the intermediate frame. It should be understood that in some embodiments, the bias assembly 446 of storage structure 400 may be omitted and replaced with the torsional spring assembly 630. Likewise, in some embodiments, the hanger assemblies 478 and 480 may be omitted and replaced with a structure utilizing the springs 96 and 98 of storage structure 592.

Figure 10:
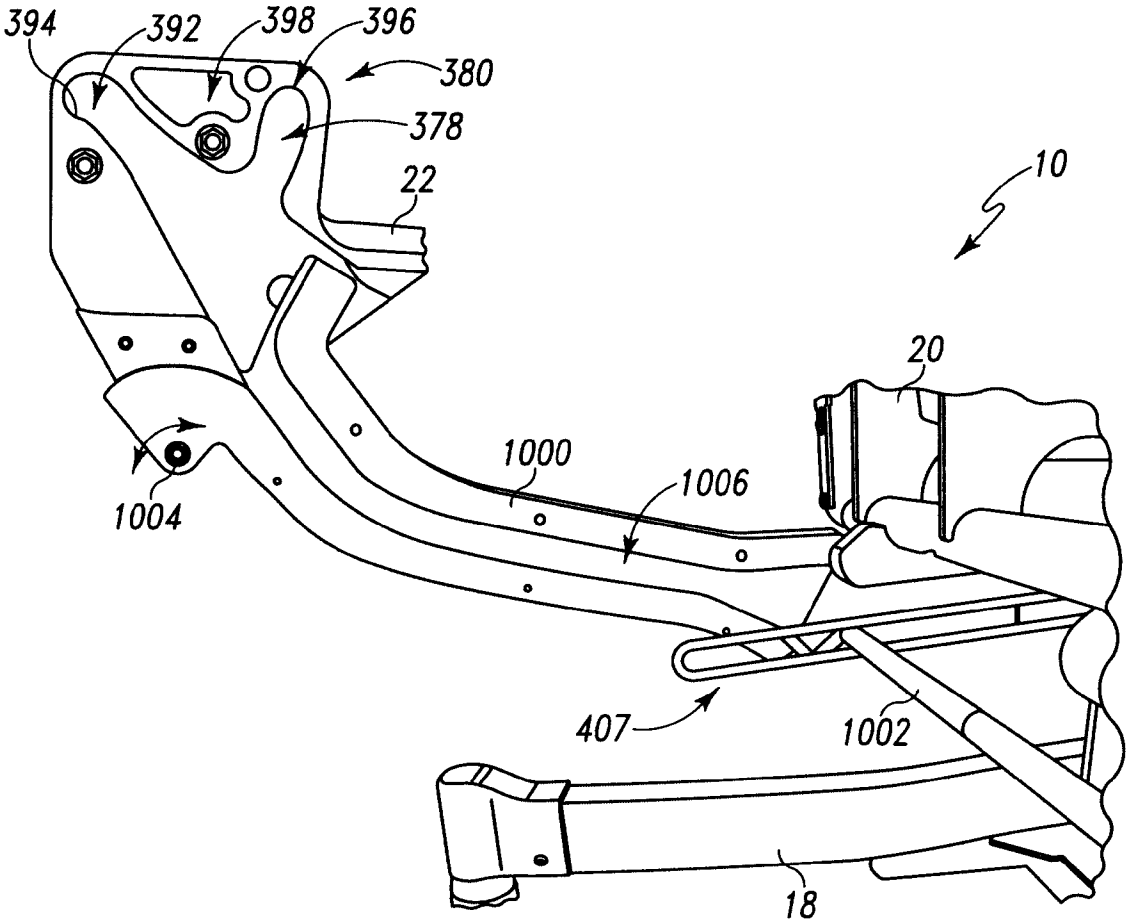
FIG. 10 is a perspective view of a portion of a birthing bed having an embodiment of a guide system which guides the stowable foot deck section from a use position to be supported on a storage structure
Figure 29:
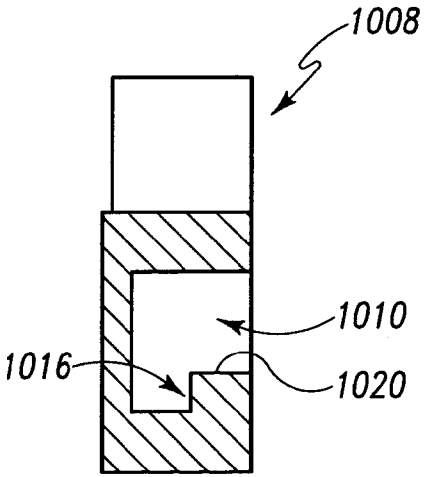
FIG. 29 is a cross-sectional view of the guide of FIG. 27 taken along lines 29-29 in FIG. 28.
Figure 27:
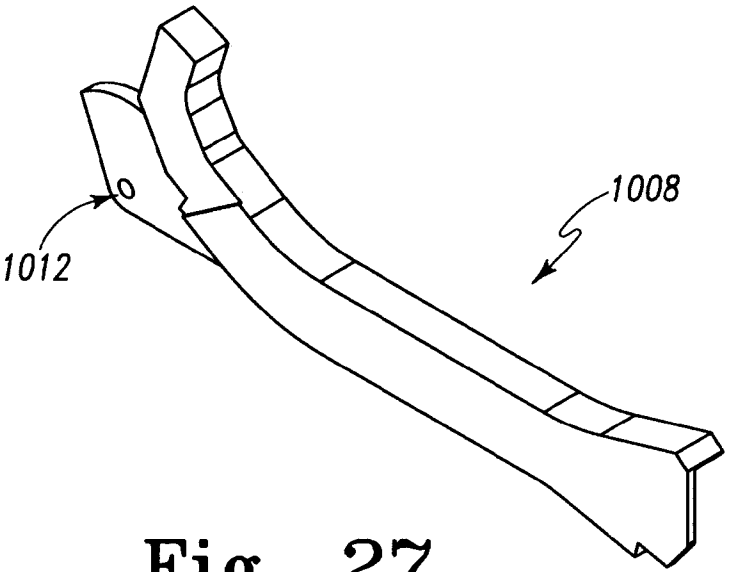
FIG. 27 is a perspective view of a portion of the guide shown in FIG. 10.
Figure 28:
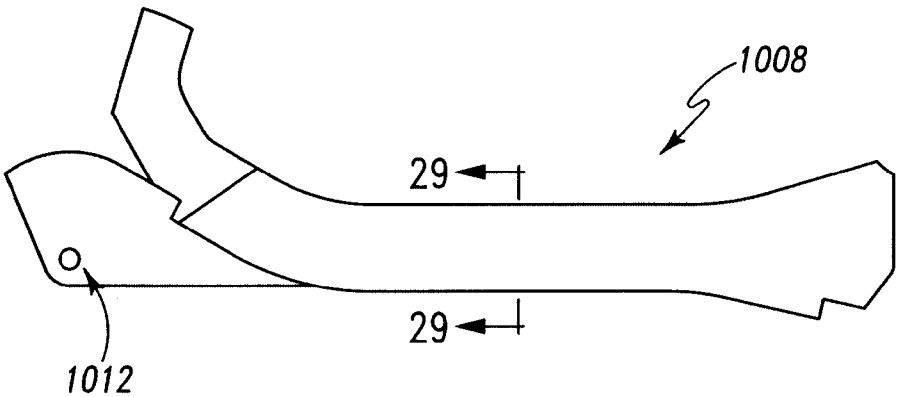
FIG. 28 is a side view of the guide of FIG. 27.

In another embodiment, guide 406 is omitted and replaced with a pair of guide members. A guide member 100 is shown in FIG. 10 engaged with a receiver 380. Another guide member engages receiver 382 and is substantially similar to guide member 1000 but in a mirror image and the discussion of guide member 1000 will be sufficient to understand the disclosure. Guide member 1000 is pivotable about a pivot 1004. Guide member 1000 is supported on a structure similar to storage structure 400 and is supported on frame 407 by a cross-member 1002. Cross-member 1002 is secured to guide member 1000 such that rollers 384 and 386 and retainers 900 and 902 are guided down a channel 1006 as foot deck section 360 is moved to a stowed position. Referring now to FIGS. 27-29 a guide member 1008 which is the opposite hand of guide member 1000 is shown in detail. Guide member 1008 includes a channel 1010 and guide member pivots relative to receiver 382 about a mount hole 1012 as depicted by arrow 1014. As seen in FIG. 29, guide member 1008 includes a trough 1016 formed in channel 1010. Trough 1016 is configured to receive a flange 910 of the retainers 900 and 902 to prevent foot deck section 360 from moving laterally as foot deck section 360 is moved to a stowed position. Rollers 384 and 386 roll along a surface 1020 preventing flanges 910 of retainers 900 and 902 from contacting metal surfaces within trough 1016.

Figure 6:
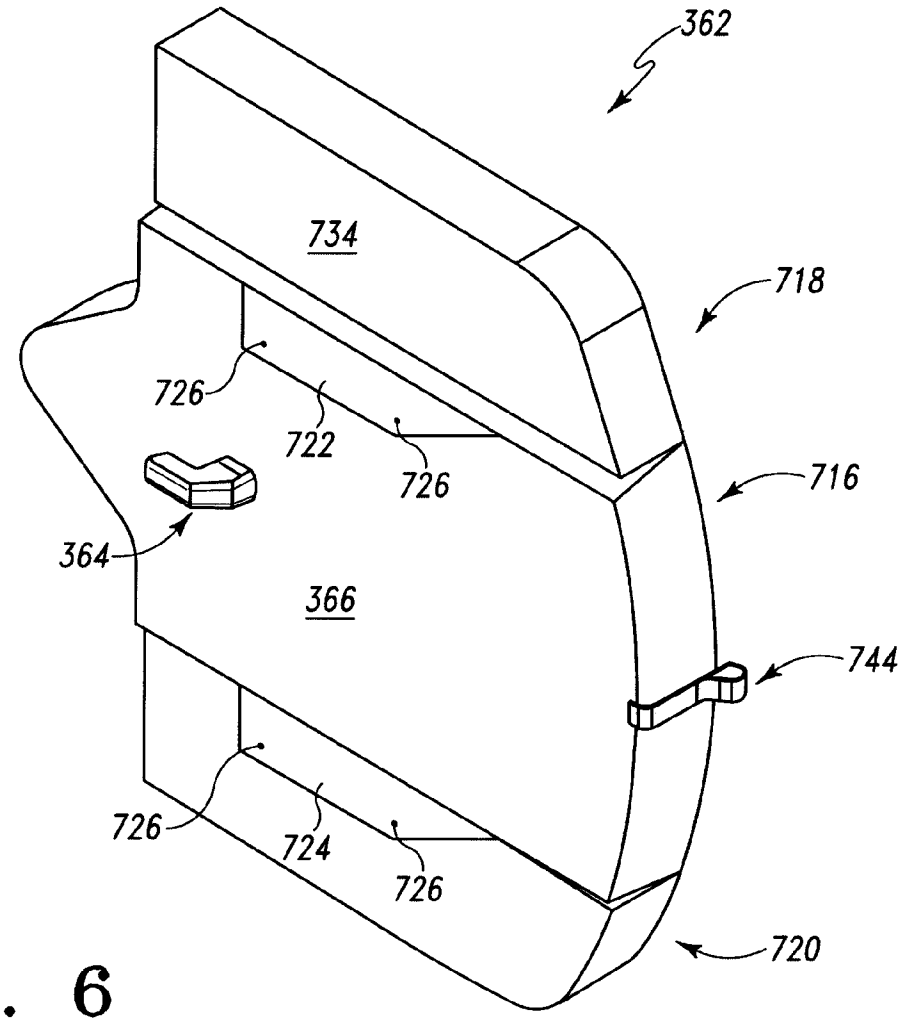
FIG. 6 is a perspective view of the cushion assembly configured to be supported on the foot deck section, the cushion assembly including a protrusion configured to be received by the stowable foot deck section to activate a locking mechanism to secure the stowable foot deck section in use position on the birthing bed.
Figure 7:
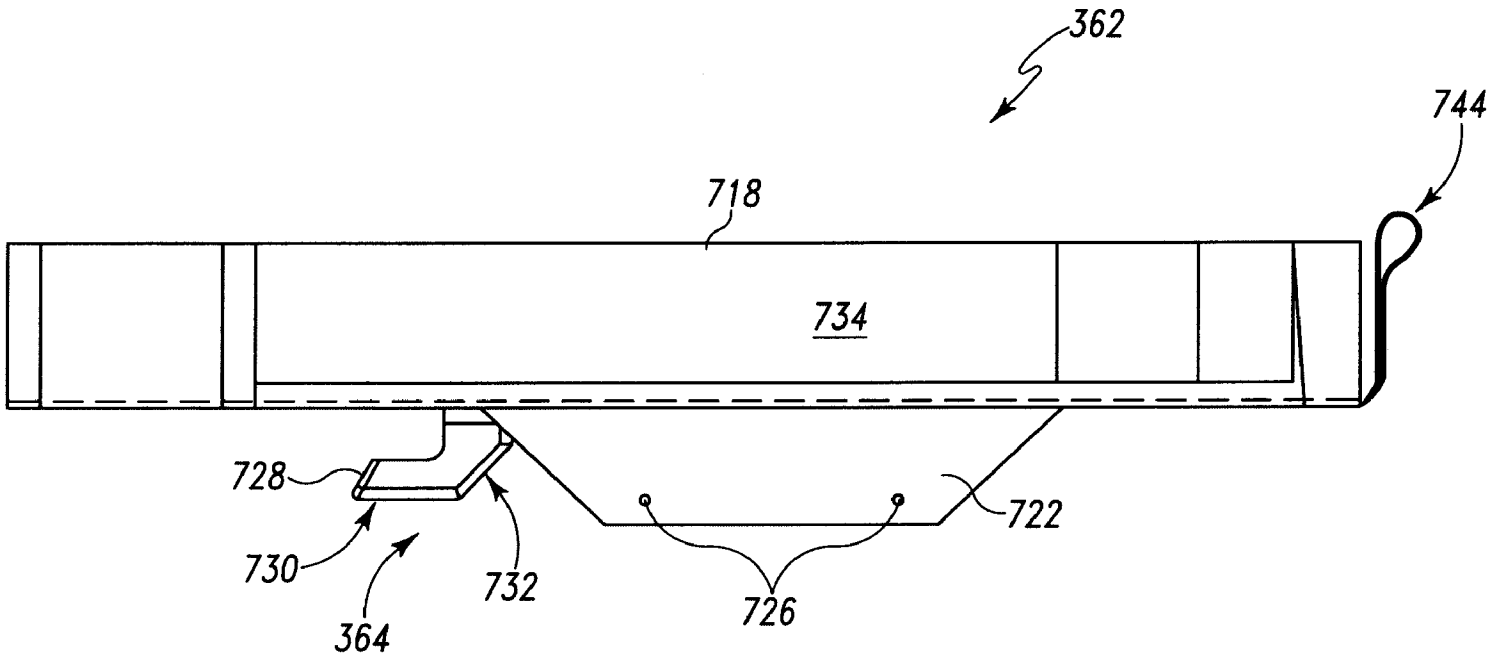
FIG. 7 is a side view of the cushion assembly of FIG. 6.
Figure 9:
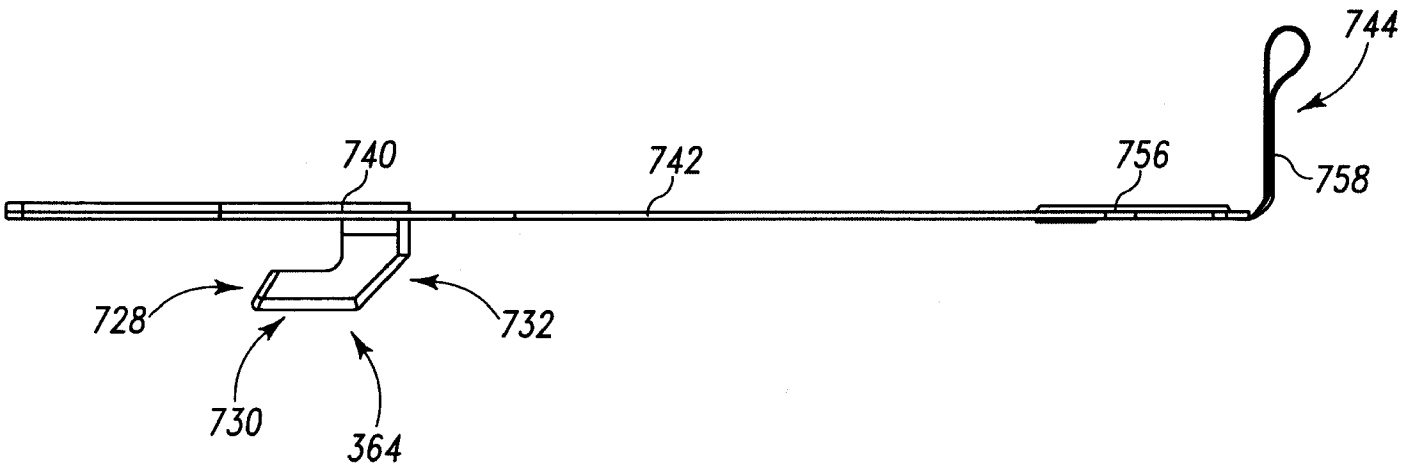
FIG. 9 is a side view of the storage structure of FIG. 8.

Referring now to FIG. 6, the foot support cushion assembly 362 comprises a central cushion 716 and side cushions 718 and 720. The cushions 716, 718 and 720 are all covered with a single covering comprising a urethane-coated fabric. However, cushions 718 and 720 are pivotable relative to cushion 716. The cushion assembly 362 also comprises a flap 722 and a flap 724, and each flap including snaps 726 that permit the cushion assembly 362 to be secured to an upper surface 856 of foot deck section 360. As seen in FIG. 9, activator 364 comprises a leading slanted surface 728 on a main portion 730, the main portion 730 being configured to be received in aperture 368 of foot deck section 360. The main portion 730 extends from a base portion 732, which is coupled to a support plate 740 which is in the side of the covering 734 of cushion assembly 362 such that activator 364 extends through an aperture 736 formed in a lower surface 738 of central cushion 716 a cushion assembly 362.

Figure 8:
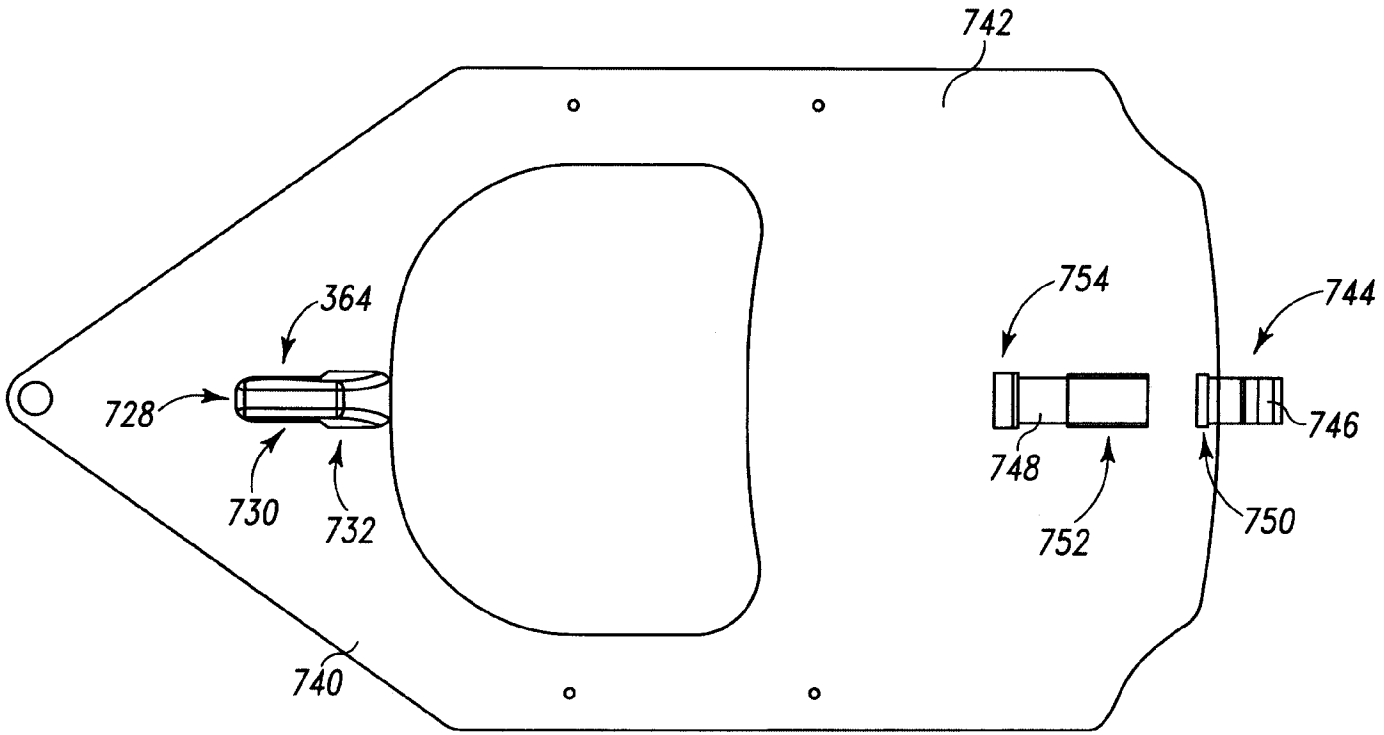
FIG. 8 is a bottom view of a storage structure of the cushion assembly of FIG. 6.

Activator 364 also extends through a plate 742 that provides rigidity to cushion assembly 362. The plates 740 and 742 in the illustrative embodiment comprise a semi rigid plastic material. Cushion assembly 362 further comprises a grip handle 744 that comprises a woven nylon fabric and is secured to plate 742. Referring now to FIG. 8, grip handle 744 has a loop 746 and a strap 748 passing through a first aperture 750 and being fed through a second aperture 752 and through a third aperture 754 and then back upon itself so that the strap be is secured to plate 742 by a hook and loop fastener 756, best seen in FIG. 9. Also, loop 746 is formed by securing a portion of the woven fabric material back upon itself and securing it with yet another hook and loop fastener Referring now to FIG. 4, the foot deck section 360 is shown with a cover 751 separated to show the structure of the locking mechanism 872 and the coupling of the locking mechanism 872 to members of the frame of the foot deck section 360. The foot deck section 360 comprises two frame rails 752 and 754.

The frame rails 752 and 754 are each coupled to a cross-tube 756. The deck section 360 also comprises a gusset 758 coupled to frame rail 752 and cross tube 756. The rollers 384 and 386 are coupled to gusset 758 and extend outwardly from a surface 760 of the gusset 758 and are retained on gusset 758 by two retainers 900 and 902 respectively. The gusset 758 further comprises an aperture 762 through which retaining pin 374 extends and retracts. The foot deck section comprises a gusset 764 coupled to frame rail 754 and coupled to cross tube 756. The rollers 388 and 390 are each coupled to frame rail 754 and extend outwardly from a gusset 764 and are retained on gusset 764 by two retainers 904 and 906 respectively. Each retainer 900, 902, 904 and 906 comprise a bearing surface 908 and a flange 910 which is configured to maintain the position of foot deck section 360 laterally on storage structure 400. Rollers 384, 386, 388 and 390 are free to rotate on the bearing surface 908 of the retainers 900, 902, 904 and 906. The 376 extends through an aperture in gusset 764 and is movable relative thereto to extend outwardly from a surface 766 of the gusset 764 to engage a receiver 382. The foot deck section 360 also comprises flanges 768 and 770 coupled to frame rails 752 and 754 respectively. Flanges 768 and 770 are configured to be coupled to a plastic handle 772 (best seen in FIG. 4).

Figure 5:
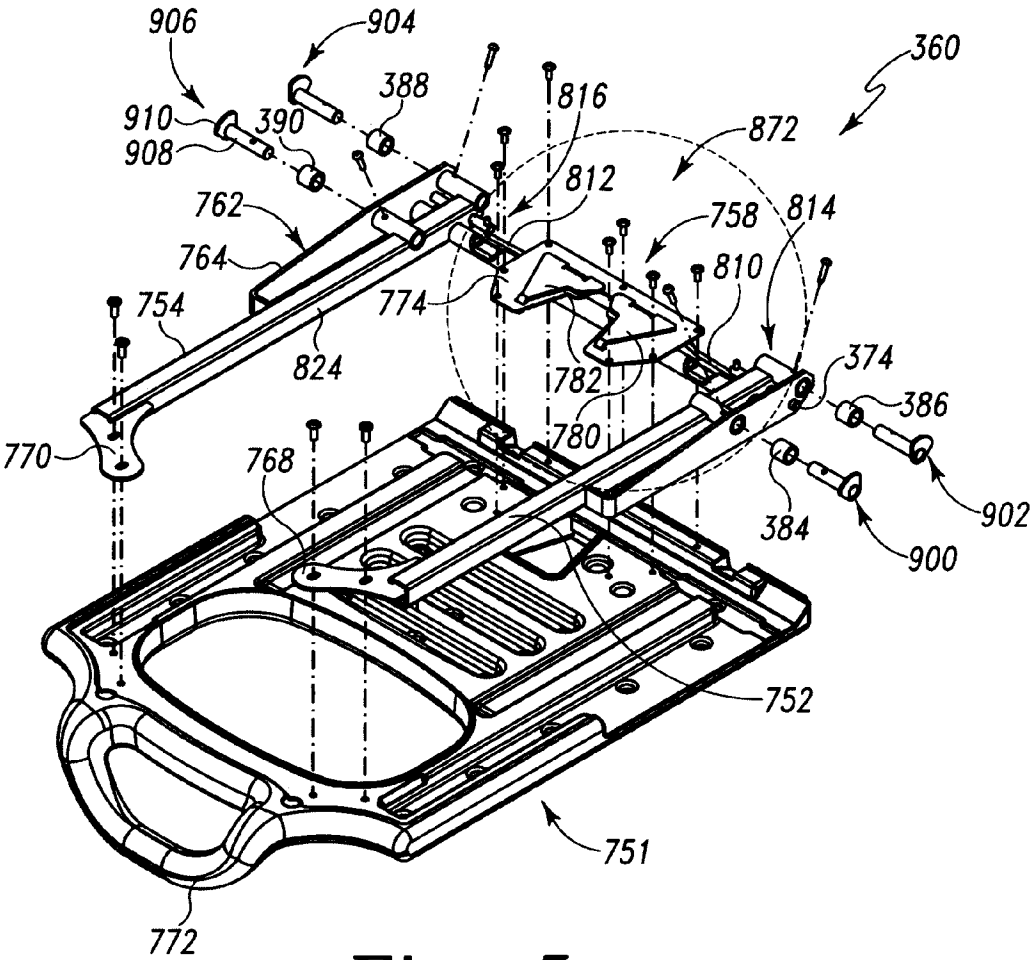
FIG. 5 is an exploded perspective assembly view of the foot deck section similar to FIG. 4, the foot deck section viewed from below in FIG. 5.
Figure 5A:
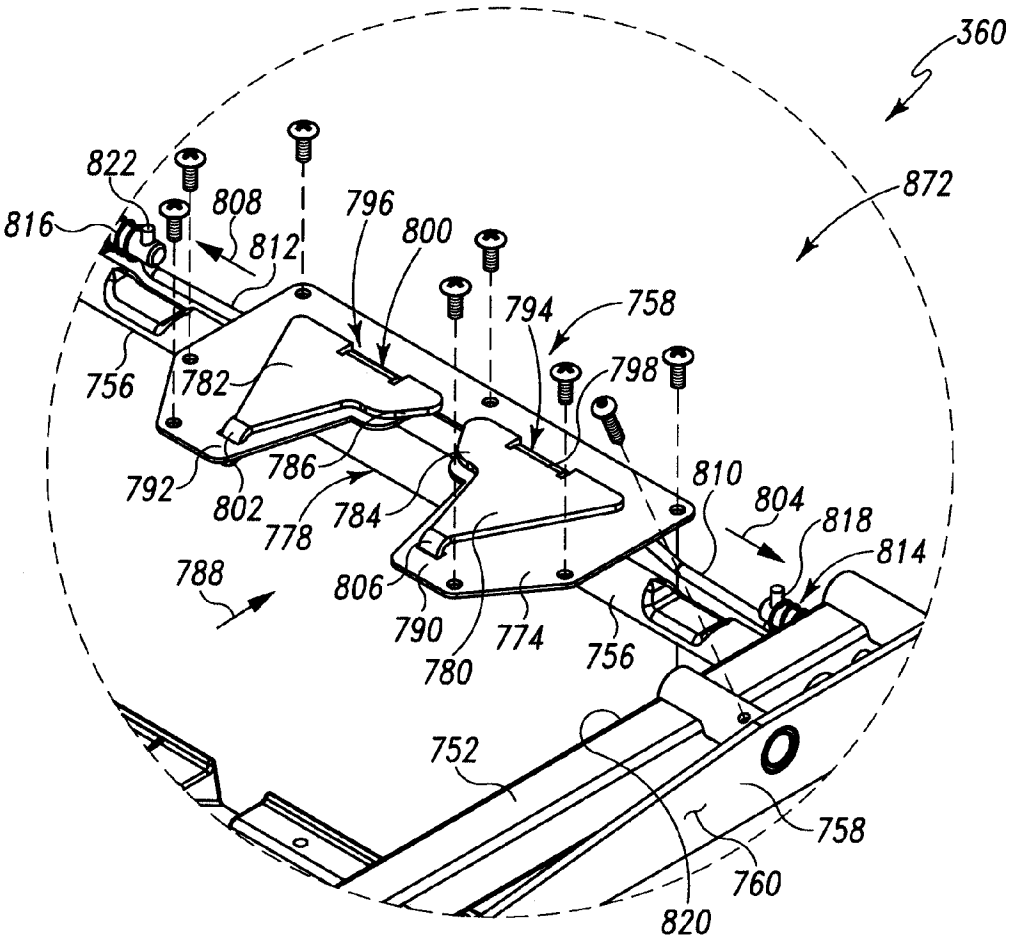
FIG. 5A is an enlarged view of a portion of FIG. 5 enclosed in a circle in FIG. 5.

When the activator 364 of cushion assembly 362 is received within aperture 368 of foot deck section 360, the actuator engages locking mechanism 372 such that the pins 374 and 376 are extended from the foot deck section 360 to engage receivers 380 and 382 to retain the foot support deck 16 to the support frame 22. Referring to FIG. 5A, the locking mechanism 372 comprises a support plate 774 that is coupled to cross tube 756. Support plate 774 defines a first space 776 and a second space 778 receives the activator 364 as the cushion assembly 362 is positioned on the foot deck section 360.

The support plate 774 comprises an aperture 790 through support plate 774 on the patient right side of foot deck section 360. The locking mechanism 372 further comprises an actuator plate 780 that comprises a tang 802 that is received through aperture 790. The actuator plate 780 is movable relative to support plate 774 and the tang 802 moves within aperture 790 when the locking mechanism 372 is actuated by activator 364. The actuator plate 780 moves laterally in the direction of arrow 804 to extend the pin 374 outwardly laterally from the foot deck section 360. The actuator plate 780 further comprises an engagement edge 784 that is engaged by surface 728 of activator 364 when cushion assembly 362 is positioned on foot deck section 360. As the activator 364 advances in the direction of arrow 788, actuator plate 780 is displaced in the direction of arrow 804.

Support plate 774 further comprises an aperture 792 positioned on the patient left side, the aperture 792 receiving a tang 306 of an actuator plate 782. The actuator plate 782 further comprises an engagement edge 786 that is engaged by surface 728 of activator 364 as the activator 364 advances in the direction of arrow 788 so that actuator plate 782 is displaced laterally in the direction of arrow 808 to extend the pin 376 outwardly laterally from the foot deck section 360.

Referring again now to actuator plate 780, plate 780 further comprises a flange 798 which extends through an aperture 794 in support plate 774 and engages with an actuator arm 810 of locking mechanism 372, the actuator arm 810 transferring motion from the flange 798 to pin 374. Actuator plate 782 also comprises a flange 800 that extends through an aperture 796 in support plate 774 and engages with an actuator arm 812. Actuator arm 812 transfers motion from flange 800 to pin 376.

The locking mechanism 372 is biased to a position in which pins 374 and 376 are retracted and the bias is overcome by the displacement of actuator plates 780 and 782 by activator 364 when cushion assembly 362 is engaged with foot deck section 360. The bias is a result of the engagement of two springs 814 and 816 engaged with frame rails 752 and 754 respectively. Spring 814 is positioned between a leg 818 of actuator aim 810 and an inner surface 820 of frame rail 752. As actuator arm 810 is displaced laterally in the direction of arrow 804, spring 814 is compressed and resists displacement of pin 374 laterally. The spring 816 is interposed between a leg 822 of actuator arm 812 and an inner surface 824 of frame rail 754 and a spring 816 is compressed when actuator arm 812 is displaced laterally in the direction of arrow 808 thereby resisting displacement of pin 376. Engagement of activator 364 with actuator plates 780 and 782 maintains springs 814 and 816 and a compressed state until cushion assembly 362 is removed from foot deck section 360 wherein the bias of springs 814 and 816 retract pins 374 and 376 thereby permitting foot deck section to be moved relative to receivers 380 and 382.

Figure 30:
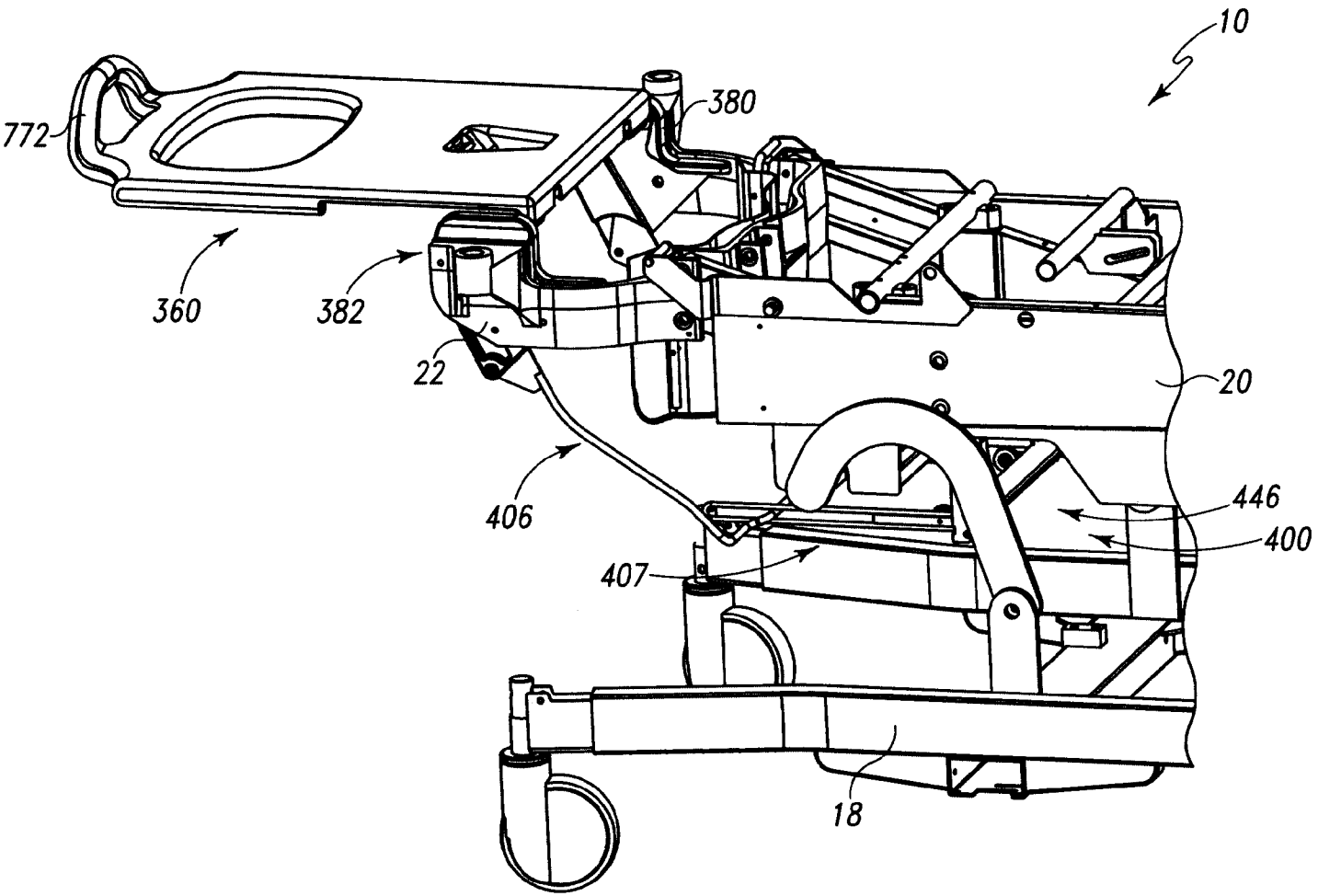
FIGS. 30-40 are various perspective views of another embodiment of a birthing bed with portions removed, the birthing bed having a structure and guide system to support a stowable foot deck section in a use position and in a stowed position.
Figure 32:
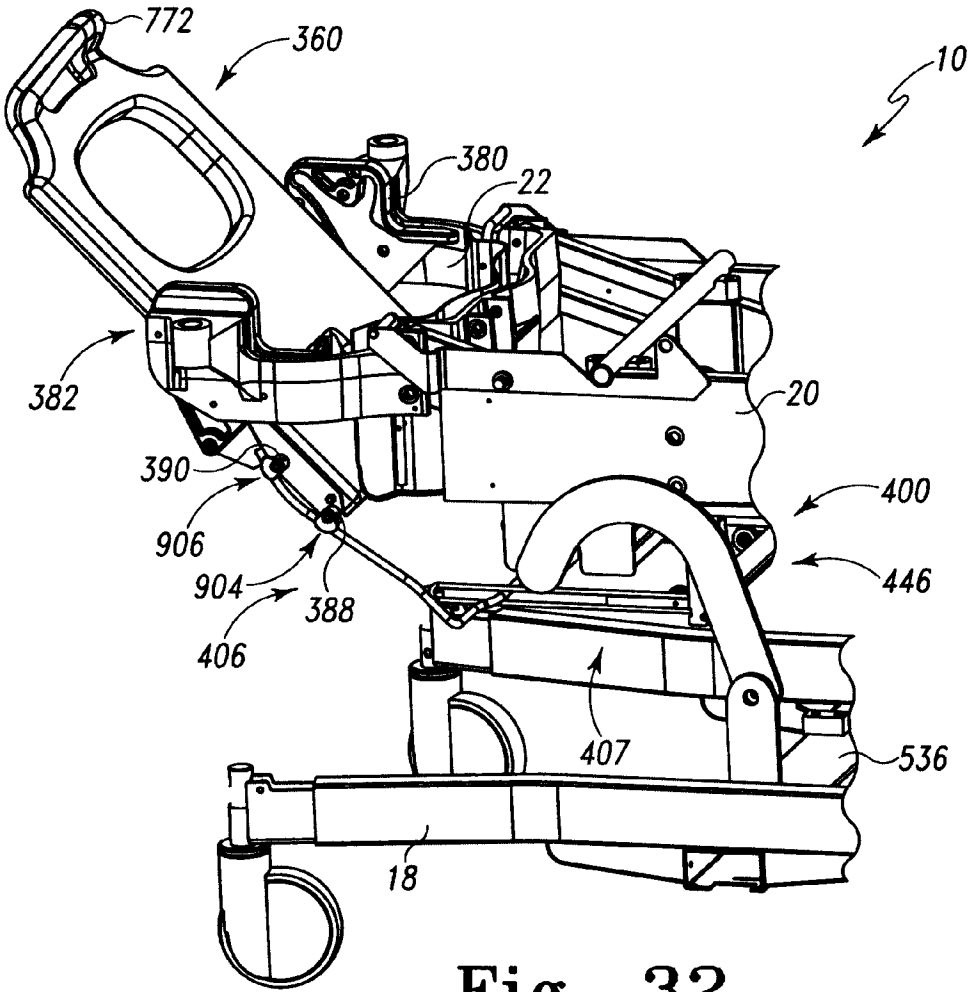
Figure 33:
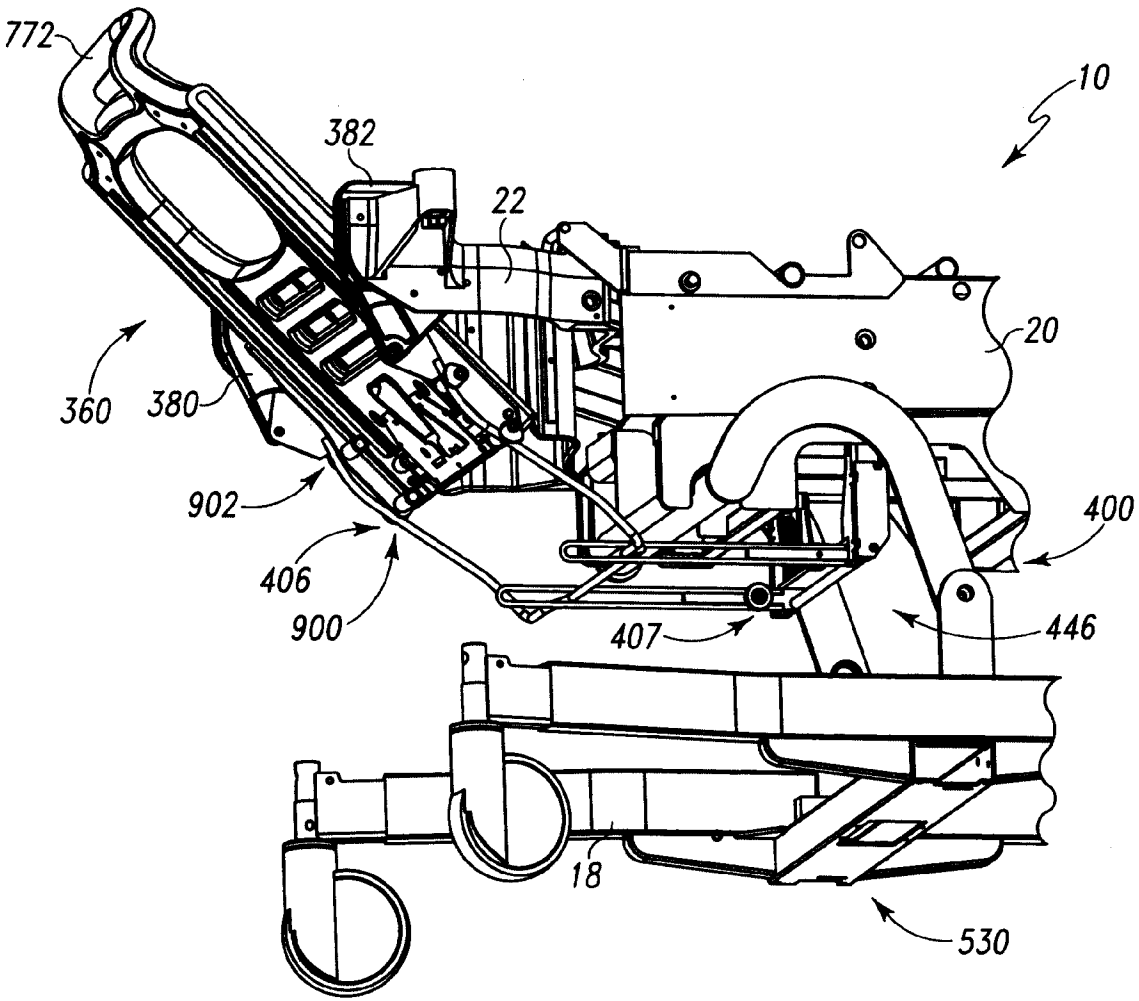

The steps necessary to stow foot deck section 360 are illustrated in the progress on FIGS. 30-40. In FIGS. 30 and 31, foot deck section 360 is supported on support frame 22 in a cantilevered configuration. Because the cushion assembly 362 is removed, the locking mechanism 372 is not actuated and foot deck section 360 is free to move relative to support frame 22. A user then lifts the handle 770 to raise a foot end of the foot deck section 360 and the rollers 388 and 390 engage the arm 418 of guide 406. As shown in FIGS. 32 and 33, the flanges 910 of retainers 904 and 906 engage with the arm 418 to preclude the foot deck section 360 from moving laterally on storage structure 400.

Figure 34:
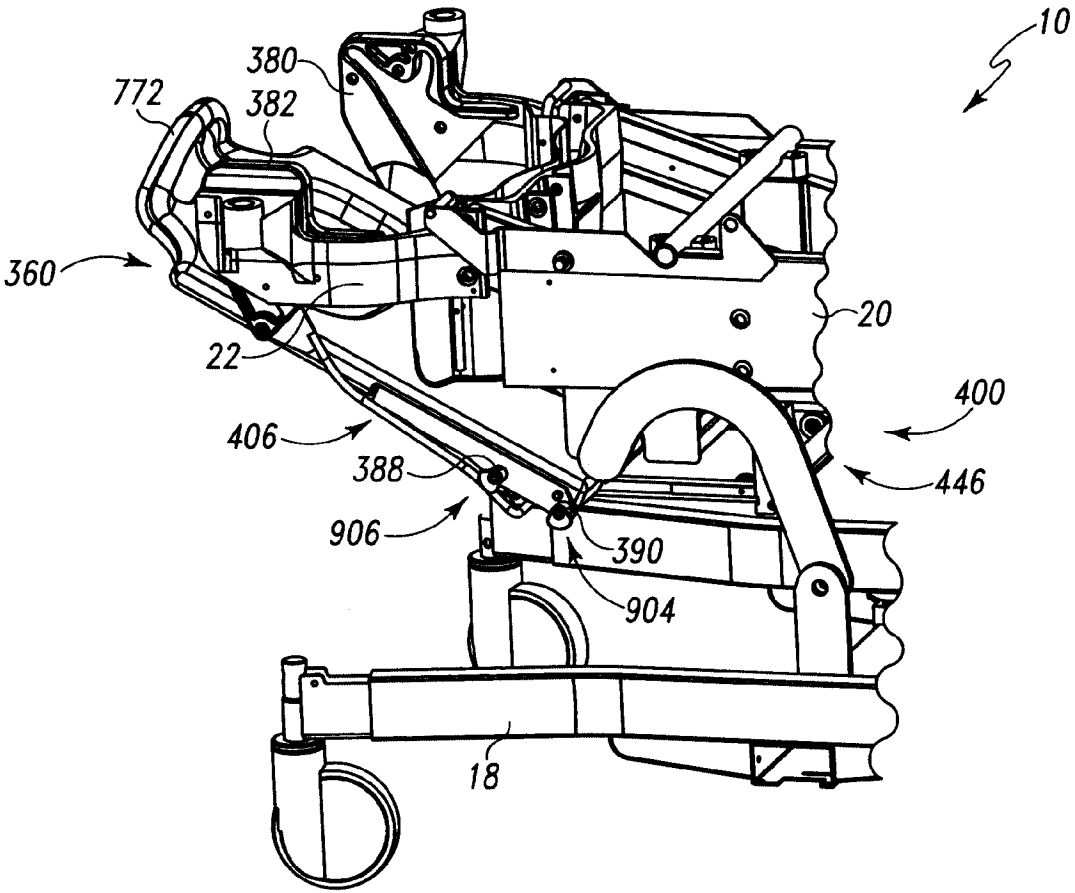
Figure 35:
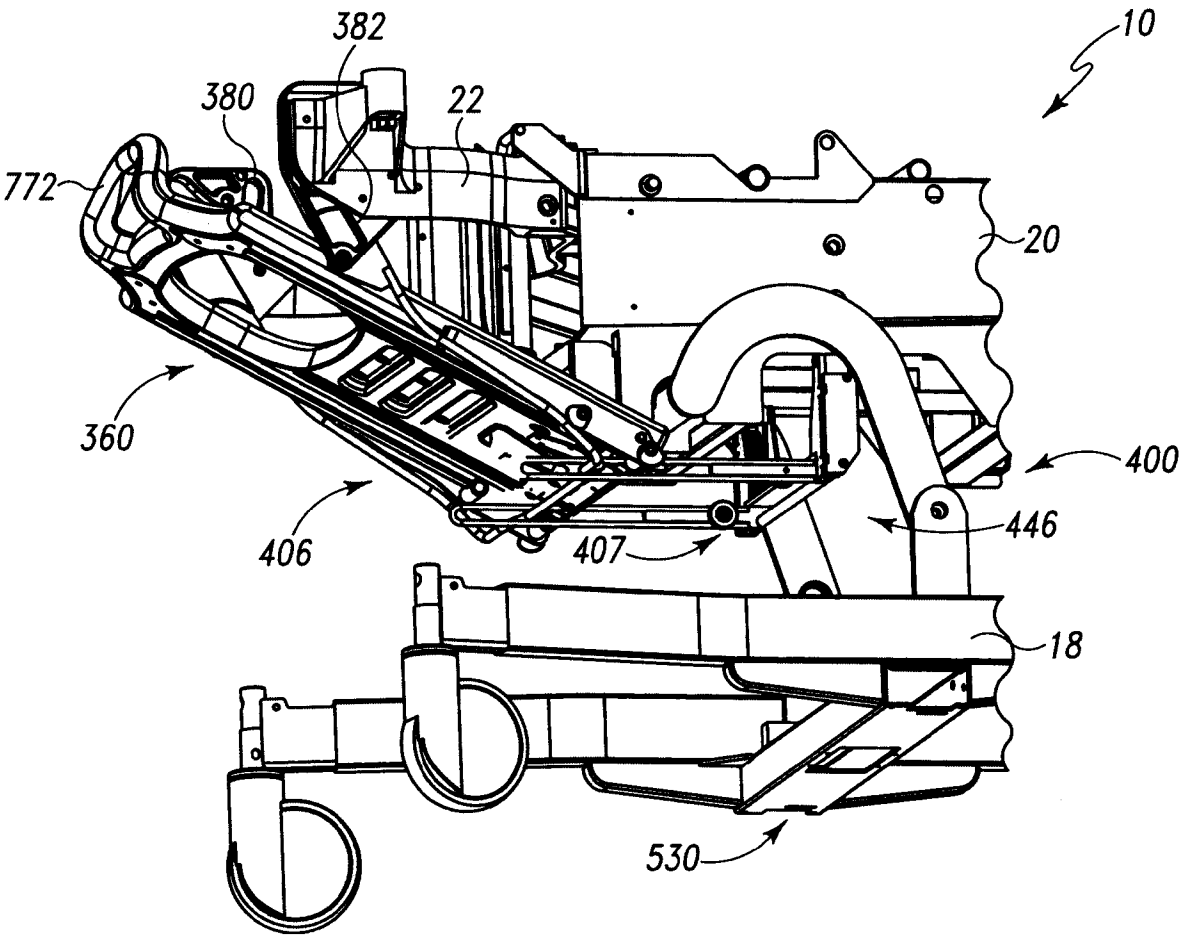
Figure 36:
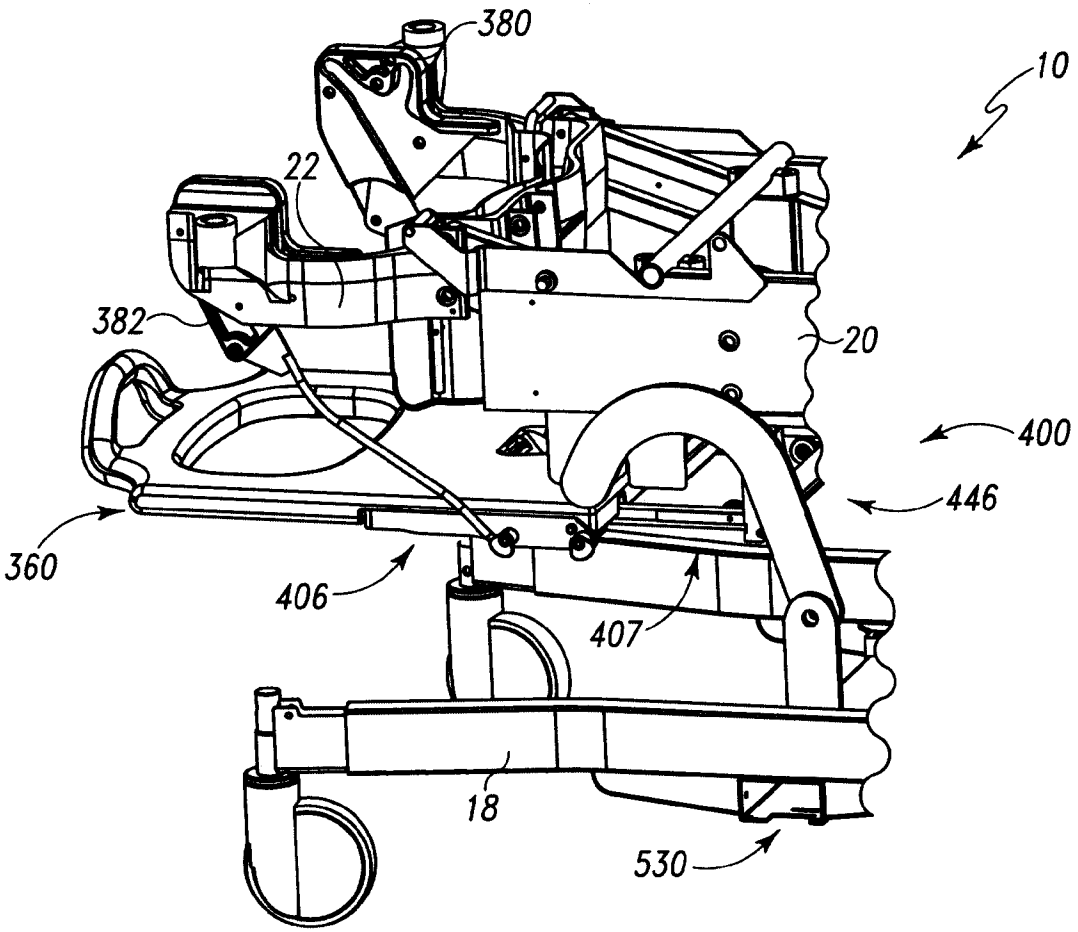
Figure 37:
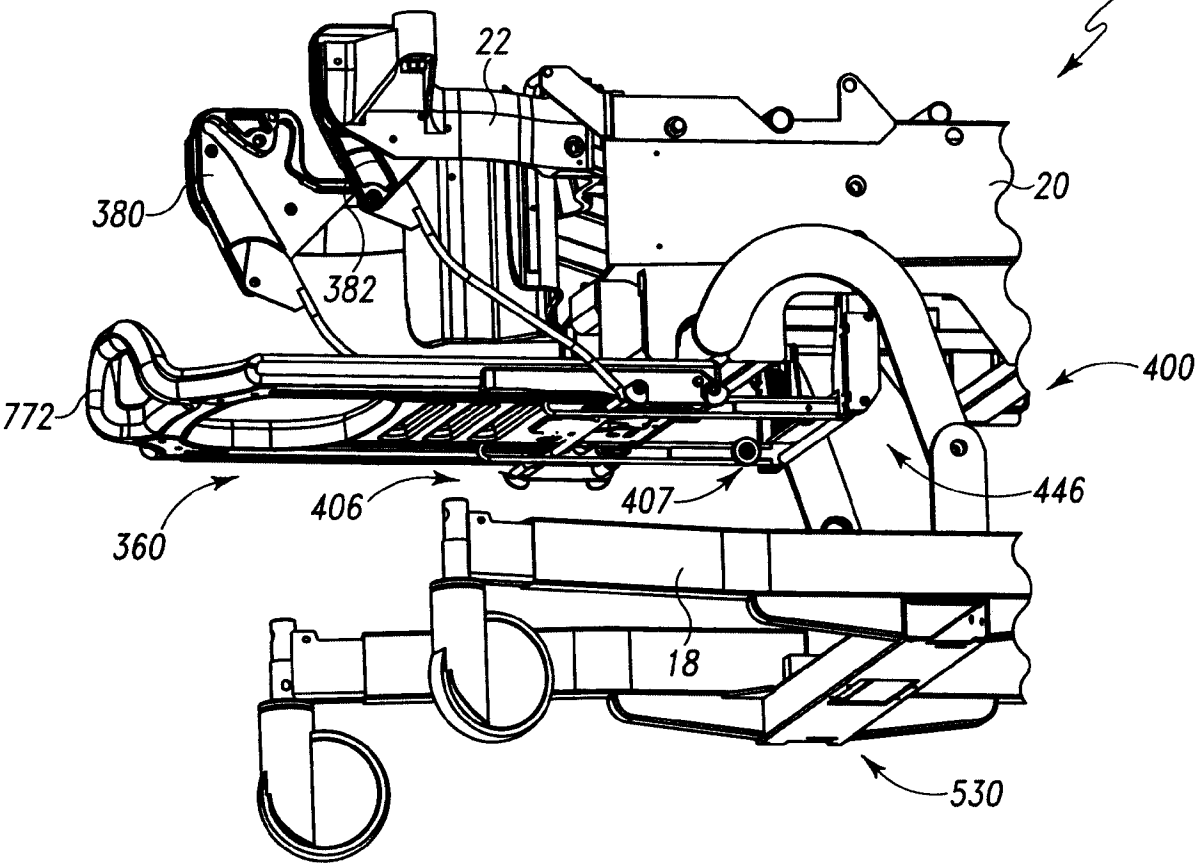
Figure 38:
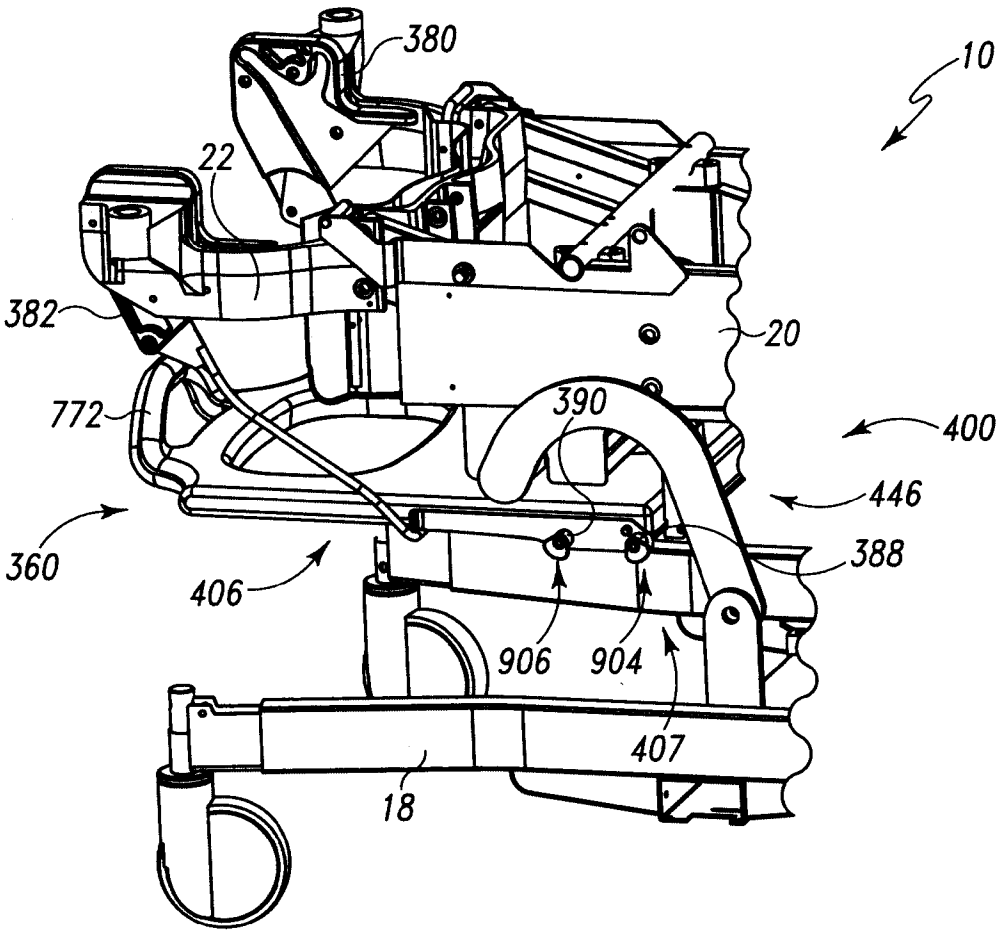

A user continues to move foot deck section 360 down guide 406 and onto frame 407 as illustrated in FIGS. 34 and 35. Once foot deck section 360 is supported completely on frame 407, the opening for placenta basin 402 is positioned below support frame 22 and is movable longitudinally to a stowed position as shown in FIG. 2. To move the foot deck section 360 to a use position, a user simply pulls handle 770 and foot deck section 360 travels up guide 406 to engage with two receivers 380 and 382.

Figure 41:
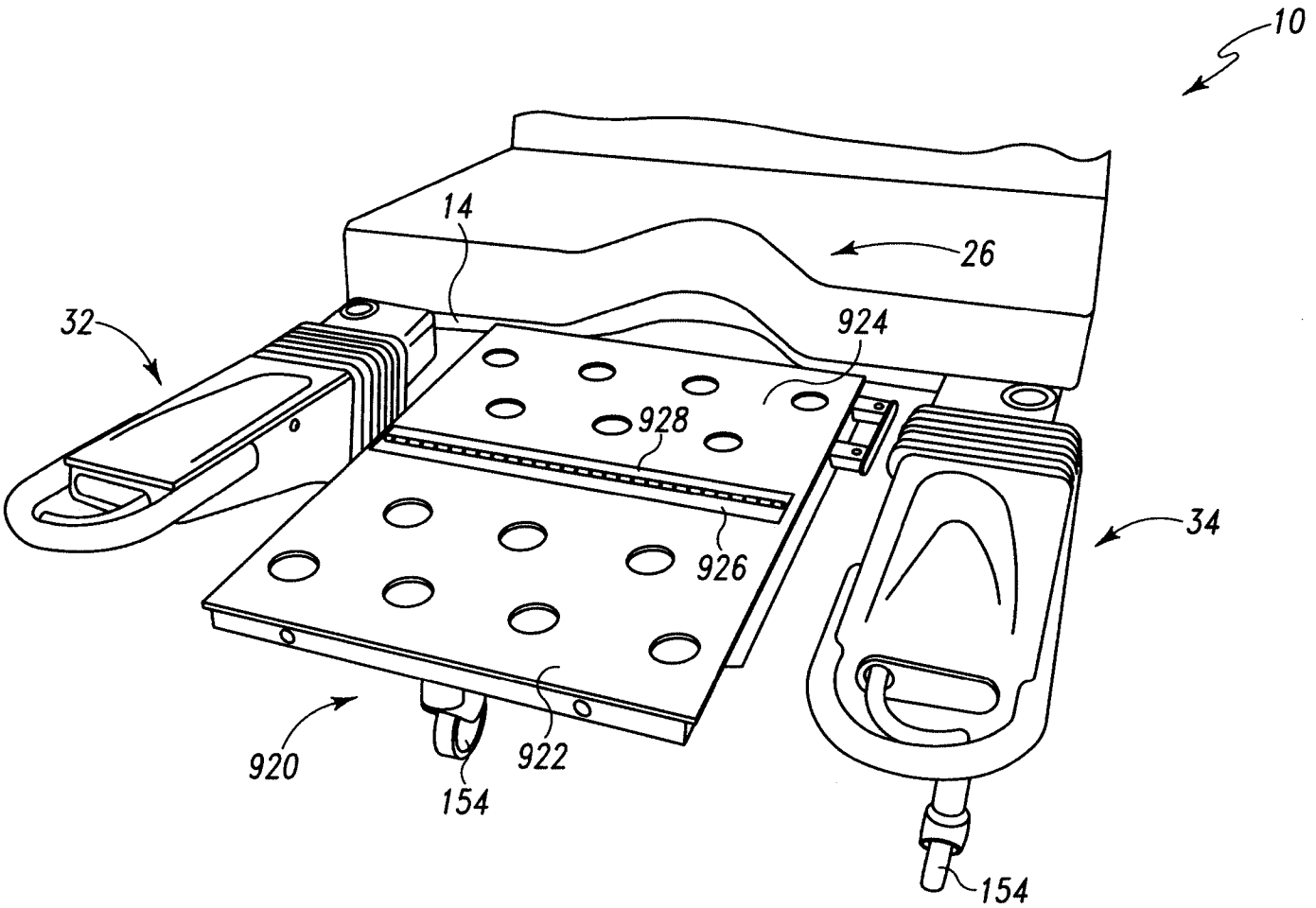
FIG. 41 is perspective view of another embodiment of birthing bed, the birthing bed having a stowable foot deck section that folds and articulates to a stowed position.
Figure 42:
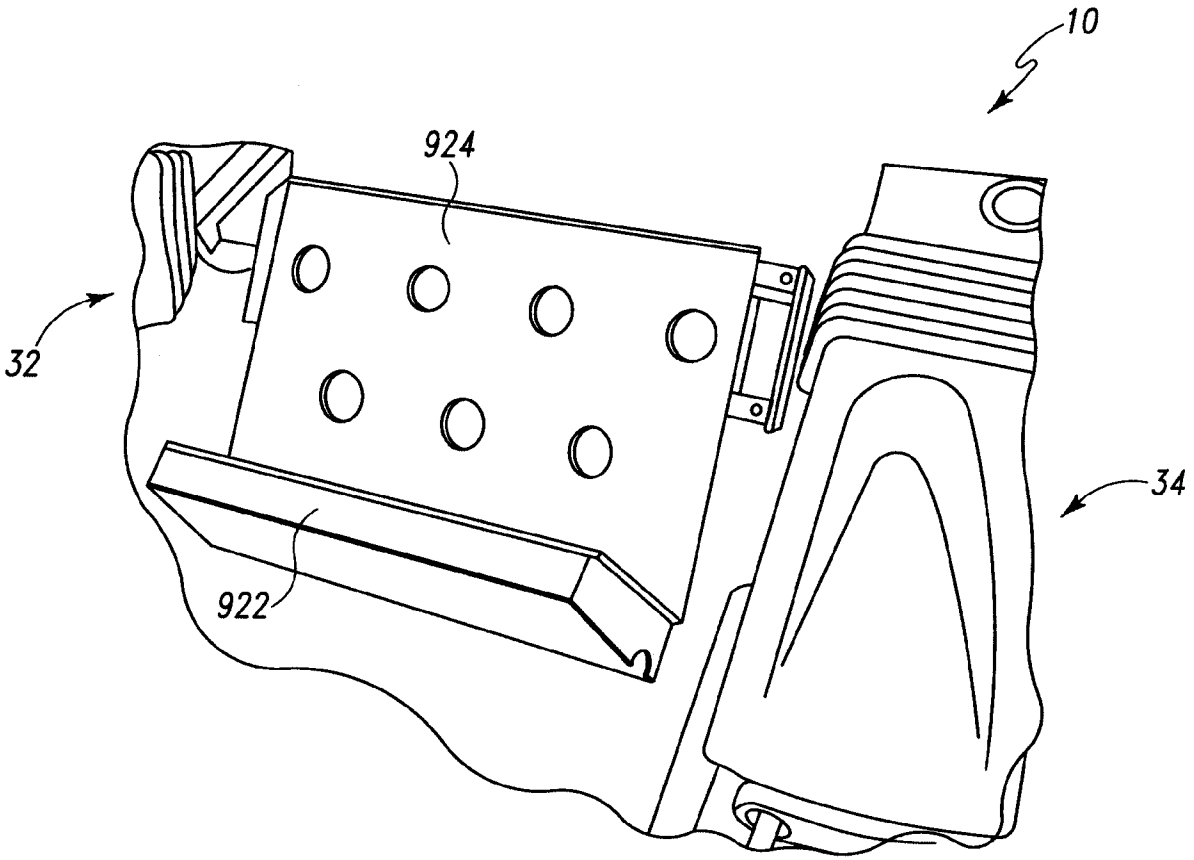
FIG. 42 is a perspective view of the stowable foot deck section of FIG. 41 in a stowed position.

In another illustrative embodiment, a foot deck section 920 comprises a first deck portion 922 and a second deck portion 924 interconnected through a pair of hinge members 926 and 928 as shown in FIG. 41. A slide (not shown) coupled to the bottom of first deck portion 922 is movable between a position wherein the slide does not engage the second deck portion 924 and a second position, wherein the slide engages second deck portion 924 to provide a rigid support under first deck portion 922 and second deck portion 924 similar to a support member for a table leaf as is known in the art. In the illustrative embodiment of FIGS. 41 and 42, first deck portion 922 pivots relative to second deck portion 924 to fold the deck portions together. In the collapsed state shown in FIG. 42, foot deck section 920 is stowed between the two foot supports 32 and 34. In some embodiments, foot deck section 920 may include two slides actuated by a cable assembly with one cable assembly permitting movement of first deck portion 922 relative to second deck portion 924 and a second slide permitting pivoting of second deck portion 924 relative to support frame 22. In some embodiments, the slides may be spring loaded such that the slides are biased to the position shown in FIG. 41 and must be released by a user to articulate to the stowed position shown in FIG. 42.

Although certain illustrative embodiments have been described in detail above, variations and modifications exist within the scope and spirit of this disclosure as described and as defined in the following claims.

The invention claimed is:

1. A patient-support apparatus comprising, a frame including first and second members, a first receiver coupled to the first member, the first receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, a second receiver coupled to the second member and positioned on the frame opposite the first receiver, the second receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, and a patient-support deck including a main portion having first and second lateral sides, a first support bracket coupled to the main portion and positioned on the first side, and a second support bracket coupled to the main portion and positioned on the second side positioned laterally opposite the first support bracket, the first and second brackets configured to engage the first and second receivers respectively to support and secure the patient-support deck on the frame.

2. The patient-support apparatus of claim 1, wherein the first and second support brackets are positioned proximate an end of the patient-support deck.

3. The patient-support apparatus of claim 2, wherein the patient-support deck is supported on the frame in a cantilevered configuration.

4. The patient-support apparatus of claim 1, wherein the patient-support deck further comprises first and second handles secured to the main portion and positioned on the first and second sides respectively.

5. The patient-support apparatus of claim 4, wherein the handles comprise a flexible material.

6. The patient-support apparatus of claim 1, wherein the patient-support deck includes a stand coupled to a main portion of the patient-support deck, the stand configured to support the patient-support deck with a patient support surface spaced apart from the floor when the patient-support deck is removed from the patient-support apparatus.

7. The patient-support apparatus of claim 6, wherein the stand comprises a first and second legs which are positioned adjacent a lower surface of the main portion when the patient-support deck is supported on the patient-support apparatus and which automatically deploy when the patient-support deck is engaged with the floor.

8. The patient-support apparatus of claim 6, wherein the stand comprises a wireform secured to a lower surface of the main portion of the patient-support deck.

9. The patient-support apparatus of claim 1, wherein the first and second support brackets comprise a bearing material positioned to engage with the inclined and lower surfaces of the first and second receivers as the patient-support deck is positioned on the patient-support apparatus.

10. The patient-support apparatus of claim 1, wherein the removable foot deck section further comprises first and second handles secured to the main portion and positioned on the first and second lateral sides respectively.

11. The patient-support apparatus of claim 10, wherein the handles comprise a flexible material.

12. A patient-support apparatus comprising, a frame including first and second members, a patient-support deck including a head deck section, a removable foot deck section, and a seat deck section arranged to lie therebetween, and deck support means for supporting the removable foot deck section to cause the removable foot deck section to extend away from the seat deck section above the first and second members of the frame in a cantilevered-use position to cause the removable foot deck section to move relative to the seat deck section in response to movement of the first and second members during adjustment of the patient-support apparatus and to cause the removable foot deck section to be aligned with the first and second members so that the removable foot deck section is centered during re-attachment or the removable foot deck section to establish the cantilevered-use position, wherein the deck support means includes a first receiver coupled to the first member, the first receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, a second receiver coupled to the second member and positioned on the frame opposite the first receiver, the second receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, a first support bracket coupled to a first lateral side included in a main portion of the removable foot deck section, and a second support bracket coupled to a second lateral side of the main portion of the removable foot deck section positioned opposite the first support bracket, the first and second brackets configured to engage the first and second receivers respectively to support and secure the removable foot deck section on the frame.

13. The patient-support apparatus of claim 12, wherein the first and second support brackets are positioned proximate an end of the removable foot deck section.

14. The patient-support apparatus of claim 12, wherein the removable foot deck section further includes a stand coupled to the main portion of the removable foot deck section, the stand configured to support the removable foot deck section with a patient support surface spaced apart from the floor when the removable foot deck section is removed from the patient-support apparatus.

15. The patient-support apparatus of claim 14, wherein the stand comprises a wireform secured to a lower surface of the main portion of the patient-support deck.

16. The patient-support apparatus of claim 12, wherein the first and second support brackets comprise a bearing material positioned to engage with the inclined and lower surfaces of the first and second receivers as the removable foot deck section is positioned on the patient-support apparatus.

17. A patient-support apparatus comprising, a frame including first and second members, a first receiver coupled to the first member, the first receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, a second receiver coupled to the second member and positioned on the frame opposite the first receiver, the second receiver including a first protrusion forming a generally vertical boundary, a second protrusion spaced apart from the first protrusion to form a generally vertical boundary, a lower generally vertical surface positioned interposed between the first and second protrusions, and an inclined surface interposed between the first and second protrusions, the inclined surface spaced vertically above the lower surface and intersecting the lower surface, and a patient-support deck including a main portion having first and second lateral sides positioned proximate an end of the patient-support deck, a first support bracket coupled to the main portion and positioned on the first side, a second support bracket coupled to the main portion and positioned on the second side positioned laterally opposite the first support bracket, the first and second brackets configured to engage the first and second receivers respectively to support and secure the patient-support deck on the frame, first and second handles secured to the main portion and positioned on the first and second lateral sides respectively, and a stand coupled to the main portion of the patient-support deck and configured to support the patient-support deck with a patient support surface spaced apart from the floor when the patient-support deck is removed from the patient-support apparatus.

18. The patient-support apparatus of claim 17, wherein the handles comprise a flexible material.

19. The patient-support apparatus of claim 17, wherein the stand comprises a wireform secured to a lower surface of the main portion of the patient-support deck.

20. The patient-support apparatus of claim 17, wherein the first and second support brackets comprise a bearing material positioned to engage with the inclined and lower surfaces of the first and second receivers as the patient-support deck is positioned on the patient-support apparatus.

* * * * *